US011473294B2

(12) United States Patent
Russell et al.

(10) Patent No.: US 11,473,294 B2
(45) Date of Patent: Oct. 18, 2022

(54) BUILDING STRUCTURE AND KIT THEREFOR

(71) Applicant: Patricia Dawn Russell, Montreal (CA)

(72) Inventors: Patricia Dawn Russell, Montreal (CA); Oscar Javier Acosta Palacios, Montreal (CA)

(73) Assignee: Patricia Dawn Russell, Montreal (CA)

( * ) Notice: Subject to any disclaimer, the term of this patent is extended or adjusted under 35 U.S.C. 154(b) by 13 days.

(21) Appl. No.: 16/230,294

(22) Filed: Dec. 21, 2018

(65) Prior Publication Data

US 2019/0194932 A1 Jun. 27, 2019

Related U.S. Application Data

(60) Provisional application No. 62/609,355, filed on Dec. 22, 2017.

(51) Int. Cl.

| | |
|---|---|
| ***E04B 1/348*** | (2006.01) |
| ***E04B 1/76*** | (2006.01) |
| ***E04B 1/74*** | (2006.01) |
| ***E04F 13/00*** | (2006.01) |

(52) U.S. Cl.
CPC ..... *E04B 1/348* (2013.01); *E04B 1/3483* (2013.01); *E04B 1/74* (2013.01); *E04B 1/7675* (2013.01); *E04F 13/00* (2013.01)

(58) Field of Classification Search
CPC ..... E04B 1/348; E04B 1/3483; E04B 1/7675; E04B 1/74; E04B 1/34807; E04B 1/19; E04B 2/58; E04B 2001/199; E04B 2001/1993; E04B 1/34384; E04B 2001/34389; E04F 13/00; E04H 1/005; E04H 2001/1283
See application file for complete search history.

(56) References Cited

U.S. PATENT DOCUMENTS

| | | | | |
|---|---|---|---|---|
| 2,271,584 A * | 2/1942 | Fellom | E04B 2/58 | 52/506.09 |
| 3,881,292 A * | 5/1975 | Porter | E04B 1/7612 | 52/461 |
| 4,334,394 A * | 6/1982 | Mader | E04B 1/74 | 52/309.12 |
| 4,443,992 A * | 4/1984 | Shechter | E04B 1/3483 | 52/745.02 |
| 5,625,998 A * | 5/1997 | Madsen | E04B 1/3483 | 52/745.03 |
| 9,121,168 B2 * | 9/2015 | Levy | E04B 1/3483 | |
| 10,000,939 B1 * | 6/2018 | Gill | E04H 9/14 | |

(Continued)

*Primary Examiner* — Jessie T Fonseca
(74) *Attorney, Agent, or Firm* — Brouillette Legal Inc.; Robert Brouillette

(57) ABSTRACT

A building structure and a kit comprising: a hollow shell; a plurality of exterior panel assemblies attached to an exterior surface of the shell, each panel assembly including: a mounting member extending outwardly from the shell, the mounting member having a first end secured to the shell and a second end located away from the shell; an exterior wall panel secured to the second end of the mounting member so as to be spaced from the shell. According to another aspect, there is also provided a building structure and a kit comprising: a hollow shell defining an interior enclosure sized and shaped to house at least one individual; a plurality of modular wall sections secured to the hollow shell inside the interior enclosure.

21 Claims, 37 Drawing Sheets

(56) References Cited

U.S. PATENT DOCUMENTS

| | | | | |
|---|---|---|---|---|
| 2004/0006942 | A1* | 1/2004 | Greenway | E04D 13/1637 52/309.8 |
| 2012/0037198 | A1* | 2/2012 | Cantin | E04B 1/34384 135/143 |
| 2012/0137610 | A1* | 6/2012 | Knight | E04B 2/58 52/309.1 |
| 2012/0174511 | A1* | 7/2012 | Harding | E04D 13/076 52/302.1 |
| 2014/0196394 | A1* | 7/2014 | Greeson | B60J 10/80 52/404.2 |
| 2014/0259970 | A1* | 9/2014 | Shapiro | E04B 1/7629 52/27 |
| 2016/0017601 | A1* | 1/2016 | Bottin | E04B 5/10 52/79.1 |
| 2016/0017653 | A1* | 1/2016 | Bottin | E06B 1/18 52/79.1 |
| 2017/0226753 | A1* | 8/2017 | Gosling | E04F 19/0436 |
| 2019/0234063 | A1* | 8/2019 | Garcia-Abril Ruiz | E04B 5/40 |
| 2020/0040565 | A1* | 2/2020 | Viehweg | E04B 1/34331 |

* cited by examiner

BUILDING STRUCTURE AND KIT THEREFOR

TECHNICAL FIELD

The invention relates to building structures, and more specifically to building structures including one or more hollow shell such as shipping containers. The invention also relates to kits for building structures including one or more hollow shell such as shipping containers.

BACKGROUND

Houses and other building structures made of recycled and eco-friendly material materials have become relatively popular in the last few years.

Specifically, there has been an increase in demand for houses made using reclaimed shipping containers, and more specifically high cube (e.g. 9'6" exterior dimensioning) standard intermodal shipping containers. Used shipping containers are sought-after building material because they are found in virtually every country in the world, are plentiful, are relatively cheap, are usually already assembled and are easy to transport. Intermodal Steel Building Units are also much stronger than most construction modules. For some, shipping containers may also provide a relatively aesthetically pleasing appearance to a house, since the module is cladded with a variety of material choices and has flexibility for many zoning requirements.

Some systems and assemblies have been proposed to retrofit existing containers and provide houses and/or other types of structures which can provide a comfortable living space for one or more individual.

Unfortunately, most of these systems and assemblies are complex, require skilled workers to assemble and are relatively expensive to produce and/or assemble.

There is therefore a need for an assembly or a system which would overcome at least one of the above-identified drawbacks.

BRIEF SUMMARY

There is provided a building structure comprising: a hollow shell defining an interior enclosure sized and shaped to house at least one individual; a plurality of exterior panel assemblies attached to an exterior surface of the hollow shell, each panel assembly including: a mounting member extending outwardly from the hollow shell, the mounting member having a first end secured to the hollow shell and a second end located away from the hollow shell; and an exterior wall panel secured to the second end of the mounting member so as to be spaced from the hollow shell.

a building structure comprising: a hollow shell defining an interior enclosure sized and shaped to house at least one individual, a plurality of exterior panel assemblies attached to an exterior surface of the hollow shell, each panel assembly including: a mounting member extending outwardly from the hollow shell, the mounting member having a first end secured to the hollow shell and a second end located away from the hollow shell, and an exterior wall panel secured to the second end of the mounting member so as to be spaced from the hollow shell.

In one embodiment, the mounting member includes an elongated body disposed generally orthogonally to the exterior wall panel.

In one embodiment, the mounting member includes a metal rod.

In one embodiment, the first end of the mounting member is welded to the exterior of the hollow shell.

In one embodiment, the exterior wall panel includes an interior face disposed towards the hollow shell, an exterior face disposed away from the hollow shell and at least one channel defined in the interior face to receive the second end of the mounting member.

In one embodiment, each channel is disposed horizontally.

In one embodiment, each channel includes a U-shaped member having a pair of parallel sidewalls disposed horizontally, an end wall extending between the parallel sidewalls and an open side opposite the end wall and facing towards the hollow shell.

In one embodiment, the second end of the mounting member includes an enlarged portion adapted to slidably engage a corresponding one of the at least one channel.

In one embodiment, the channel is a strut channel.

In one embodiment, the building structure further comprises a layer of insulating material disposed between the panel and the shell.

In one embodiment, the hollow shell includes at least one construction module.

In one embodiment, the at least one construction module is made of metal, wood, concrete, fiberglass or polymer.

In one embodiment, the hollow shell includes at least one shipping container.

In one embodiment, the at least one shipping container includes at least one intermodal shipping container.

In one embodiment, the shipping container is rectangular.

According to another aspect, there is also provided a kit for a building structure comprising: a hollow shell defining an interior enclosure sized and shaped to house at least one individual; a plurality of exterior panel assemblies adapted to be attached to an exterior surface of the hollow shell, each panel assembly including: a mounting member adapted to be secured to the hollow shell so as to extend outwardly therefrom, the mounting member having a first end adapted to be secured to the hollow shell and a second end located away from the first end; and an exterior wall panel adapted to be secured to the second end of the mounting member so as to be spaced from the hollow shell.

In one embodiment, the mounting member includes an elongated body disposed generally orthogonally to the exterior wall panel.

In one embodiment, the mounting member includes a metal rod.

In one embodiment, the first end of the mounting member is adapted to be welded to the exterior of the hollow shell.

In one embodiment, the exterior wall panel includes an interior face adapted to be disposed towards the hollow shell, an exterior face adapted to be disposed away from the hollow shell and at least one channel defined in the interior face to receive the second end of the mounting member.

In one embodiment, each channel is adapted to be disposed horizontally.

In one embodiment, each channel includes a U-shaped member having a pair of parallel sidewalls adapted to be disposed horizontally, an end wall extending between the parallel sidewalls and an open side opposite the end wall and facing towards the hollow shell.

In one embodiment, the second end of the mounting member includes an enlarged portion adapted to slidably engage a corresponding one of the at least one channel.

In one embodiment, the channel is a strut channel.

In one embodiment, the kit further comprises a layer of insulating material adapted to be disposed between the panel and the shell.

In one embodiment, the hollow shell includes at least one construction module.

In one embodiment, the at least one construction module is made of metal, wood, concrete, fiberglass or polymer.

In one embodiment, the hollow shell includes at least one shipping container.

In one embodiment, the at least one shipping container includes at least one intermodal shipping container.

In one embodiment, the shipping container is rectangular.

According to another aspect, there is also provided a building structure comprising: a hollow shell defining an interior enclosure sized and shaped to house at least one individual; and a plurality of dividing wall sections secured to the hollow shell inside the interior enclosure.

In one embodiment, the building structure further includes a plurality of mounting members secured to one of a floor and a ceiling of the interior enclosure at a predetermined location, each dividing wall section being secured to the at least one of the plurality of mounting members to position at least one interior wall panel to the predetermined location.

In one embodiment, each mounting member includes at least one post member secured to the corresponding one of the floor and the ceiling and to be disposed vertically.

In one embodiment, each mounting member includes a base plate secured to the corresponding one of the floor and the ceiling and a pair of post members extending upwardly from the base plate.

In one embodiment, the base plate is elongated and has a first end and a second end, the pair of post members including a first post member located near the first end and a second post member located near the second end.

In one embodiment, each post member has a rectangular cross-section.

In one embodiment, each post member has a square cross-section.

In one embodiment, each post member is sized and shaped to be slidably received in a corresponding tubular vertical frame member of one of the dividing wall sections having a corresponding cross-section.

In one embodiment, the building structure further comprises a plurality of securing members for securing the dividing wall section to a corresponding post member, each securing member having a first end portion secured to the corresponding post member and second end portion secured to the dividing wall section.

In one embodiment, each securing member is flat and L-shaped, the first end portion being disposed vertically along the corresponding post member and the second end portion being disposed horizontally along a horizontal frame member of the dividing wall section.

In one embodiment, the plurality of dividing wall sections includes a wall frame and a plurality of interior wall panels enclosing the wall frame.

In one embodiment, the wall frame includes a plurality of vertical frame members and a plurality of horizontal frame members extending transversely between the vertical frame members.

In one embodiment, each vertical frame member includes a plurality of bracket holes for mounting at least one bracket to hold at least one of an accessory, a fitting and a device.

In one embodiment, the interior wall panel is rectangular.

In one embodiment, the hollow shell includes at least one construction module.

In one embodiment, the at least one construction module is made of metal, wood, concrete, fiberglass or polymer.

In one embodiment, the hollow shell includes at least one shipping container.

In one embodiment, the at least one shipping container includes at least one intermodal shipping container.

In one embodiment, the shipping container is rectangular.

According to another aspect, there is also provided a kit for a building structure comprising: a hollow shell defining an interior enclosure sized and shaped to house at least one individual; and a plurality of dividing wall sections adapted to be secured to the hollow shell inside the interior enclosure.

In one embodiment, the kit further includes a plurality of mounting members adapted to be secured to one of a floor and a ceiling of the interior enclosure at a predetermined location, each dividing wall section being secured to the at least one of the plurality of mounting members to position at least one interior wall panel to the predetermined location.

In one embodiment, each mounting member includes at least one post member adapted to be secured to the corresponding one of the floor and the ceiling and to be disposed vertically.

In one embodiment, each mounting member includes a base plate adapted to be secured to the corresponding one of the floor and the ceiling and a pair of post members extending upwardly from the base plate.

In one embodiment, the base plate is elongated and has a first end and a second end, the pair of post members including a first post member located near the first end and a second post member located near the second end.

In one embodiment, each post member has a rectangular cross-section.

In one embodiment, each post member has a square cross-section.

In one embodiment, each post member is sized and shaped to be slidably received in a corresponding tubular vertical frame member of one of the dividing wall sections having a corresponding cross-section.

In one embodiment, the kit further comprises a plurality of securing members for securing the dividing wall section to a corresponding post member, each securing member having a first end portion adapted to be secured to the corresponding post member and second end portion adapted to be secured to the dividing wall section.

In one embodiment, each securing member is flat and L-shaped, the first end portion being adapted to be disposed vertically along the corresponding post member and the second end portion being adapted to be disposed horizontally along a horizontal frame member of the dividing wall section.

In one embodiment, the plurality of dividing wall section includes a wall frame and a plurality of interior wall panels enclosing the wall frame.

In one embodiment, the wall frame includes a plurality of vertical frame members and a plurality of horizontal frame members extending transversely between the vertical frame members.

In one embodiment, each vertical frame member includes a plurality of bracket holes adapted for mounting at least one bracket to hold at least one of an accessory, a fitting and a device.

In one embodiment, the interior wall panel is rectangular.

In one embodiment, the hollow shell includes at least one construction module.

In one embodiment, the at least one construction module is made of metal, wood, concrete, fiberglass or polymer.

In one embodiment, the hollow shell includes at least one shipping container.

In one embodiment, the at least one shipping container includes at least one intermodal shipping container.

In one embodiment, the shipping container is rectangular.

According to another broad aspect, there is provided a dividing wall section for a building structure including a floor and a ceiling, the dividing wall section including at least one mounting member securable to at least one of the floor and the ceiling of the building structure at a predetermined location and at least one interior wall panel, the at least one interior wall panel being securable to the at least one mounting members to position the at least one interior wall panel to the predetermined location.

According to yet another broad aspect, there is provided a kit for a dividing wall section for a building structure including a floor and a ceiling, the kit including at least one mounting member adapted to be secured to at least one of the floor and the ceiling at a predetermined location and at least one interior wall panel, each of the at least one interior wall panel being adapted to be secured to the at least one mounting members to position the at least one interior wall panel to the predetermined location.

According to still another aspect, there is provided a wall section assembly for a building structure including at least one wall, the wall section assembly comprising at least one wall panel and at least one board connected to the at least one wall panel, the at least one board defining a passage for allowing at least one of an electric or a plumbing element to run along the wall section assembly.

According to a further broad aspect, there is provided a kit for a wall section assembly for a building structure including at least one wall, the kit comprising at least one wall panel and at least one board, connectable to the at least one wall panel, the at least one board defining a passage for allowing at least one of an electric element or a plumbing element to run along the wall section assembly.

Further details of the invention and its advantages will be apparent from the detailed description included below.

DETAILED DESCRIPTION

In the following description of the embodiments, references to the accompanying drawings are by way of illustration of an example by which the invention may be practiced. It will be understood that other embodiments may be made without departing from the scope of the invention disclosed.

Figure 1:
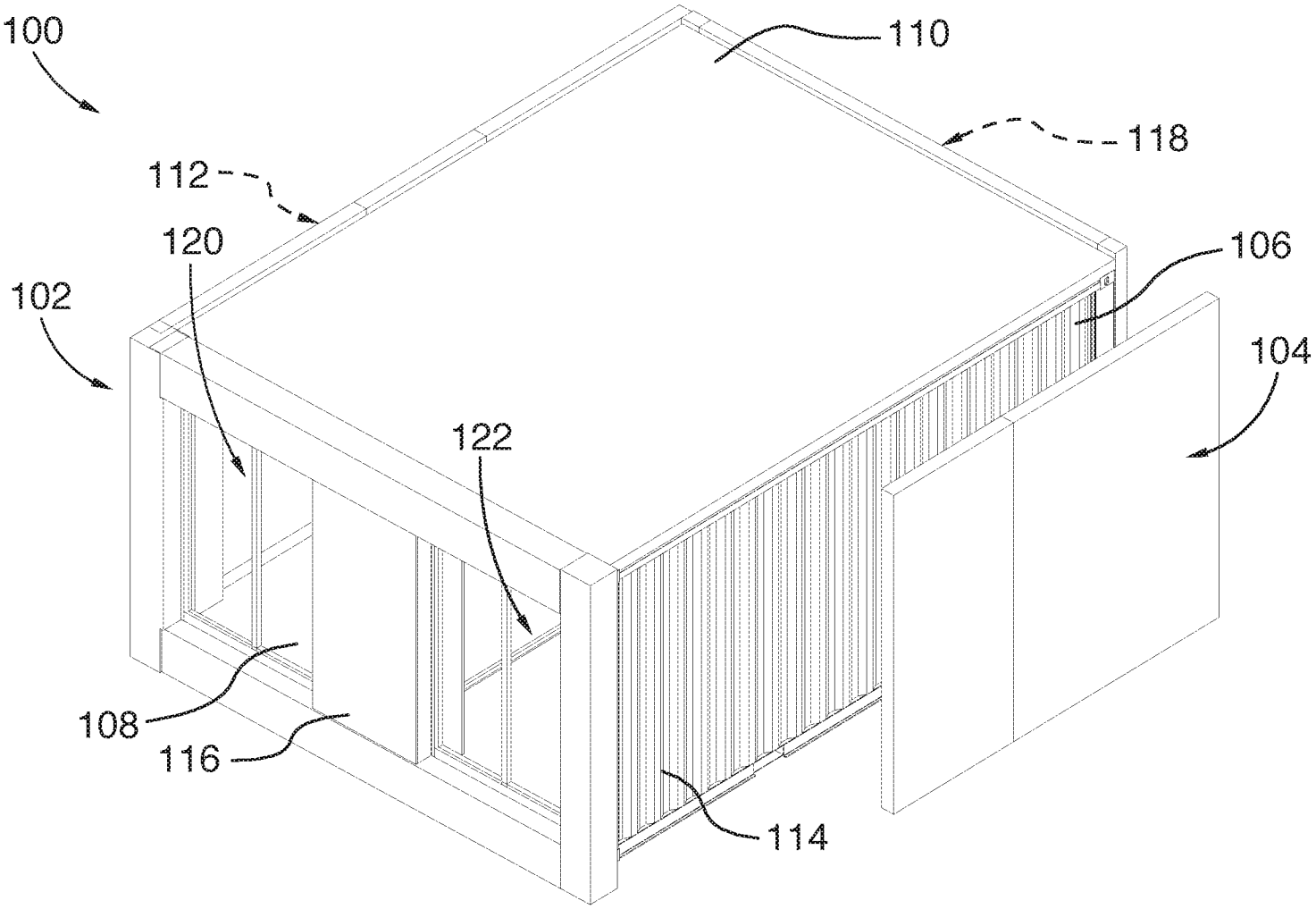
FIG. 1 is a top perspective view of a building structure, in accordance with one embodiment, with two exterior wall panels exploded and half of one of the exploded exterior wall panels removed to show the hollow shell.
Figure 2:
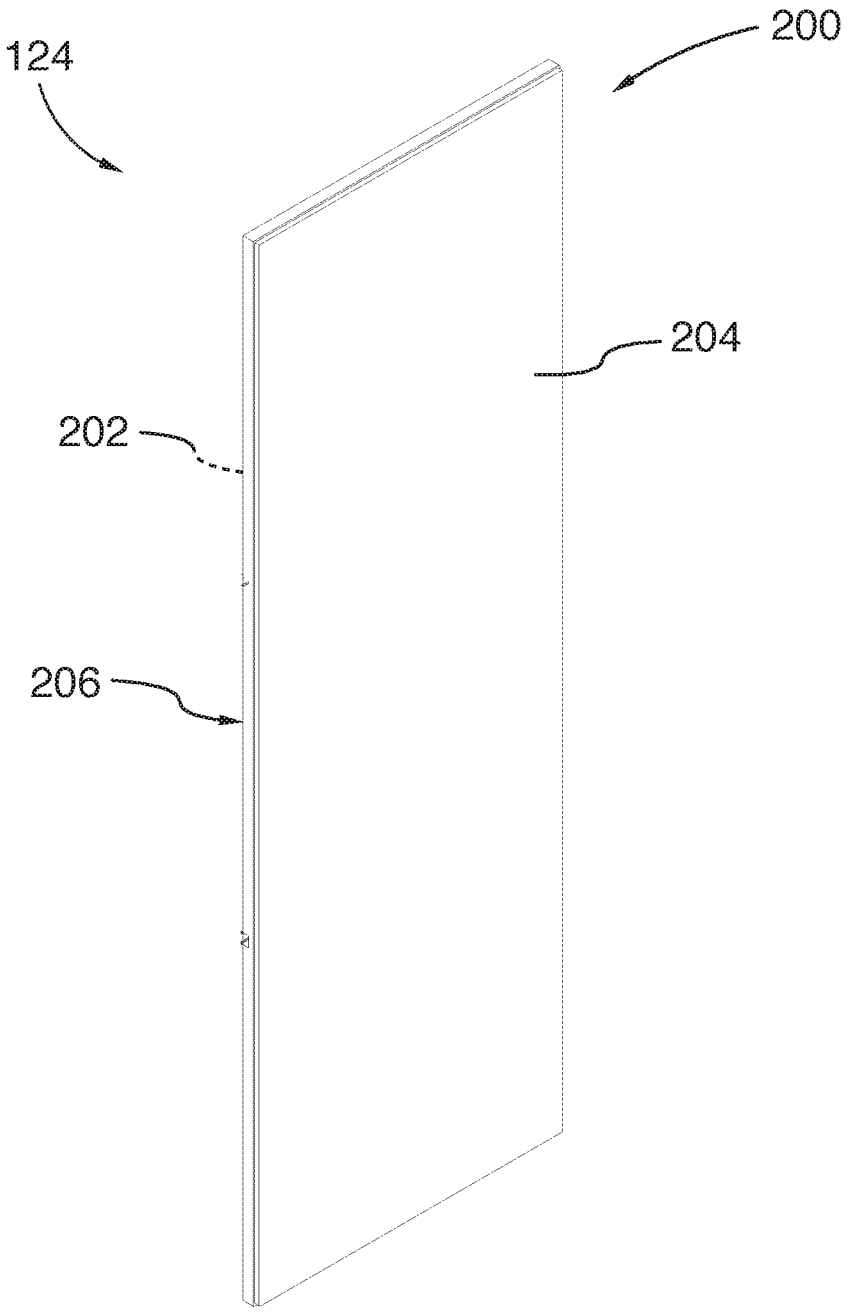
FIG. 2 is a top outer perspective view of an exterior wall panel for the building structure illustrated in FIG. 1.
Figure 3:
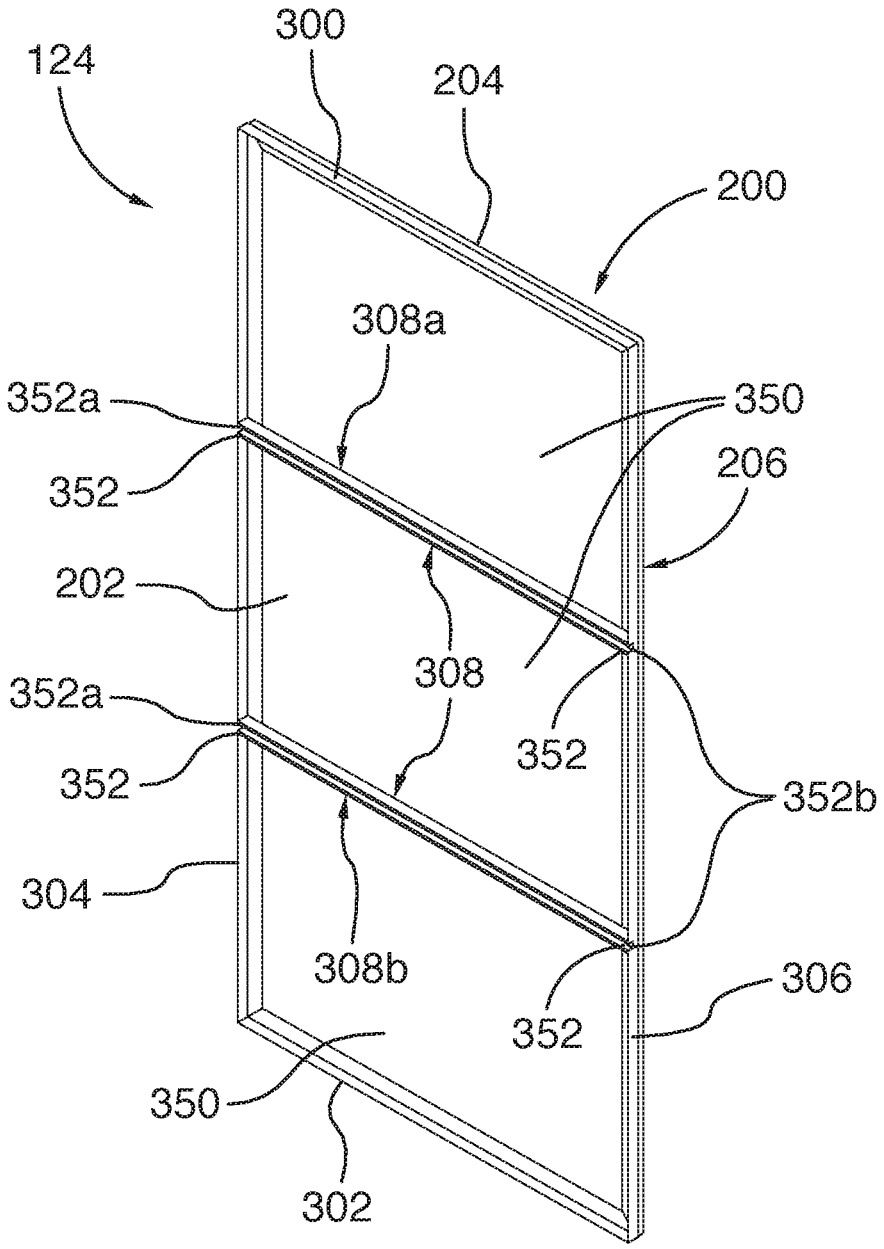
FIG. 3 is a top inner perspective view of the exterior wall panel illustrated in FIG. 2.
Figure 4:
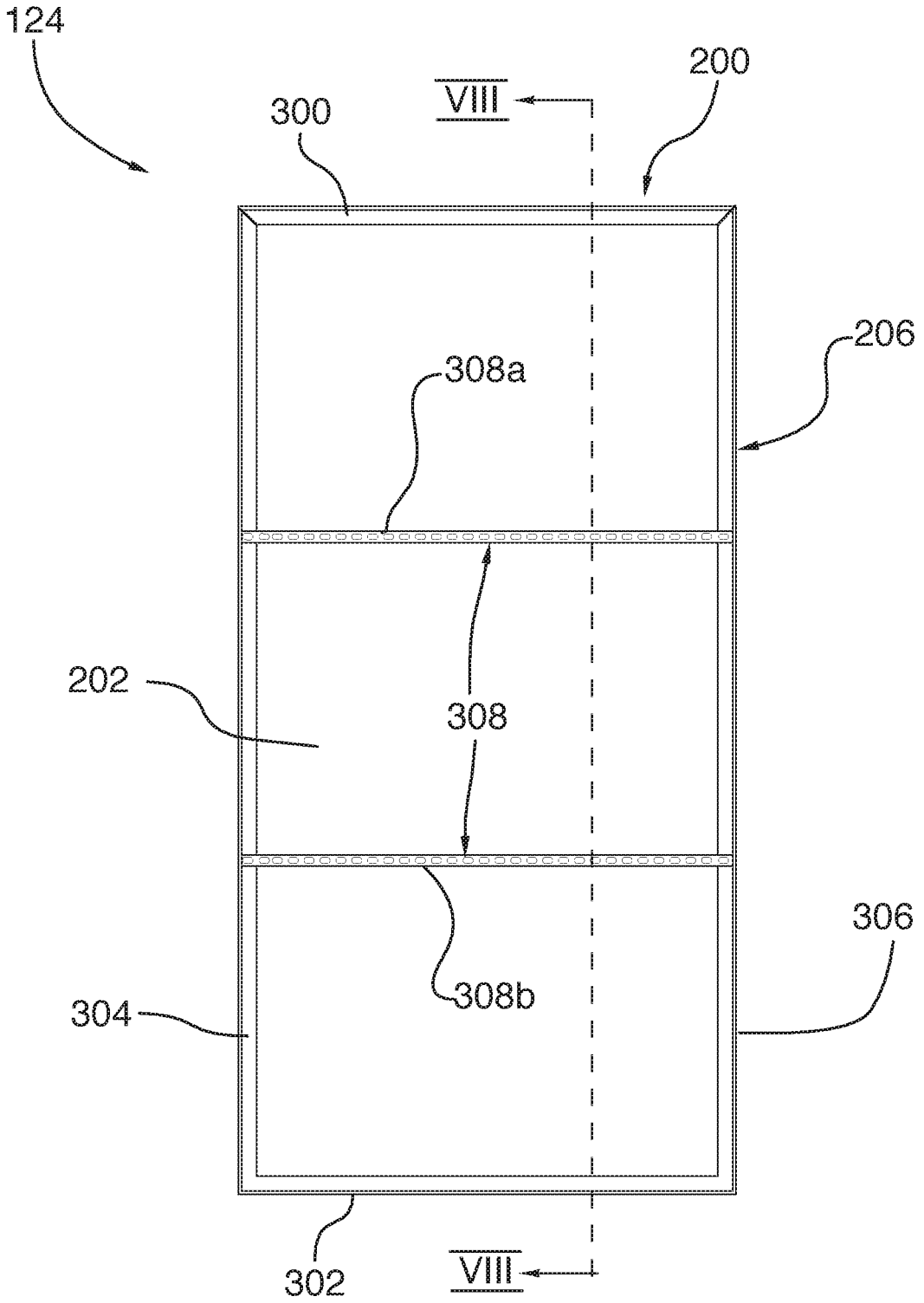
FIG. 4 is an inner elevation view of the exterior wall panel illustrated in FIG. 2.
Figure 5:
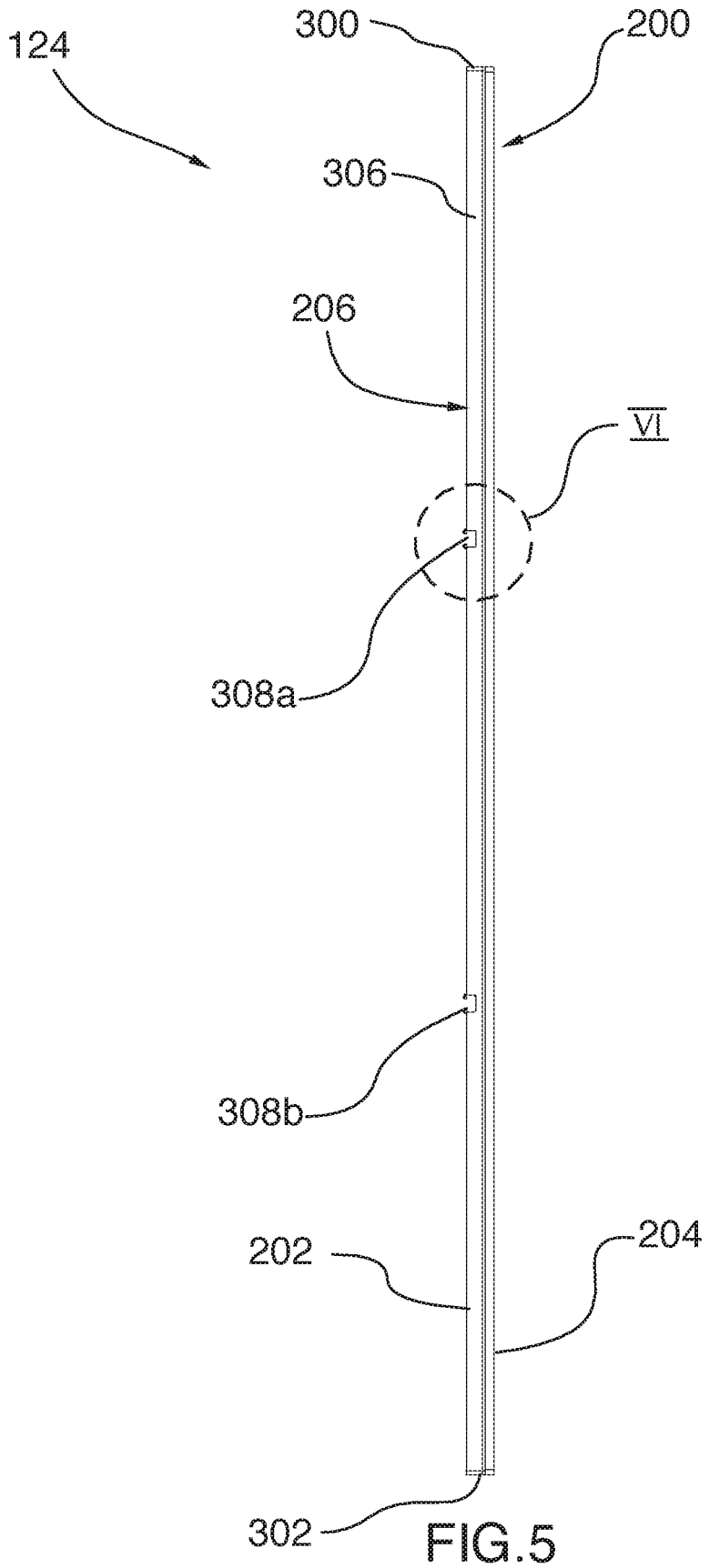
FIG. 5 is a side elevation view of the exterior wall panel illustrated in FIG. 2.

Referring first to FIG. 1, there is provided a building structure 100, in accordance with one embodiment. The building structure 100 includes a hollow structural shell 102 defining a supporting structure of the building structure 100 and at least one exterior panel assembly 104 attached to an exterior surface 106 of the shell. In the illustrated embodiment, the shell 102 is adapted to house at least one individual.

In the illustrated embodiment, the shell 102 includes a floor 108, a roof panel 110 generally disposed opposite and parallel to the floor 108 and first and second vertical side walls 112, 114 extending between the floor 108 and the roof panel 110.

Still in the illustrated embodiment, the shell 102 further includes first and second vertical end walls 116, 118 extending between the floor 108 and the roof panel 110 and disposed orthogonally to the between the first and second vertical side walls 112, 114. The first end wall 116 includes a first wall opening 120 located near the first vertical sidewall 112 and a second wall opening 122 located near the second vertical sidewall 114.

In the illustrated embodiment, the first and second wall openings 120, 122 are generally rectangular. Alternatively, the first and second wall openings 120, 122 could be round, oval or have any other shape that a skilled person may consider appropriate.

In one embodiment, at least one of the wall openings 120 or 122 could include a door which would allow access into the building structure 100. The door could be a patio door, for example, or any other door that a skilled person would consider appropriate. In this embodiment, the other wall opening 120 or 122 could be provided with a window pane to define a window. In another embodiment, both of the wall openings 120, 122 could include doors. In yet another embodiment, both of the wall openings 120, 122 could include windows and the shell 102 may include one or more additional wall openings defined in the second end wall 118 or in one of the side walls 112, 114 which could include a door.

Still referring to FIG. 1, the shell 102 includes at least one shipping container. In the illustrated embodiment, the shell 102 is manufactured from two intermodal shipping containers disposed side-to-side and connected together by a container attachment assembly to define a single hollow shell, as will be explained further below.

In one embodiment, the intermodal shipping container includes a typical intermodal shipping container as is known to a skilled addressee. The container walls are typically made of steel or a steel alloy such as weathering steel or the like. The container walls are also typically corrugated, as will appreciate a skilled addressee. Intermodal shipping containers also typically include 20-foot long containers and 40-foot long containers. Alternatively, the shipping containers could be of any other dimensions and be made of any other material that a skilled person would consider appropriate.

While in this embodiment the shell 102 is made from at least one container and, more precisely from two intermodal shipping containers, it will be appreciated that shell 102 could be manufactured from other types of construction modules such as, e.g., sectional prefabricated building shells, prefabricated home shells, precision built home shells, and the likes, may also be used without departing from the scope of the present invention. It is understood that the shell constructions referred hereinabove means construction substantially void of inner dividing walls. It will be appreciated by the skilled person that constructions not necessarily seen as modular construction like, e.g., doublewides or mobile homes, may also be used without departing from the scope of the present invention. The person skilled in the art will further appreciate that these building unit modules and other constructions may be made of various material including, but not limited to, metal, wood, concrete, fiberglass, polymer, a combination thereof or any other type of suitable material.

Figure 9:
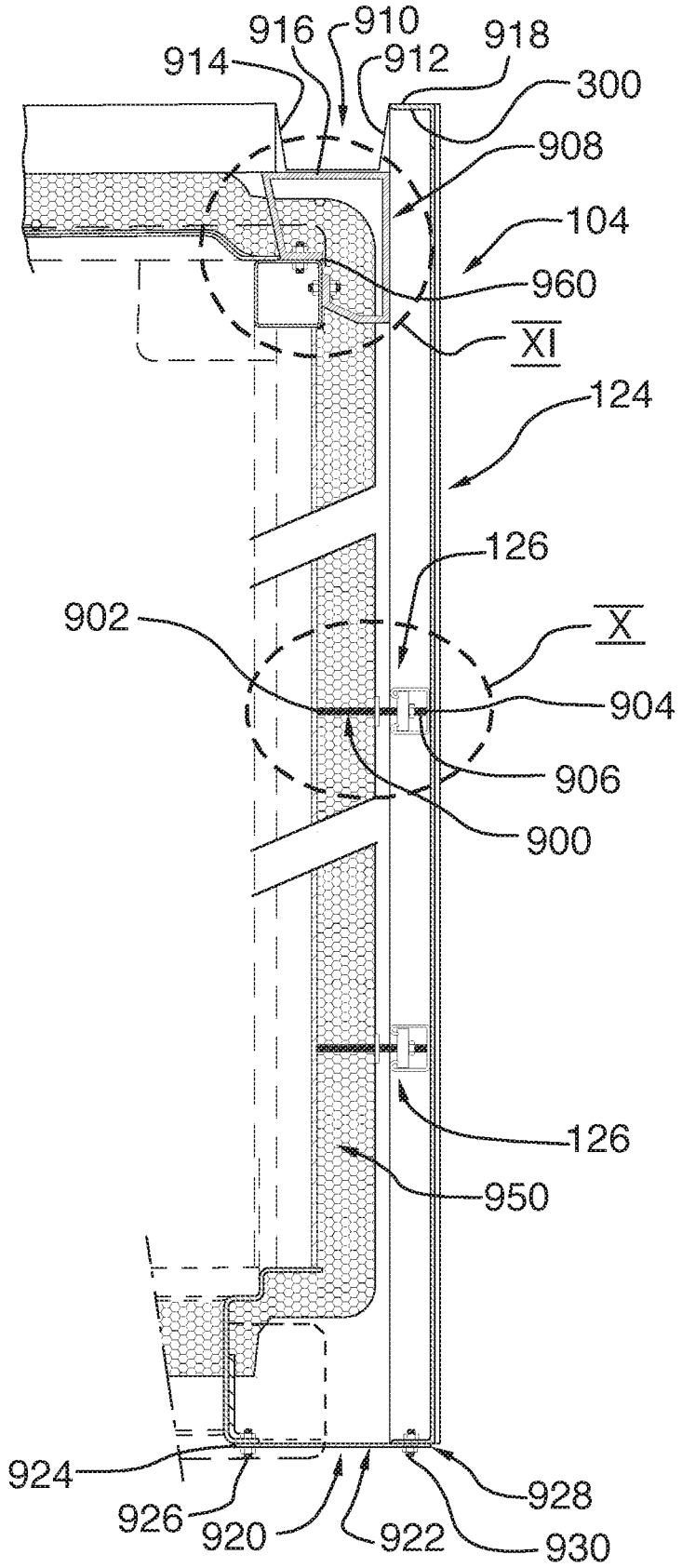
FIG. 9 is a schematic cross-sectional view of the exterior panel assembly illustrated in FIG. 1 mounted to the shell, in accordance with one embodiment.
Figure 10:
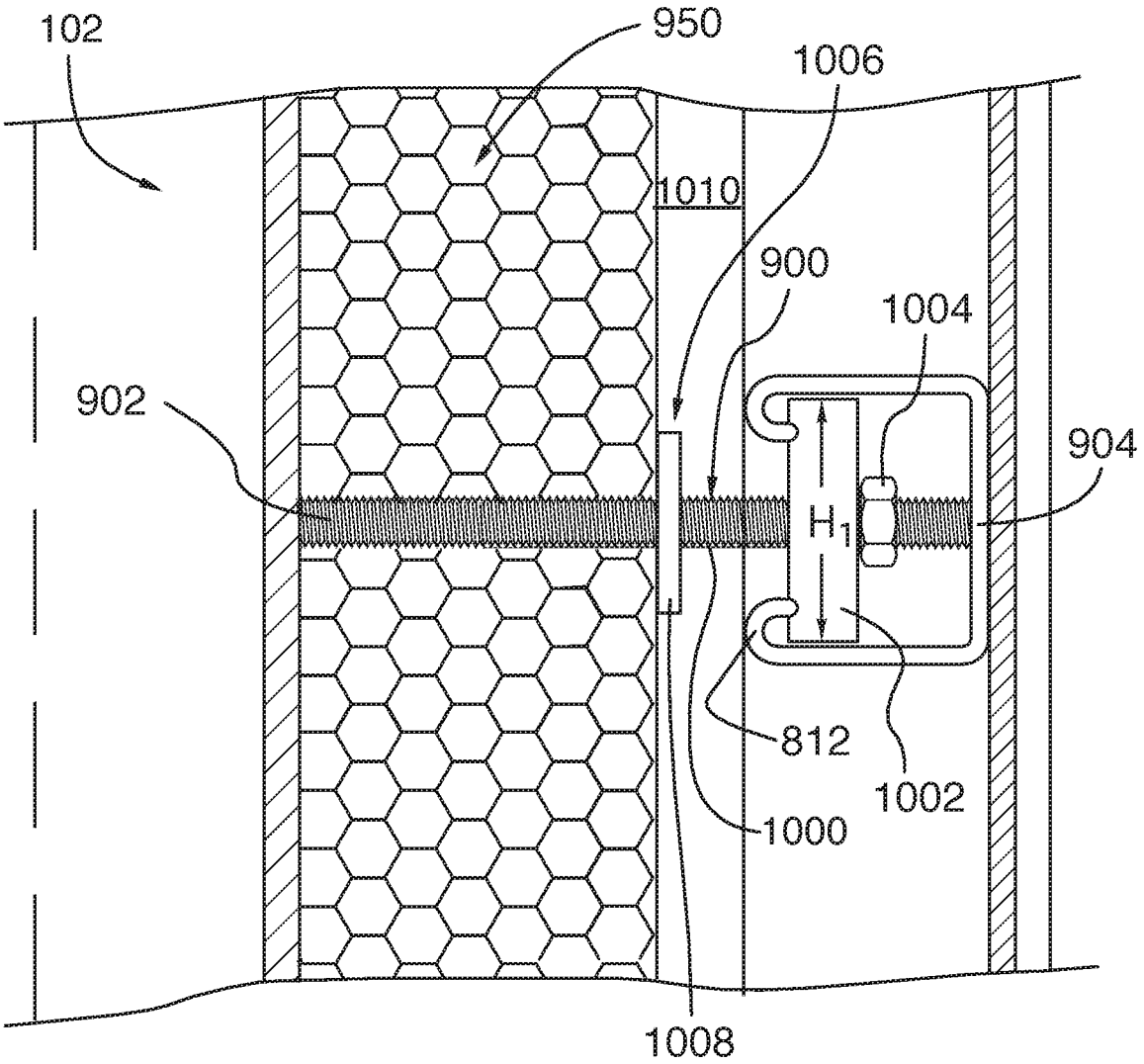
FIG. 10 is an enlarged portion of the cross-sectional view of the exterior panel assembly illustrated in FIG. 9, showing details of the mounting members.

Still in the illustrated embodiment, each exterior panel assembly 104 includes an exterior wall panel 124 and a plurality of mounting members 126 for securing the exterior wall panels to the shell 102, as will be shown further in FIGS. 9 and 10.

Turning to FIGS. 2 to 8, each exterior wall panel 124 includes a generally planar panel body 200 having an interior face 202 and an opposite exterior face 204. When the exterior wall panels 124 are attached to the shell 102, the interior face 202 is disposed towards the shell 102 and the exterior face 204 is disposed away from the shell 102.

In the illustrated embodiment, the exterior wall panel 124 further includes a panel frame 206 which is mounted to the interior face 202 of the panel body 200 and which is disposed on a perimeter of the panel body 200. Specifically, the panel frame 206 includes parallel top and bottom frame members 300, 302 disposed opposite each other and parallel first and second side frame members 304, 306 extending opposite each other and orthogonally to the top and bottom frame members 300, 302.

The exterior wall panel 124 further includes a plurality of channels 308 adapted to receive the mounting members 126. In the illustrated embodiment, each channel 308 is generally linear and extends along the entire width of the panel body 200 between the first and second side frame members 304, 306. Still in the illustrated embodiment, each exterior wall panel 124 includes two channels 308*a*, 308*b* disposed generally horizontally and parallel to each other. Each channel 308 is adapted to receive at least one mounting member 126, as will be explained further below. Alternatively, each exterior wall panel 124 could instead include a single channel or more than two channels. In yet another embodiment, the exterior wall panel 124 could include round holes or another type of openings instead of channels.

Figure 8:
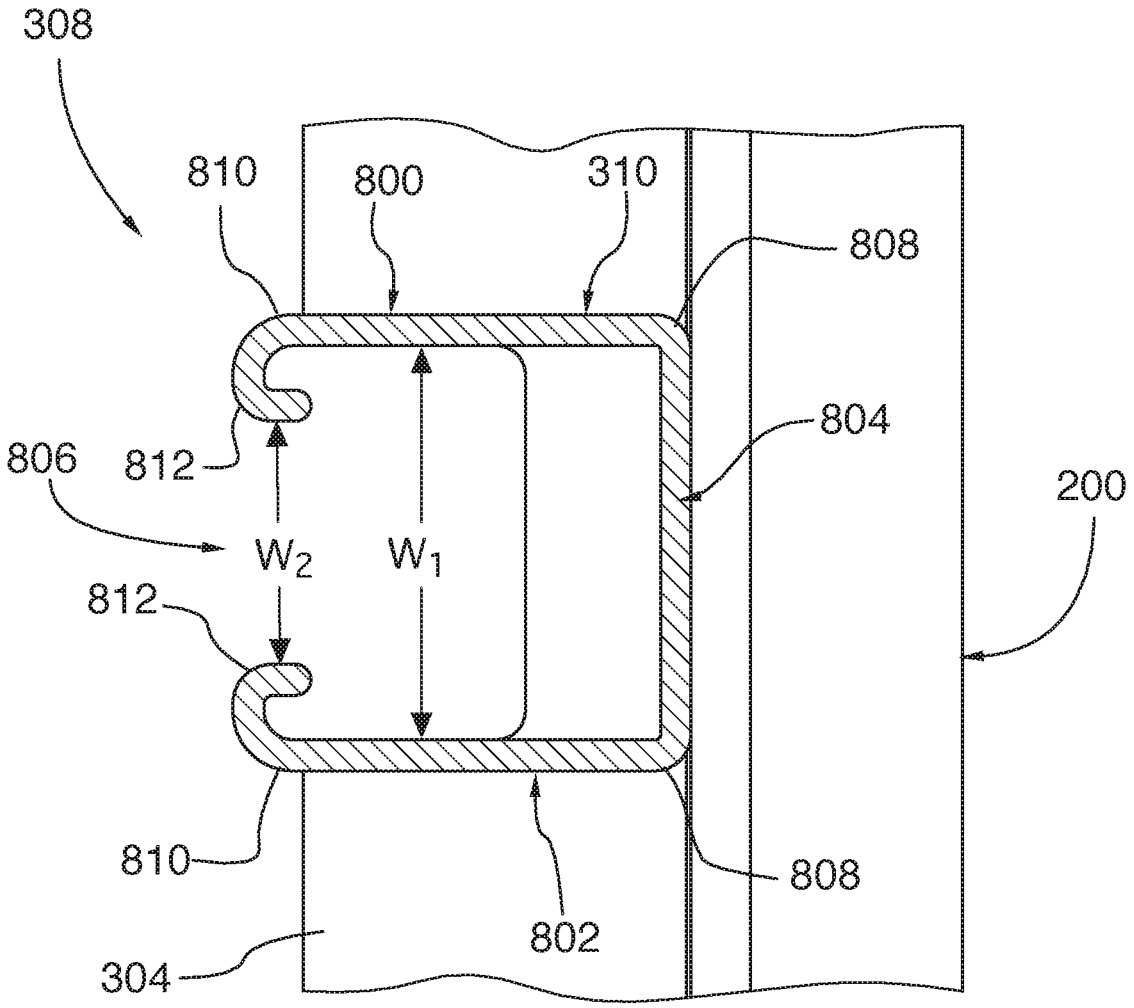
FIG. 8 is a cross-section view of the exterior wall panel, taken along line VIII-VII of FIG. 4.

Referring specifically to FIG. 8, each channel 308 includes a strut member 310 having a generally U-shaped cross-section. Specifically, the strut member 310 includes a first strut side wall 800, a second strut side wall 802 disposed parallel to the first strut side wall 800 and a strut end wall 804 extending between the strut side walls 800, 802 and disposed orthogonally to the first and second strut side walls 800, 802. In this configuration, an open side 806 is defined opposite the strut end wall 804. When the exterior wall panels 124 are attached to the shell 102, the exterior wall panel 124 is disposed such that the first and second strut side walls 800, 802 are generally horizontal and the open side 806 is disposed towards the shell 102.

In the illustrated embodiment, each one of the first and second strut side walls 800, 802 defines a cross-section profile including a first end 808 connected to the strut end wall 804 and an opposite second end 810 located adjacent the open side 806. In the illustrated embodiment, the second end 810 of each one of the first and second strut side walls 800, 802 includes a lip portion 812 which extends inwardly into the open side 806 towards the other one of the first and second side walls 800, 802. Specifically, the lip portion 812 is generally hook-shaped and curves back towards the strut end wall 804. In this configuration, the open side 806 is therefore partially obstructed by the lip portions 812, such that first and second strut side walls 800, 802 are spaced apart from each other by a strut interior width $W_1$ and the lip portions are spaced apart from each other by an open side width $W_2$ which is smaller than the strut interior width $W_1$.

In the illustrated embodiment, and as best shown in FIGS. 3 to 7, the panel frame 206 extends away from the interior face 202 of the panel body 200 to define a rectangular recess 350 between the top, bottom, first side and second side frame members 300, 302, 304, 306, and the strut members 308 are disposed in the recess 350 between the first and second side frame members 304, 306.

Furthermore, each side frame member 300, 302, 304, 306 includes a plurality of indents 352, each one corresponding to one of the strut members 310. More specifically, each strut member 310 is aligned with a first corresponding indent 352*a* defined in the first side frame member 304 and a second corresponding indent 352*b* defined in the second side frame member 306.

Figure 6:
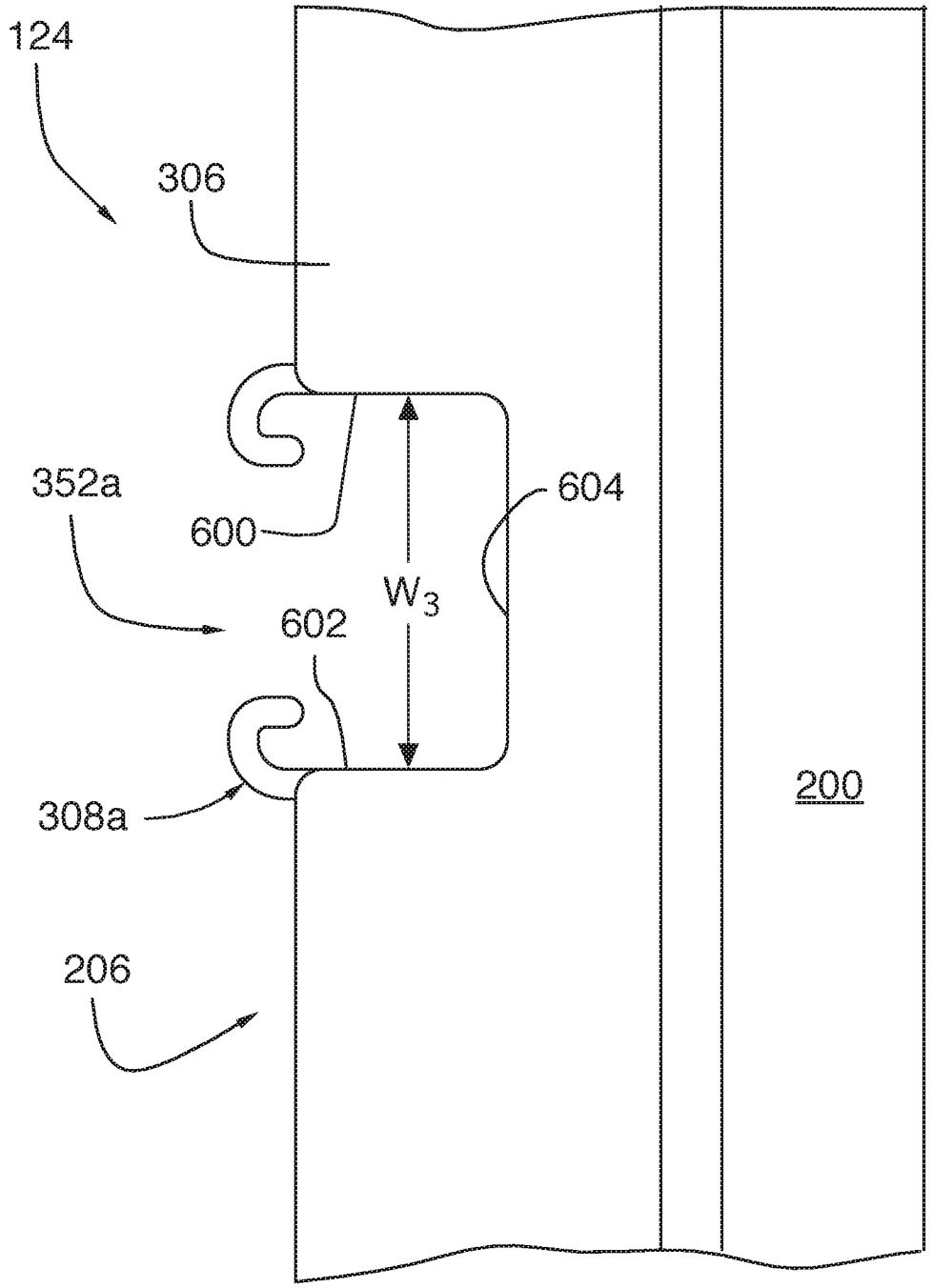
FIG. 6 is an enlarged side view of the exterior wall panel, taken from area VI of FIG. 5.
Figure 7:
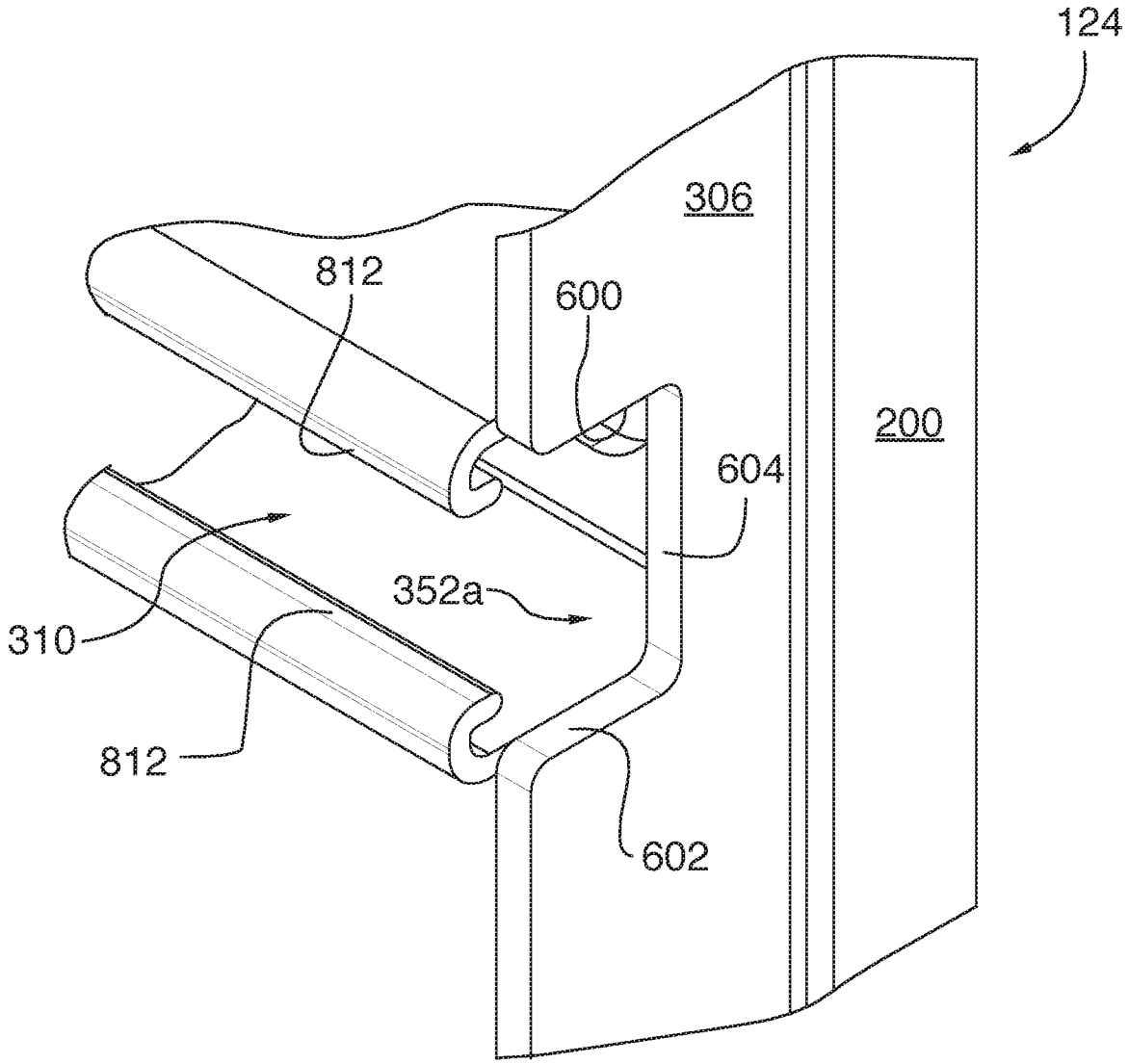
FIG. 7 is an enlarged perspective view of the exterior wall panel illustrated in FIG. 6.

In the illustrated embodiment, each indent 352 is generally rectangular and includes a first side edge 600, an opposed second side edge 602 extending parallel to the first side edge 600 and an end edge 604 extending orthogonally to the first and second side edges 600, 602, as best shown in FIG. 6. The indent 352 is sized and shaped such that the first side edge 600 is flush with the first strut sidewall 800 and the second side edge 602 is flush with the second strut sidewall 802. In this configuration, the first and second side edge 600, 602 are spaced apart by an indent width $W_3$ which is generally the same as the strut interior width $W_1$. It will be appreciated that the indents 352 allows access to the interior of the strut members 308 from the side frame members 304, 306. Alternatively, instead of being rectangular, the indents 352 could have any other shape that would allow access to the interior of the strut members 308 from the side frame members 304, 306. In an alternate embodiment, side frame member 300, 302, 304, 306 include no indent. Such an alternate configuration may find use for instance where the configuration of strut members 308 is such that access to its interior via side frame member 300, 302, 304, 306 is not required.

In one embodiment, each strut member 308 is made of a single piece of metal manufactured by a metalworking technique known to a skilled addressee, such as extrusion, metal sheet bending or the like. Alternatively, each one of the strut side walls 800, 802 and the end wall 804 may include a single, flat metal piece which is assembled to the other ones of the strut side walls 800, 802 and end wall 804 using an assembly technique known to the skilled addressee, such as welding, riveting or the like.

Referring now to FIGS. 9 and 10, each mounting member 126 extends outwardly from the exterior surface 106 of the shell 102. More specifically, each mounting member 126 includes an elongated member 900 which is disposed generally orthogonally to the exterior wall panel 124. The elongated member 900 has a first end 902 secured to the shell 102 and a second end 904 which is located away from the first end 902. The second end 904 includes an enlarged portion 906 which is adapted to be received in one of the strut members 310.

In the illustrated embodiment, the elongated member 900 includes a rod 1000 and the enlarged portion 906 includes a rod head 1002 which is secured to the rod 1000. In one embodiment, the rod head 1002 is generally disc-shaped and includes a central opening, not shown, in which the rod 1000 is received. Alternatively, the rod head 1002 may not be disc-shaped, but instead be rectangular or have any other shape that a skilled person would consider appropriate.

Still in the illustrated embodiment, the rod head 1002 is adapted to be received and held within a corresponding strut member 310. More specifically, the rod head 1002 has a head diameter $H_1$ which is generally similar to the strut interior width $W_1$ of the corresponding strut member. To mount the exterior wall panels 124 to the mounting members 126, the exterior wall panel 124 can be aligned such that a corresponding indent 352 is aligned with the rod head 1002 and moved laterally to slidably engage the rod head 1002 into the corresponding strut member 310.

In one embodiment, a plurality of rods 1000 are spaced from each other and disposed in a horizontal row on the exterior surface of the shell 102 such that the rod heads 1002 of the plurality of rods 1000 are located at the same horizontal level. When the exterior wall panel 124 is moved laterally as described above, all of the rod heads 1002 of the plurality of rods 1000 disposed in a horizontal row are received in the corresponding strut member 310. The rod heads 1002 thereby guide the exterior wall panels 124 into a predetermined position.

In one embodiment, the rod heads 1002 may be free to rotate about the rod 1000 and the head diameter $H_1$ may be slightly smaller than the strut interior width $W_1$ such that the rod heads 1002 may define rollers to facilitate moving the exterior wall panels 124 laterally. In another embodiment, the rod head 1002 threadably engages the rod 1000. In yet another embodiment, the rod head 1002 is further welded or otherwise secured to the rod 1000 such that rotation of the rod head 1002 relative to the rod 1000 is prevented. In yet another embodiment, the rod 1000 and the rod head 1002 may be integrally formed together to define a unitary piece.

In the illustrated embodiment, the rod 1000 is threaded and the mounting member 126 further includes a nut 1004 adapted to threadably engage the rod 1000. Specifically, the nut 1004 is disposed near the second end 904 of the rod, beyond the rod head 1002, and the rod head 1002 abuts the lip portions 812 of the strut member 310 such that the rod head 1002 is sandwiched between the lip portions 812 and the nut 1004. It will be understood that this arrangement prevents the exterior wall panel 124 from moving towards and away from the shell 102.

In yet another embodiment, the rods 1000 in a horizontal row may not include distinct rod heads 1002. Instead, the enlarged portion 906 of the mounting members 126 may include a single elongated rail element secured to all of the plurality of rods 1000 disposed in a horizontal row, and the rail elements could slidably engage the strut member 310 when the exterior wall panel 124 is moved laterally.

In one embodiment, the rod 1000 is made of metal and the first end 902 of the elongated member 900 is welded to the shell 102. Alternatively, the first end 902 of the elongated member 900 could be fastened, glued, or attached to the shell 102 using one of various attachment techniques known to a skilled addressee. Furthermore, it will be understood that while mounting members 126, mounting member 126 has been described in accordance with one embodiment, it could be configured differently, provided that it allows attaching the exterior wall panel 124 to the shell 102.

In the illustrated embodiment, the building structure 100 further includes a layer of insulating material 950 disposed generally on the exterior surface 106 of the shell 102. In one embodiment, the layer of insulating material 950 could include a first sublayer of polyurethane spray foam applied generally uniformly on the exterior surface 106 of the shell 102. The layer of insulating material 950 could further include a second sublayer of fiberglass applied on the first sublayer. In one embodiment, the first sublayer of polyurethane spray foam could have a thickness of about 1 inch or 2.54 cm and the second sublayer of fiberglass could have a thickness of about 5 inches or 12.7 cm.

Alternatively, the layer of insulation 950 material could include another type of insulation material such as mineral wool, cellulose, polystyrene or any other insulation material which a skilled person may consider appropriate. In another embodiment, the layer of insulation material 950 could be made only of a single insulating material instead of including a plurality of sublayers made from different insulating materials.

It will be appreciated that the exterior wall panel 124 may provide a pleasing exterior appearance and a certain level of weather protection to the building structure, and that the layer of insulating material 950 may provide additional weather protection. Specifically, the layer of insulating material 950 may contribute to at least one of thermal and acoustic insulation of the shell 102.

In the illustrated embodiment, the mounting member 126 further includes a limiting member 1006 adapted to abut the outer face of the layer of insulating material 950. Specifically, the limiting member 1006 includes a washer 1008 which is mounted on the rod 1000 between the rod head 1002 and the first end 902 of the elongated member 900.

In the illustrated embodiment, the washer 1008 is spaced from the rod head 1002 such that an air gap 1010 is created between the exterior wall panel 124 and the layer of insulating material 950. It will be appreciated that this air gap 1010 may further contribute to insulating the shell 102. In one embodiment, the washer 1008 is spaced by a distance of 2 inches from the shell 102. Alternatively, the washer 1008 may be spaced by a different distance from the shell 102.

Alternatively, the mounting member 126 may not include a limiting member 1006. In this embodiment, the mounting member 126 may not even include an air gap 1010 and the layer of insulation material 950 may contact both the exterior surface of the shell 102 and the interior face 202 of the panel body 200. In this configuration, the layer of insulation material 950 would therefore extend from the exterior surface 106 of the shell 102 all the way to the interior face 202 of the panel body 200. In yet another embodiment, the building structure 100 may not even include a layer of insulating material 950.

Figure 11:
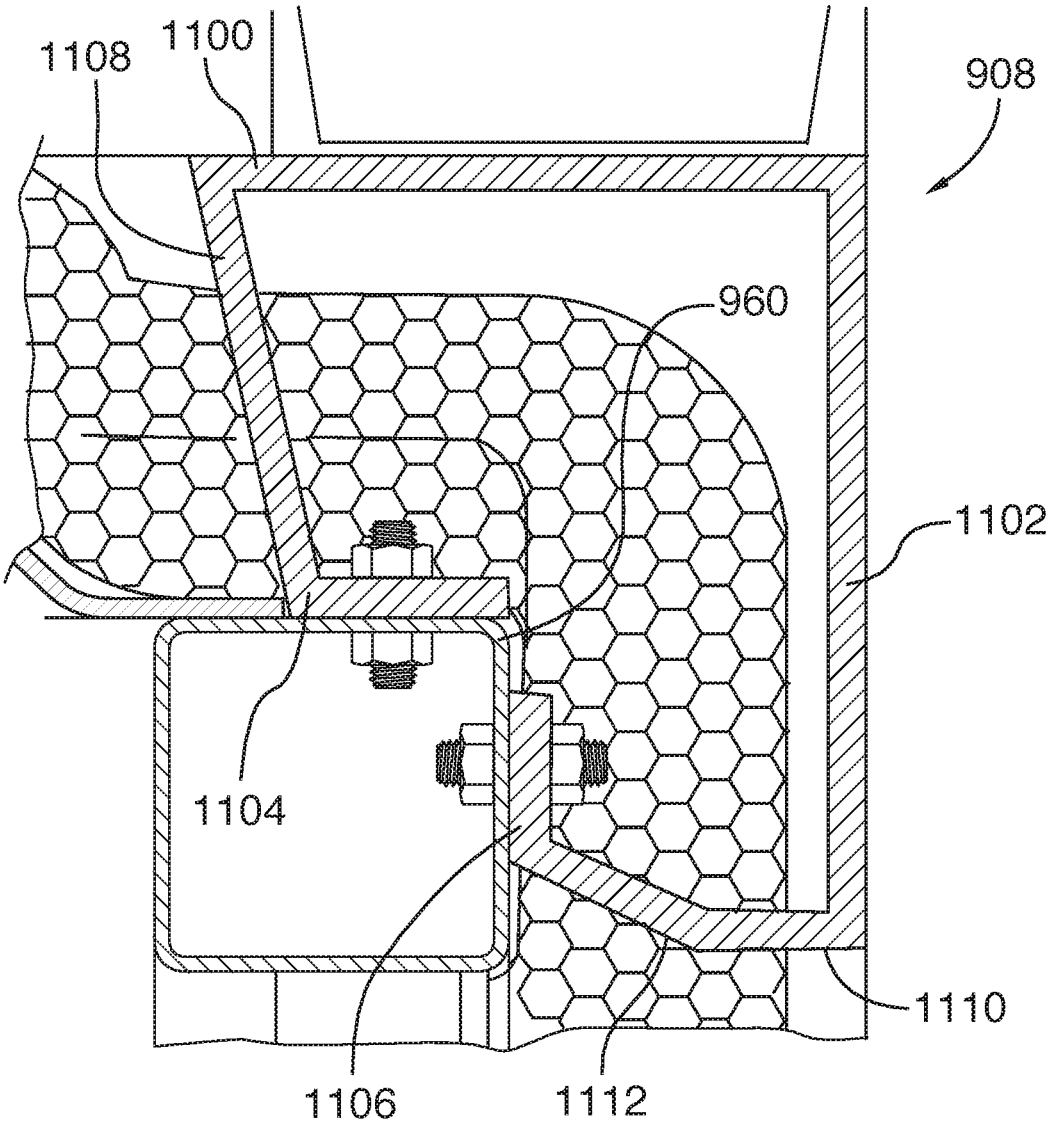
FIG. 11 is another enlarged portion of the cross-sectional view of the exterior panel assembly illustrated in FIG. 9, showing details of the top corner brace.

In the illustrated embodiment, the exterior panel assembly 104 further include a top corner brace 908 for further securing the exterior wall panel 124 to the shell 102 (best shown in FIGS. 9 and 11).

Specifically, each one of the first and second vertical side walls 112, 114 and the first and second vertical end walls 116, 118 of the shell 102 meets the roof panel 110 to define a top horizontal edge 960 of the shell 102. The top corner brace 908 is generally elongated and extends horizontally over the top horizontal edge 960. In one embodiment, the top corner brace includes a single, elongated piece which extends over the entire length of the top horizontal edge. Alternatively, the top corner brace may include a plurality of spaced-apart brace sections spaced from each other and distributed along the top horizontal edge.

Referring now specifically to FIG. 11, the top corner brace 908 has a generally hollow cross-section which includes a planar top face 1100 and a planar exterior face 1102 connected to the planar top face 1100. In the illustrated embodiment, the top face 1100 and the exterior face 1102 are disposed generally orthogonally to each other. When the top corner brace 908 is secured to the shell 102, the top face 1100 extends generally horizontally and the exterior face 1102 extends generally vertically. The exterior wall panel 124 is adapted to be disposed against the exterior face 1102 and to be secured to the exterior face 1102 using one of various means such as riveting, welding or any other securing means that a skilled person may consider appropriate.

In the embodiment illustrated in FIG. 11, the top corner brace 908 further includes first and second inner faces 1104, 1106 which are adapted to be placed against the shell 102 and secured to the shell 102. The first inner face 1104 extends generally parallel to the top face 1100 and the second inner face 1106 extends generally parallel to the exterior face 1102. In the illustrated embodiment, both the first and second inner faces 1104, 1106 are shorter respectively than the top face 1100 and the exterior face 1102.

In the illustrated embodiment, the first inner face 1104 is connected to the top face 1100 by a first connecting face 1108. Still in the embodiment illustrated in FIG. 11, the first connecting face 1108 is angled relative to the top face 1100 and the first inner face 1104. Alternatively, the first connecting face 1108 could instead extend orthogonally to the top face 1100 and the first inner face 1104.

In the embodiment illustrated in FIG. 11, the top corner brace 908 further includes a generally planar bottom face 1110 which is connected to the exterior face 1102 and which is generally parallel to the top face 1100. The bottom face 1110 is shorter than the top face 1100 and is connected to the second inner face 1106 by a second connecting face 1112 which is angled relative to the bottom face 1110 and the second inner face 1106. Alternatively, the top corner brace 908 may not comprise a second connecting face 1112 and the bottom face 1110 could be directly connected to the second inner face 1106.

In one embodiment, the inner faces 1104, 1106 are secured to the shell 102 using fasteners such as bolts and nuts or the like. Alternatively, the inner faces could be riveted or welded to the shell 102, or be secured to the shell 102 using any other securing technique known to a skilled addressee. In yet another embodiment, the top corner brace 908 could have a cross-section having any other shape which a skilled person would consider to be appropriate.

Figure 12:
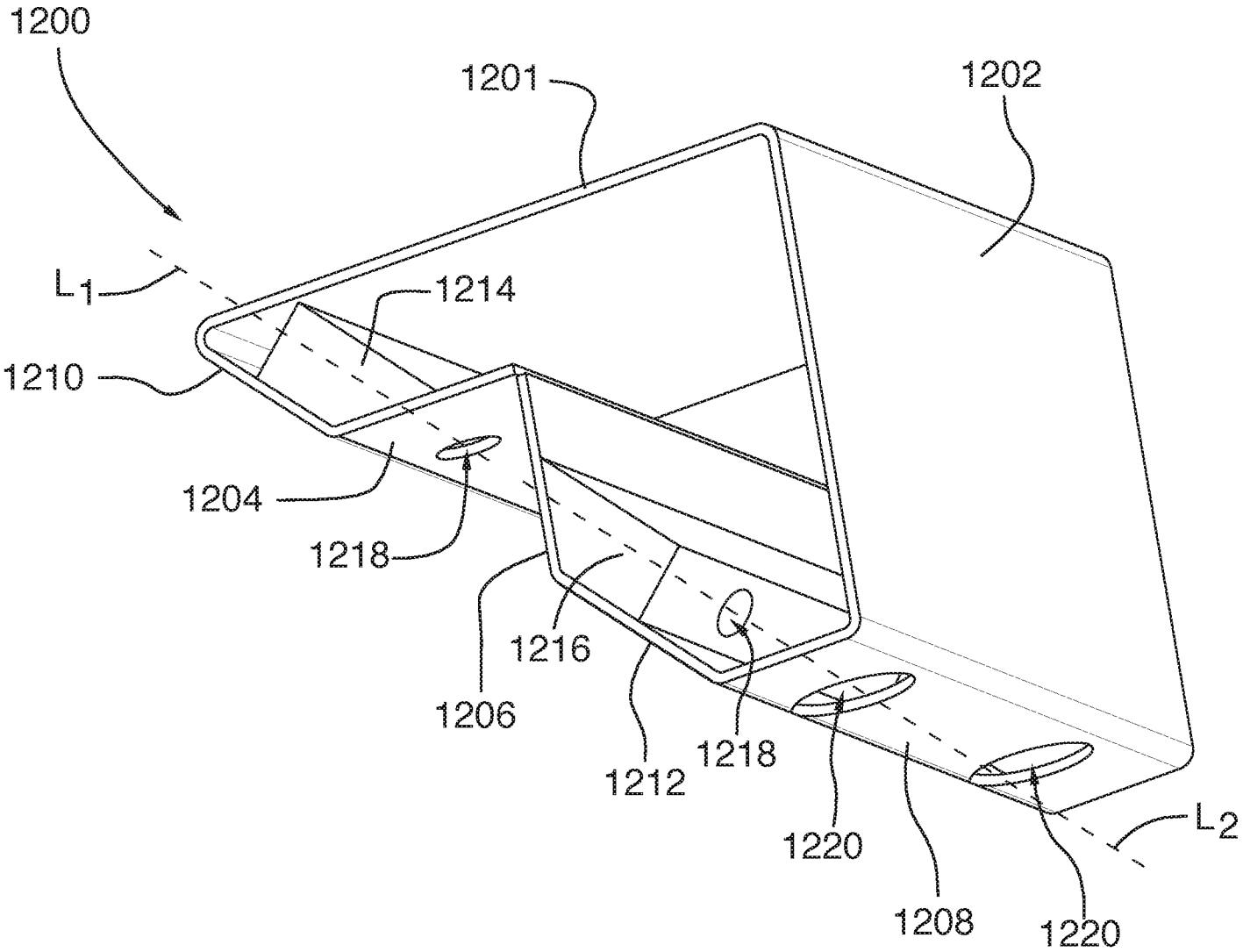
FIG. 12 is a bottom perspective view of a top corner brace for the exterior panel assembly illustrated in FIG. 9 in accordance with an alternative embodiment.
Figure 13:
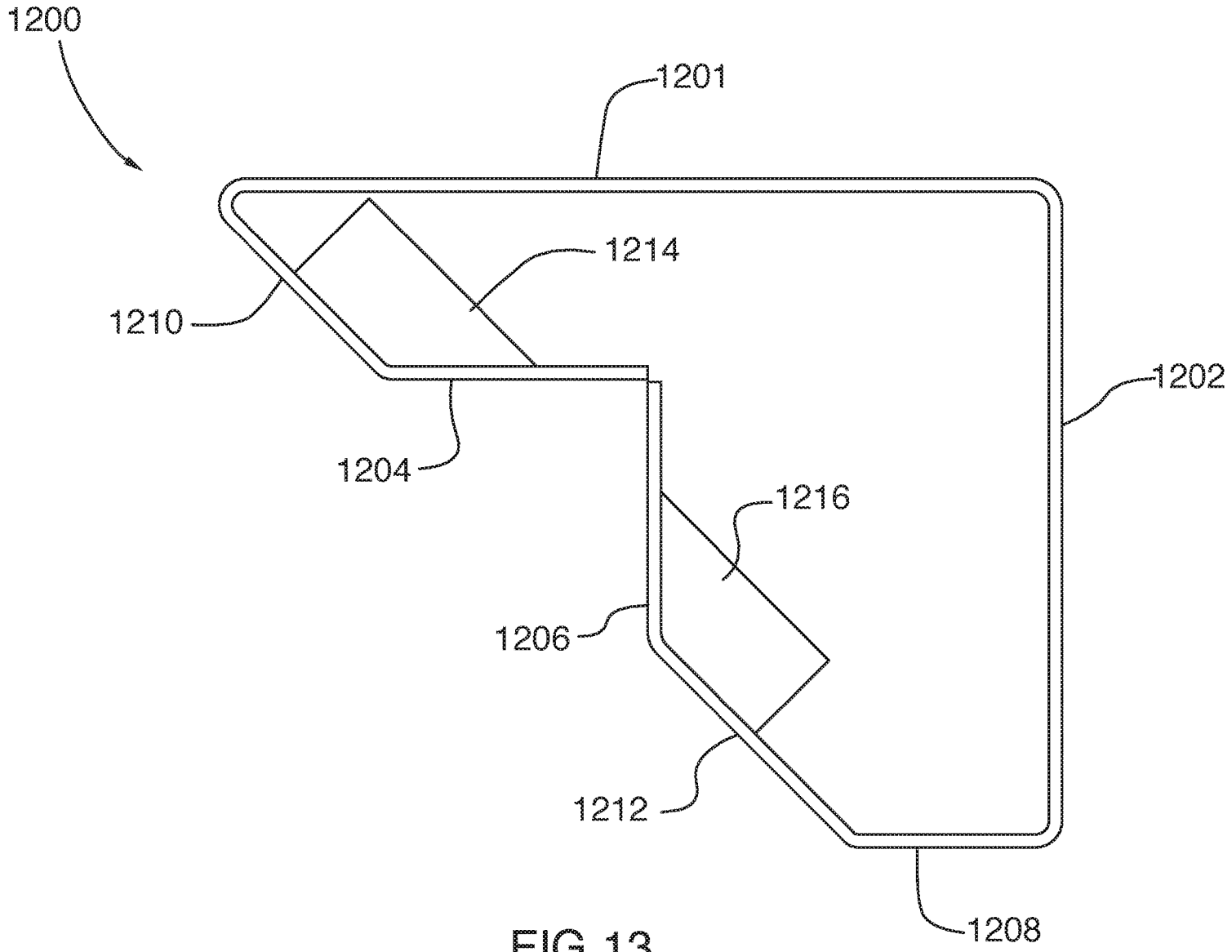
FIG. 13 is a side elevation view of the top corner brace illustrated in FIG. 12.

Now turning to FIGS. 12 and 13, there is shown a top corner brace 1200, in accordance with an alternative embodiment. The top corner brace 1200 is generally similar to the top corner brace 908 shown in FIGS. 9 to 11 and includes a top face 1201, an exterior face 1202, first and second inner faces 1204, 1206, a bottom face 1208 and first and second connecting faces 1210, 1212.

In the embodiment shown in FIGS. 12 and 13, the top corner brace 1200 further includes a first lug member 1214 disposed against the first inner face 1204 and the first connecting face 1210 and a second lug member 1216 disposed against the second inner face 1206 and the second connecting face 1212.

Still in the embodiment shown in FIGS. 12 and 13, the first lug member 1214 includes a first pair of bores 1218 (only one bore 1218 being shown), which extend through the first lug member 1214. Each one of the first pair of bores defines a first longitudinal axis $L_1$ which is parallel to the first connecting face 1210. Similarly, the second lug member 1216 includes a second pair of bores 1218 (only one bore 1218 being shown) which extends through the second lug member 1216. Each one of the second pair of bores 1218 defines a second longitudinal axis $L_2$ which is parallel to the second connecting face 1212. In one embodiment, the first longitudinal axis $L_1$ is further coaxial with the second longitudinal axis $L_2$.

Furthermore, each one of the bottom face 1208, the first inner face 1204 and the second inner face 1206 includes a pair of oblong openings 1220. The bores 1218 of the first and second lug members 1214, 1216 and the oblong openings 1220 are aligned to allow a pair of elongated fasteners (not shown) to pass through. It will be understood that in this configuration, the elongated fasteners extend through a portion of the shell 102 located between the first and second inner faces 1204, 1206 to thereby secure the top corner brace 1200 to the shell 102.

In one embodiment, the elongated fasteners are threaded and the first and second pair of bores 1218 of the first and second lug members 1214, 1216 are threaded to threadably receive the elongated fasteners. Alternatively, the first and second pair of bores 1218 of the first and second lug members 1214, 1216 could be unthreaded and instead be held by one or more nuts threadably engaging the elongated fastener.

Alternatively, instead of including a pair of elongated fasteners, the top corner brace 1200 could be secured to the shell 102 using only a single elongated fastener or more than two elongated fasteners.

It will be appreciated that the two configurations of top corner braces 908, 1200 described above define a cross-section having a generally closed shape, which may provide generally good resistance against damage from outside forces applied on the exterior wall panels 124, such as wind or the like. In one embodiment, the top corner brace may be adapted to withstand hurricane force winds of about 188 km/h or greater. Alternatively, the top corner brace may be adapted to withstand a different level of force.

Figure 13A:
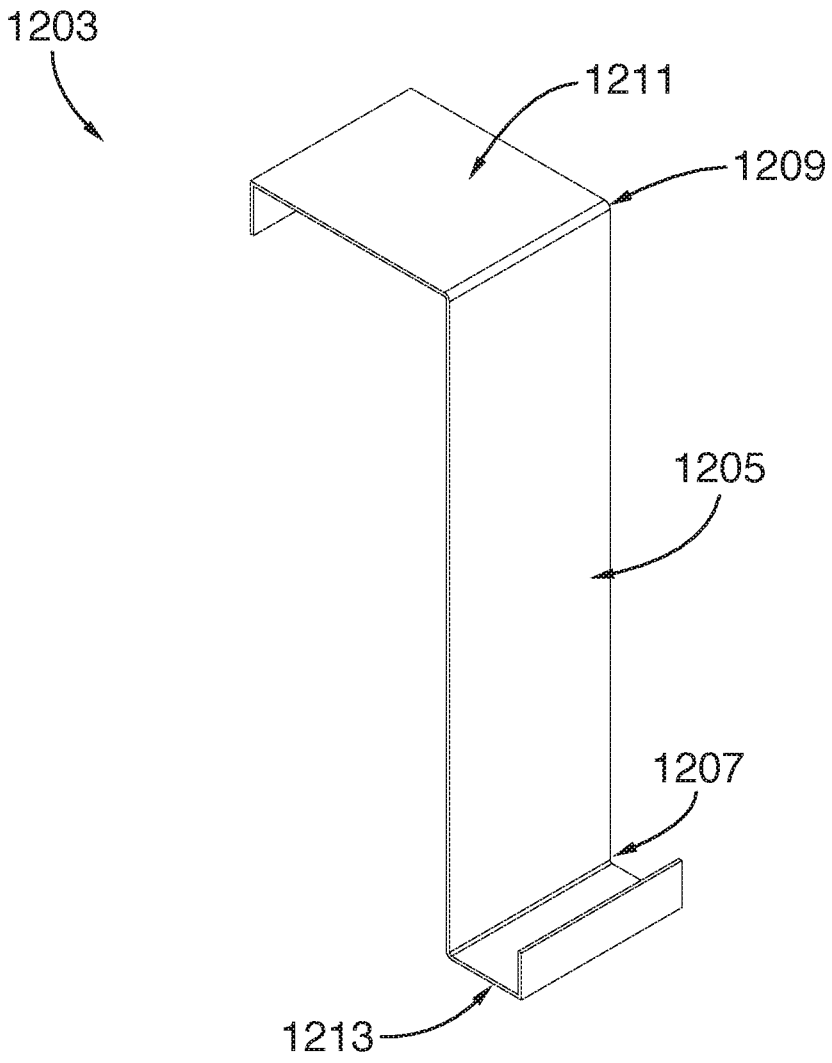
FIG. 13A is a perspective view of a spacing element, in accordance with one embodiment.

To provide further hurricane withstanding capabilities, a spacing element can be positioned connected to the top corner braces 908, 1200 and to the exterior wall panel 124. For instance, in one embodiment shown in FIG. 13A, a spacing element 1203 is generally Z-shaped and includes a generally vertical center portion 1205 having a bottom end 1207 and a top end 1209, a top hook-shaped portion 1211 which extends generally horizontally from the top end 1209 of the center portion 1205, toward the shell 102, and a bottom hook-shaped portion 1213 which extends generally horizontally from the bottom end 1207 of the center portion 1205, away from shell 102.

In the illustrated embodiment, the top hook-shaped portion 1211 is supported on top face 1201 of top corner brace 1200 and the vertical central portion 1205 extends downwardly, along and below, exterior face 1202 face of top corner brace 1200 and is secured to the top corner brace 1200 using fasteners such as bolts and nuts or the like. Still in the illustrated embodiment, the bottom hook-shaped portion 1213 is configured to engage and support a channel 308 of the exterior wall panel 124. In one embodiment, the bottom hook-shaped portion 1213 is is secured to the channel 308 using fasteners such as bolts and nuts or the like. Alternatively, the top and bottom hook-shaped portions 1211 and 213 could be riveted or welded, or be secured respectively to the top corner brace 1200 and the channel 308 using any other securing technique known to a skilled addressee. As it will be appreciated, the presence of spacing element 1203 provides further connection between the top corner brace 1200 and the exterior wall panel 124., thereby contributing to increase resistance to wind. While the spacing element 1203 in the illustrated embodiment is generally Z-shaped, it will be understood that such a spacing element allowing connection between the top corner braces 908, 1200 and the exterior wall panel could take different shapes and be made of any suitable material.

Referring back to FIGS. 9 to 11, the building structure 100 further includes a gutter member 910 disposed over the top corner brace 908. Specifically, the gutter member 910 has a generally U-shaped cross-section and includes a first upright sidewall 912 disposed away from the shell 102, a second upright sidewall 914 disposed opposite the first upright sidewall 912 and towards the shell 102, and a bottom wall 916 extending between the first and second upright sidewalls 912, 914 and disposed generally horizontally against the top corner brace 908. In the illustrated embodiment, the first and second upright sidewalls 912, 914 are slightly angled towards the bottom wall 916 to direct debris and liquids such as rain towards the bottom wall 916. The bottom wall 916 could be secured to the top corner brace 908 using a securing technique such as riveting, welding or any other securing technique that a skilled addressee may consider appropriate.

Still in the illustrated embodiment, the first upright sidewall 912 further includes a flange 918 extending generally horizontally generally away from the shell 102. Specifically, the flange 918 extends over the top frame member 300 of the panel frame 206 and generally rests on top of the top frame member 300. In one embodiment, a generally flat gasket or seal (not shown) is further provided between the flange 918 and the top frame member 300 to prevent water infiltration between the flange 918 and the top frame member 300. The gasket may be made of rubber and have a thickness of ⅛ inches or about 0.3175 cm, or could alternatively be made of a different material and/or have a different thickness.

Still referring to FIGS. 9 to 11, the exterior panel assembly 104 further includes a bottom securing member 920 adapted to further secure the exterior wall panel 124 to the shell 102. Specifically, the bottom securing member 920 includes a plurality of spaced-apart, elongated bars 922, each one having a first end 924 fastened to the underside of the shell 102 using a first bottom fastener 926 and a second end 928 located away from the first end 924 and fastened to the bottom frame member 302 of the exterior wall panel 124 using a second bottom fastener 930. In one embodiment, the first and second bottom fasteners 926, 930 include fasteners such as bolts and nuts or the like. Alternatively, the elongated bars 922 could be secured to the shell 102 and to the bottom frame member 302 using another securing technique such as welding, riveting or any other technique that a skilled addressee would consider appropriate.

In one embodiment, the elongated bars 922 are spaced apart from each other by about 2 feet or 60.96 cm. Alternatively, the elongated bars 922 may be spaced from each other by a greater or smaller distance.

It will be appreciated that the shell 102 and the exterior panel assembly 104 may be provided separately by a manufacturer as a kit for a user to assemble. In one embodiment, the layer of insulating material 950 may be applied and/or secured to the shell 102 offsite by the manufacturer and the shell 102 with the layer of insulating material 950 may then be delivered to the user. Alternatively, an amount of insulating material 950 and the shell 102 could be provided to the user separately and the user could apply and/or secure insulating material on the shell 102 to form the layer of insulating material on the shell 102.

In one embodiment, the rods 1000 may further be welded offsite by the manufacturer at predetermined locations on the shell 102 and the shell 102 with the welded rods 1000 could then be delivered to the user. Specifically, the rods 1000 may include capacitor discharge (CD) studs which could relatively easily be welded to the shell 102 using a stud welding tool such as a stud gun or the like. Alternatively, the studs and the shell 102 could be provided to the user separately and the user could weld the studs to the shell 102 at predetermined locations on the shell 102 using a stud welding tool.

In one embodiment, the exterior wall panels 124 are further provided by the manufacturer separately from the shell 102. In this embodiment, the user assembles the exterior wall panels 124 to the shell 102 by first positioning a first one of the exterior wall panels 124 parallel to a corresponding one of the shell's walls 112, 114, 116 or 118, with the channels 308 disposed horizontally, and lining up the indents 352 in the panel frame 206 with corresponding rod heads 1002 of the rods 1000 secured to the shell 102. The first one of the exterior wall panels 124 may then be pushed laterally such that the rod heads 1002 slidably engages the corresponding channel 308. In an embodiment in which the rod heads 1002 are free to rotate about the rod 1000, the rod heads 1002 may act as rollers to facilitate lateral movement of the exterior wall panel 124.

The first one of the exterior wall panels 124 may further be moved laterally until it reaches a desired location in which all of the rod heads 1002 of the plurality of rods 1000 disposed in a horizontal row engage the corresponding channel 308. The exterior wall panel 124 may then be secured to the shell 102 to prevent further lateral movement of the exterior wall panel 124. This process may then be repeated with the remaining exterior wall panels 124.

In one embodiment, securing the exterior wall panel 124 to the shell 102 includes securing the elongated bars 922 of the bottom securing member 920 to the exterior wall panel 124. In this embodiment, the shell 102 could be provided to the user with the first end 924 of the elongated bars 922 secured to the underside of the shell 102 via the first bottom fastener 926. More specifically, the elongated bars 922 could be relatively loosely fastened to the underside of the shell 102 and disposed generally parallel to the shell's walls 112, 114, 116, 118 such that the elongated bars 922 do not extend outwardly from the shell 102.

When the exterior wall panels 124 are assembled to the shell 102 and moved to their desired location, the elongated bars 922 may be pivoted outwardly from the shell 102 about the first bottom fastener 926 until they are generally orthogonal to the shell's walls 112, 114, 116, 118. The elongated bars 922 may then be fastened to the bottom frame member 302 of the exterior wall panel 124 using the second bottom fastener 930. The first bottom fastener 926 could also be tightened to prevent further pivoting of the elongated bars 922 about the first bottom fastener 926.

Alternatively, the elongated bars 922 could instead be pivoted before the exterior wall panels 124 are assembled to the shell 102 and moved to their desired location. In yet another embodiment, the exterior wall panels 124 could be mounted to the rods 1000 offsite by the manufacturer instead of being assembled by the user.

It will be appreciated that the configuration described above provides a substantially easy and convenient solution for a user who wishes to be provided a modular building structure which he/she can assemble himself/herself. This configuration may further reduce the cost of the modular building structure since the assembly of the kit is performed by the user instead of the manufacturer.

It will also be appreciated that the modular building structure described above is relatively customizable. For example, the user could select a desired shell having a desired size and/or a desired shape and further select desired exterior wall panels having a desired appearance color and/or a desired finish.

It will also be appreciated that this configuration would allow a number of exterior wall panels to be pre-fabricated and stored until selected by a user, instead of being manufactured on demand, which could facilitate the delivery of the kit to the user and reduce the cost of manufacturing the exterior wall panels and of the overall cost of the building structure.

Figure 14:
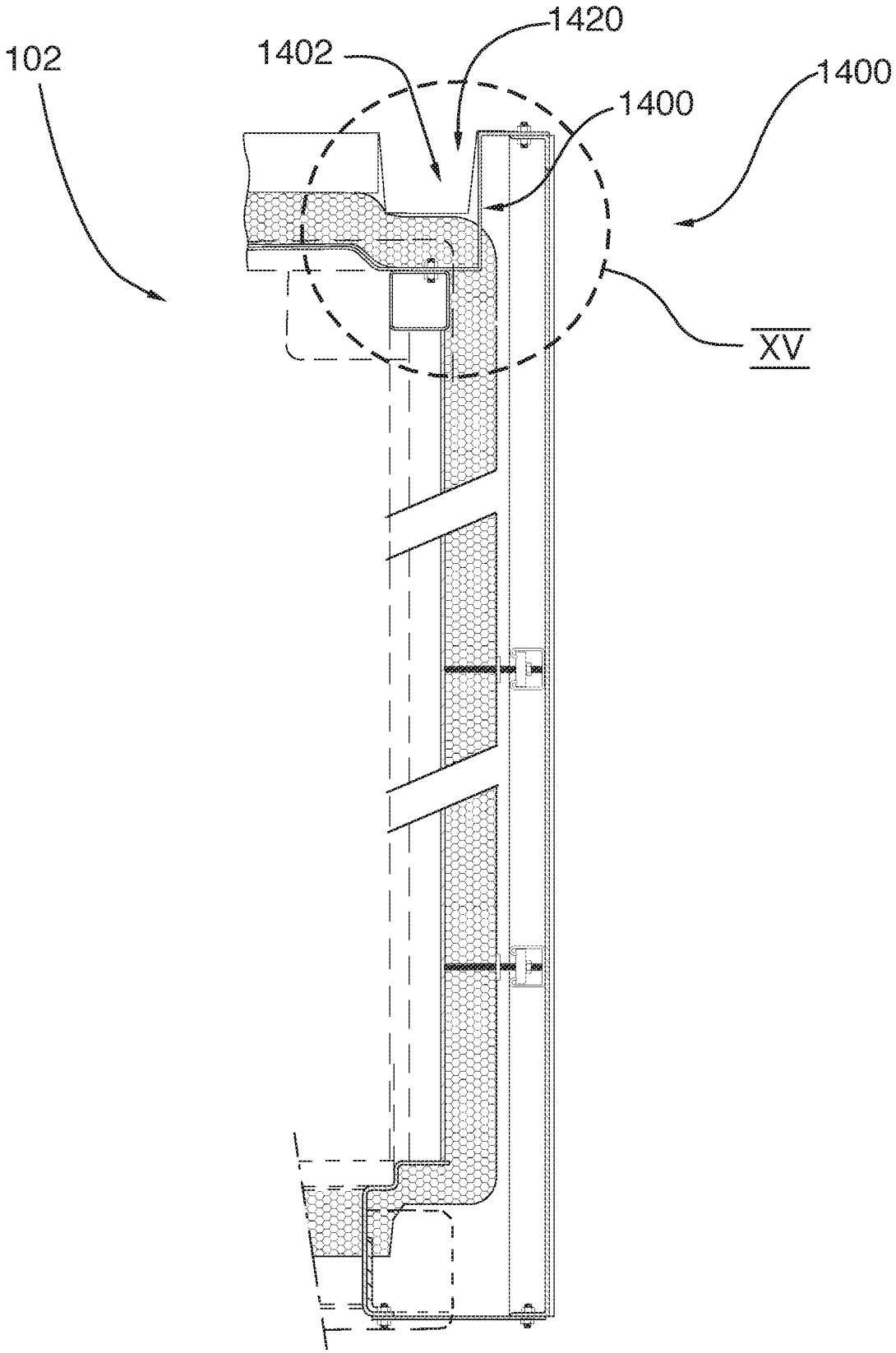
FIG. 14 is a schematic cross-sectional view of an exterior panel assembly mounted to the shell illustrated in FIG. 1, in accordance with an alternative embodiment.
Figure 15:
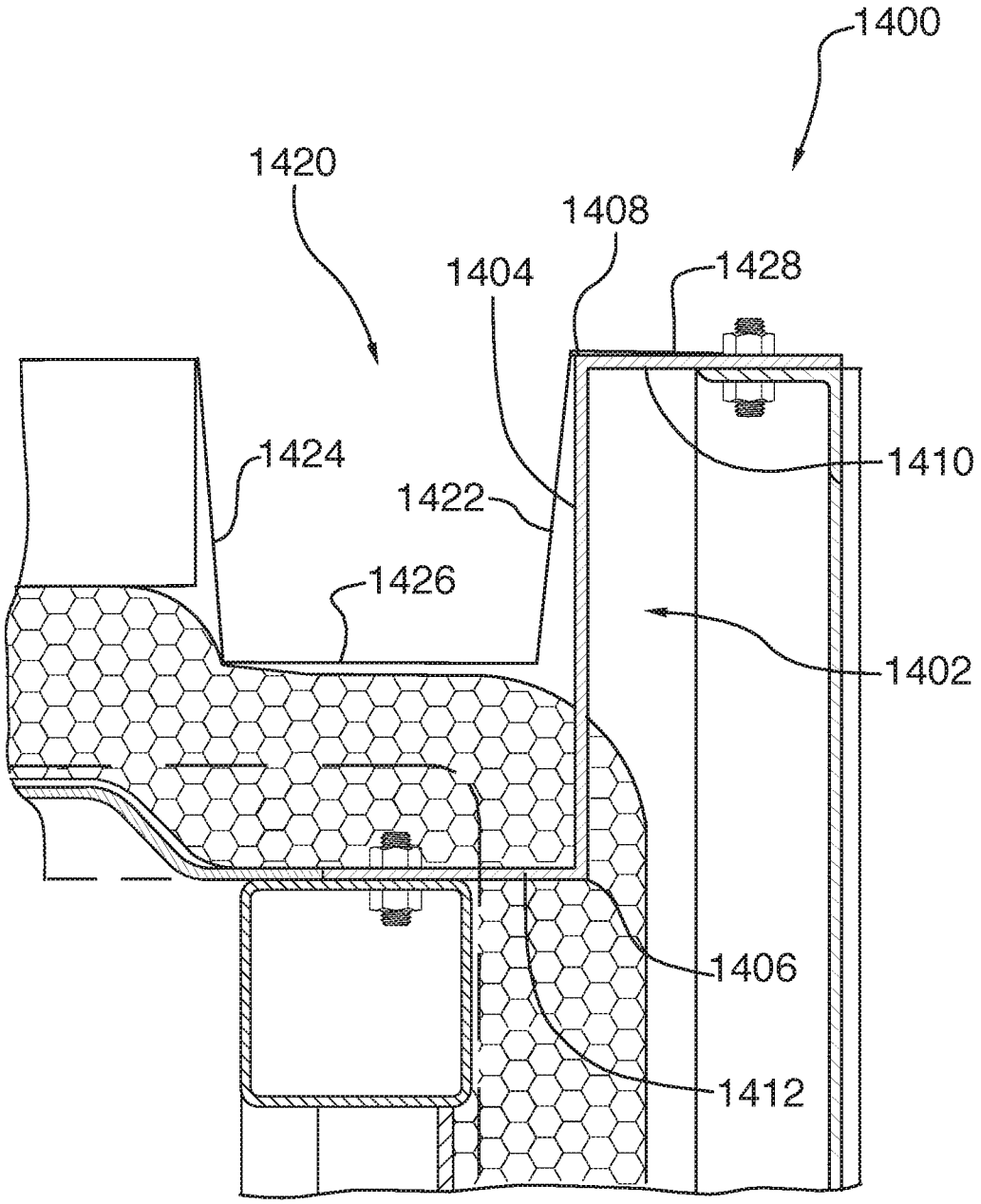
FIG. 15 is an enlarged portion of the cross-sectional view of the exterior panel assembly illustrated in FIG. 14, showing details of the top corner brace.

Turning now to FIGS. 14 and 15, there is shown an exterior panel assembly 1400, in accordance with an alternative embodiment.

In the embodiment illustrated in FIGS. 14 and 15, the exterior panel assembly 1400 is generally similar to the exterior panel assembly 104 illustrated in FIGS. 9 to 11, except that the exterior panel assembly 1400 includes a top corner brace 1402 which is different from the top corner braces 908, 1200 illustrated in FIGS. 9 to 13. The top corner brace 1402 is generally Z-shaped and includes a generally vertical center portion 1404 having a bottom end 1406 and a top end 1408, a top flange 1410 which extends generally horizontally from the top end 1408 of the center portion 1404, away from the shell 102, and a bottom flange 1412 which extends generally horizontally from the bottom end 1406 of the center portion 1404, towards the shell 102.

In the illustrated embodiment, the bottom flange 1412 is disposed against the top of the shell 102 and is secured to the shell 102 using fasteners such as bolts and nuts or the like. Still in the illustrated embodiment, the top flange 1410 is disposed against the top frame member 300 of the panel frame 206 and is secured to the top frame member 300 using fasteners such as bolts and nuts or the like. Alternatively, the top and bottom flanges 1410, 1412 could be riveted or welded, or be secured respectively to the shell 102 and the top frame member 300 using any other securing technique known to a skilled addressee.

In the embodiment illustrated in FIGS. 14 and 15, the building structure 100 further includes a gutter member 1420 disposed over the top corner brace 1402. The gutter member 1420 is generally similar to the gutter member 910 illustrated in FIG. 9. Specifically, the gutter member 1420 has a generally U-shaped cross-section and includes a first upright side wall 1422, a second upright side wall 1424 and a bottom wall 1426 extending between the first and second upright side walls 1422, 1424. Still in the illustrated embodiment, the first upright sidewall 1422 further includes a flange 1428 which extends generally horizontally generally away from the shell 102. Specifically, the flange 1428 extends over the top flange 1410 of the top corner brace 1402 and generally rests on top of the top flange 1410.

Figure 16:
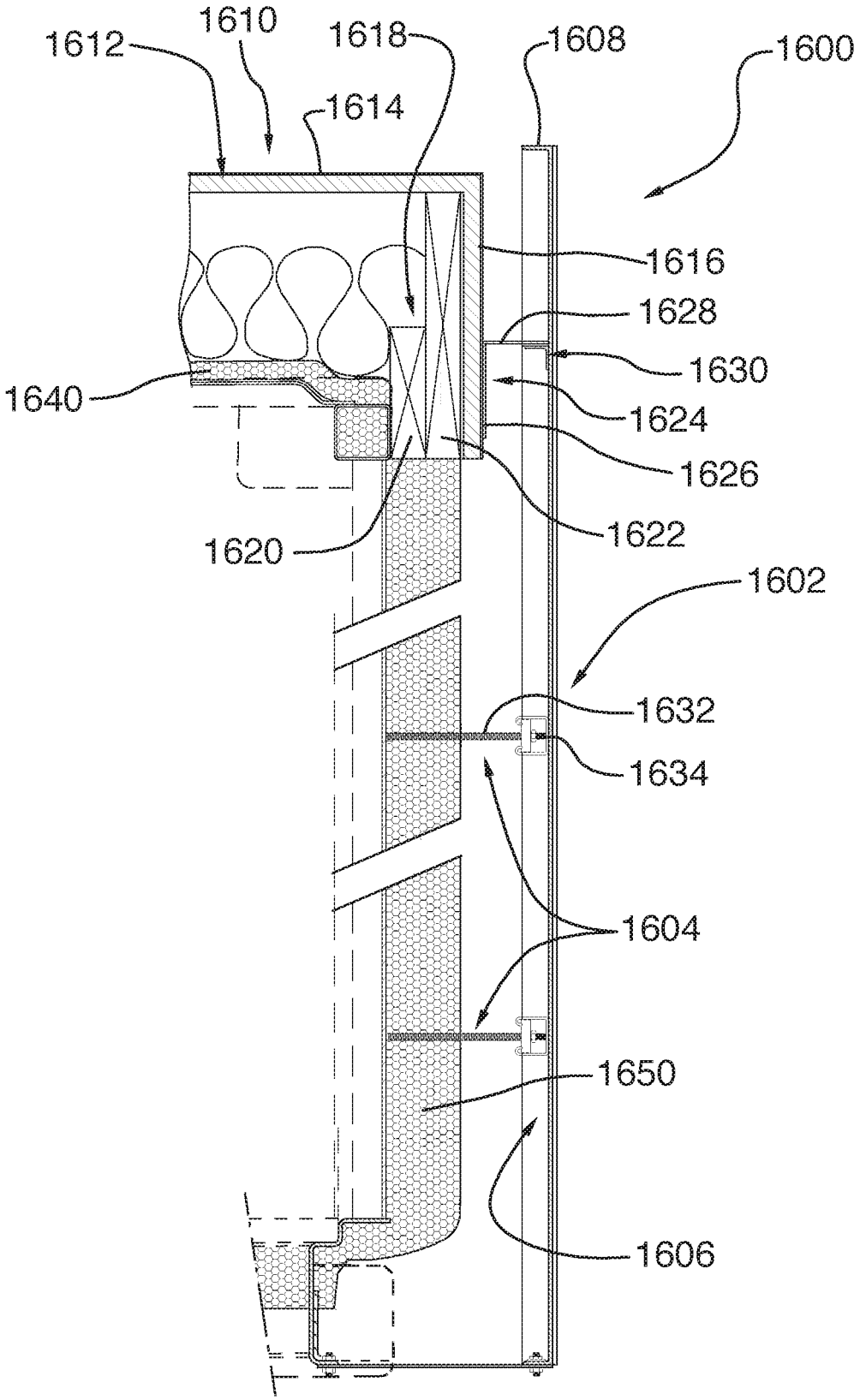
FIG. 16 is a schematic cross-sectional view of an exterior panel assembly mounted to the shell illustrated in FIG. 1, in accordance with yet another alternative embodiment.

Referring now to FIG. 16, there is shown an exterior panel assembly 1600, in accordance with another alternative embodiment.

In the embodiment illustrated in FIG. 16, the exterior panel assembly 1600 includes an exterior wall panel 1602 and a plurality of mounting members 1604 generally similar to the exterior wall panel 124 and mounting members 126 illustrated in FIGS. 9 to 11.

In the embodiment illustrated in FIG. 16, the exterior wall panel 1602 is generally taller than the exterior wall panel 124 illustrated in FIGS. 9 to 11. Specifically, the exterior wall panel 1602 includes a panel frame 1606 having a top frame member 1608 which is located at a higher level than the top frame member 300 of the exterior wall panel 124 illustrated in FIGS. 9 to 11.

Furthermore, the exterior panel assembly 1600 does not include a top corner brace. Instead, the building structure 100 includes a roof cover assembly 1610 disposed over the shell's roof panel 110 and connected to the exterior wall panel 1602. Specifically, the roof cover assembly 1610 includes an external casing 1612 which includes a top panel 1614 disposed generally horizontally and spaced upwardly from the roof panel 110 and a plurality of side panels 1616 which are disposed generally vertically and which extend downwardly from the top panel 1614. The roof cover assembly 1610 further includes at least one reinforcement piece 1618 disposed against the side panels 1616 to reinforce the side panels 1616. In the embodiment illustrated in FIG. 16, the at least reinforcement piece 1618 includes a first lumber board 1620 disposed against the shell 102 and a second lumber board 1622 sandwiched between the first lumber board 1620 and the side panels 1616 of the external casing 1612. In one embodiment, the first lumber board 1620 includes a 2 inches by 6 inches pressure treated lumber board and the second lumber board 1622 includes a 2 inches by 12 inches pressure treated lumber board. Alternatively, the first and second lumber boards 1620, 1622 may have different dimensions.

In the embodiment illustrated in FIG. 16, the roof cover assembly 1610 may further include additional insulating material 1640 disposed within the external casing 1612 between the top panel 1614 of the external casing 1612 and the roof panel 110 of the shell 102 to thereby further limit heat loss from the shell 102 through the roof panel 110.

Still in the embodiment illustrated in FIG. 16, the roof cover assembly 1610 further includes at least one angle bracket 1624 having a lower vertical portion 1626 disposed against the exterior of the side panels 1616 and an upper horizontal portion 1628 extending away from the side panels 1616. The upper horizontal portion 1628 is adapted to be secured to a corresponding angle bracket 1630 disposed on the exterior wall panel 1602. Alternatively, the upper horizontal portion 1628 could simply rest on the corresponding angle bracket 1630.

Still in the embodiment illustrated in FIG. 16, the building structure 100 further includes a layer of insulating material 1650 which is generally similar to the layer of insulating material 950 illustrated in FIG. 9. Specifically, the layer of insulating material 1650 is disposed generally on the exterior surface 106 of the shell 102. In this embodiment, the layer of insulating material 1650 may be thicker than the layer of insulating material 950 illustrated in FIG. 9 to further prevent heat loss through the shell's walls 112, 114, 116, 118.

Still in the embodiment illustrated in FIG. 16, the mounting members 1604 are generally similar to the mounting members 126 illustrated in FIG. 9. Specifically, each mounting member 1604 includes a rod 1632 and a rod head 1634 secured to the rod 1632. In the embodiment illustrated in FIG. 16, the rod 1632 may be longer than the rod 1000 illustrated in FIGS. 9 and 10 so as to space the exterior wall panel 1602 further away from the shell 102. This configuration allows the thicker layer of insulating material to be disposed against the shell 102, as described above. This configuration may further define a wider air gap between the layer of insulating material and the exterior wall panel 1602 to further prevent heat loss through the shell's walls 112, 114, 116, 118.

It will be appreciated that the exterior panel assembly 1600 illustrated in FIG. 16 is substantially well thermally insulated and may therefore be particularly well adapted for relatively cold climate.

Figure 17:
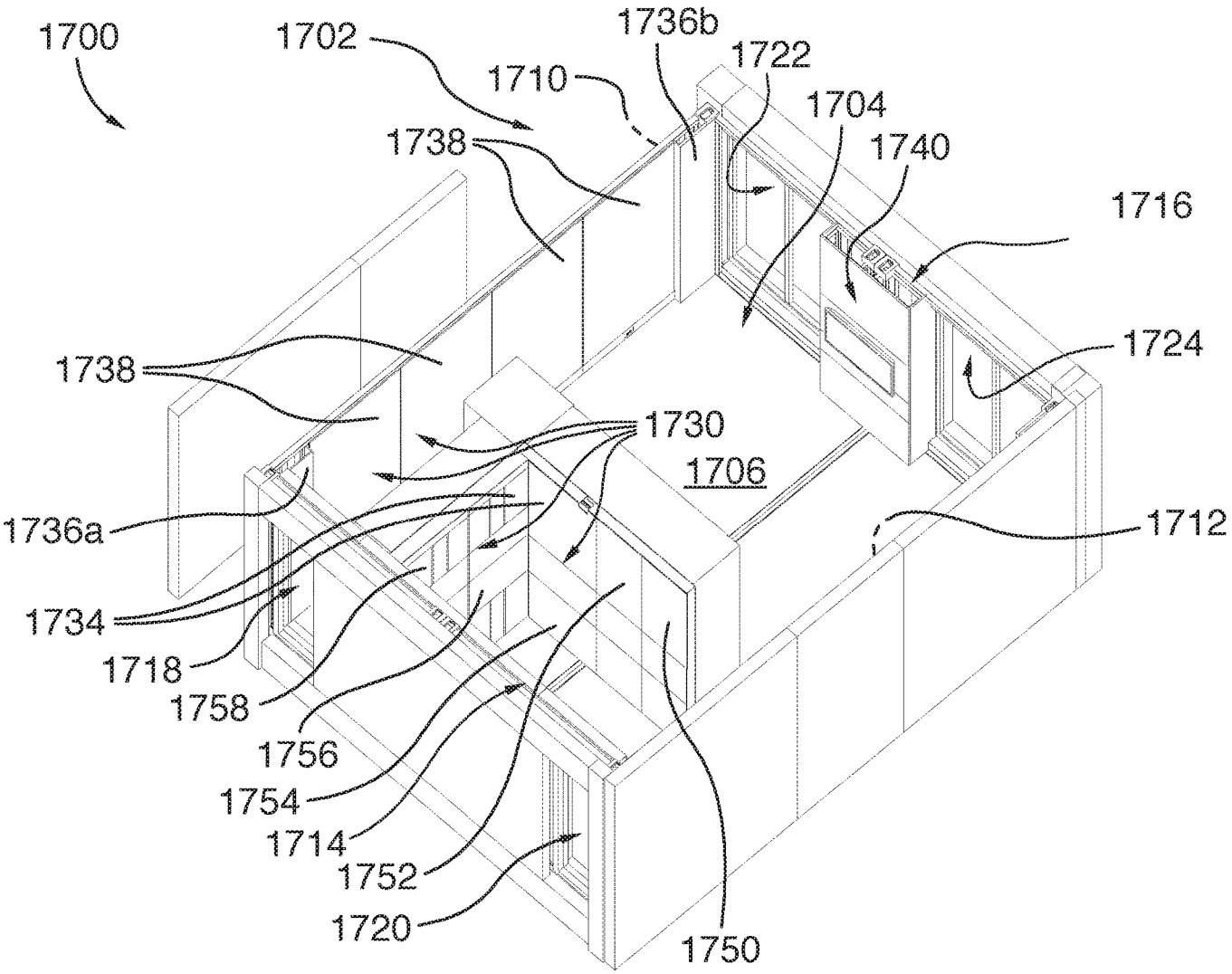
FIG. 17 is a top perspective view of a building structure, in accordance with one embodiment, with the roof panel removed to show detail of the living space's configuration.
Figure 18:
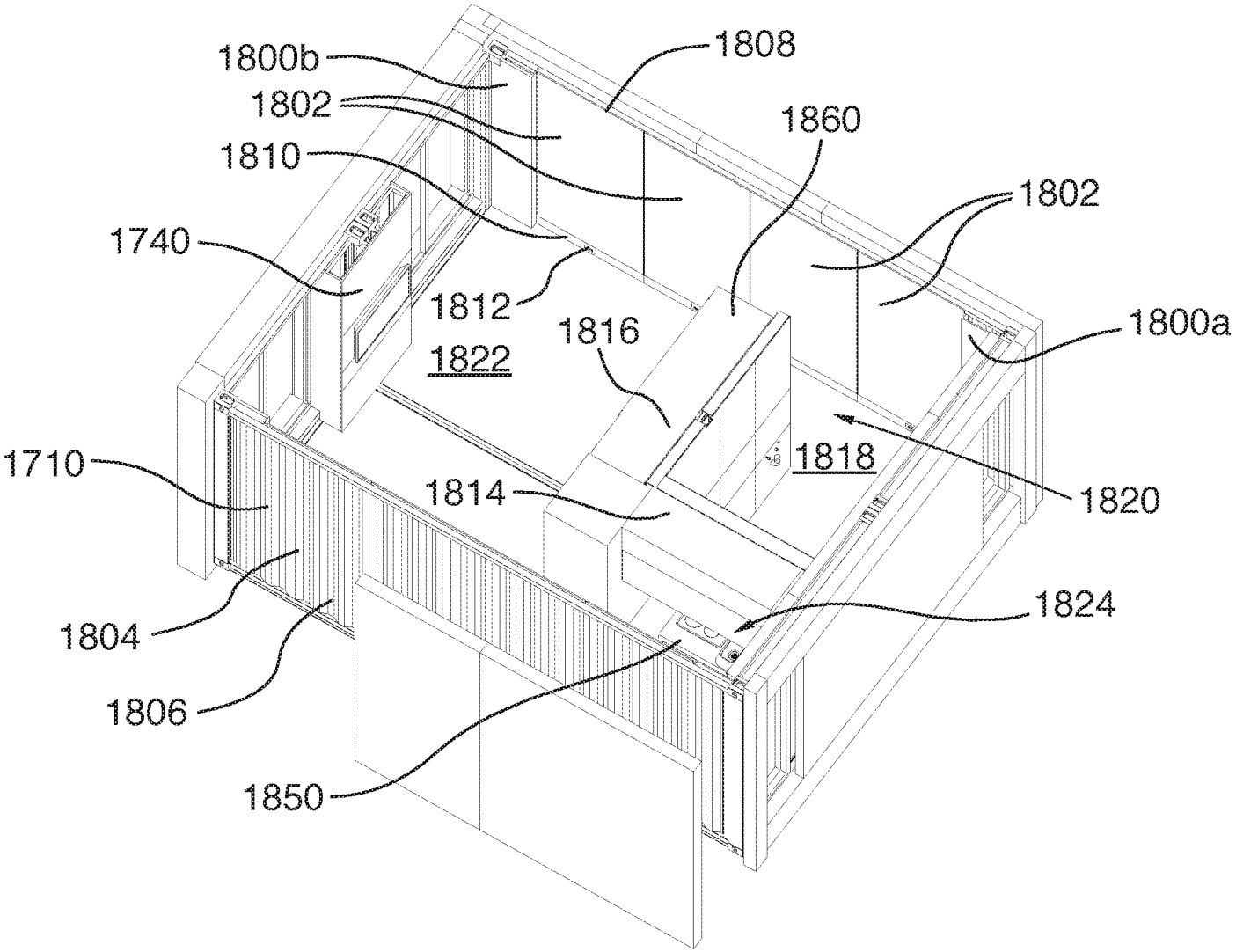
FIG. 18 is another top perspective view of the building structure illustrated in FIG. 17.
Figure 19:
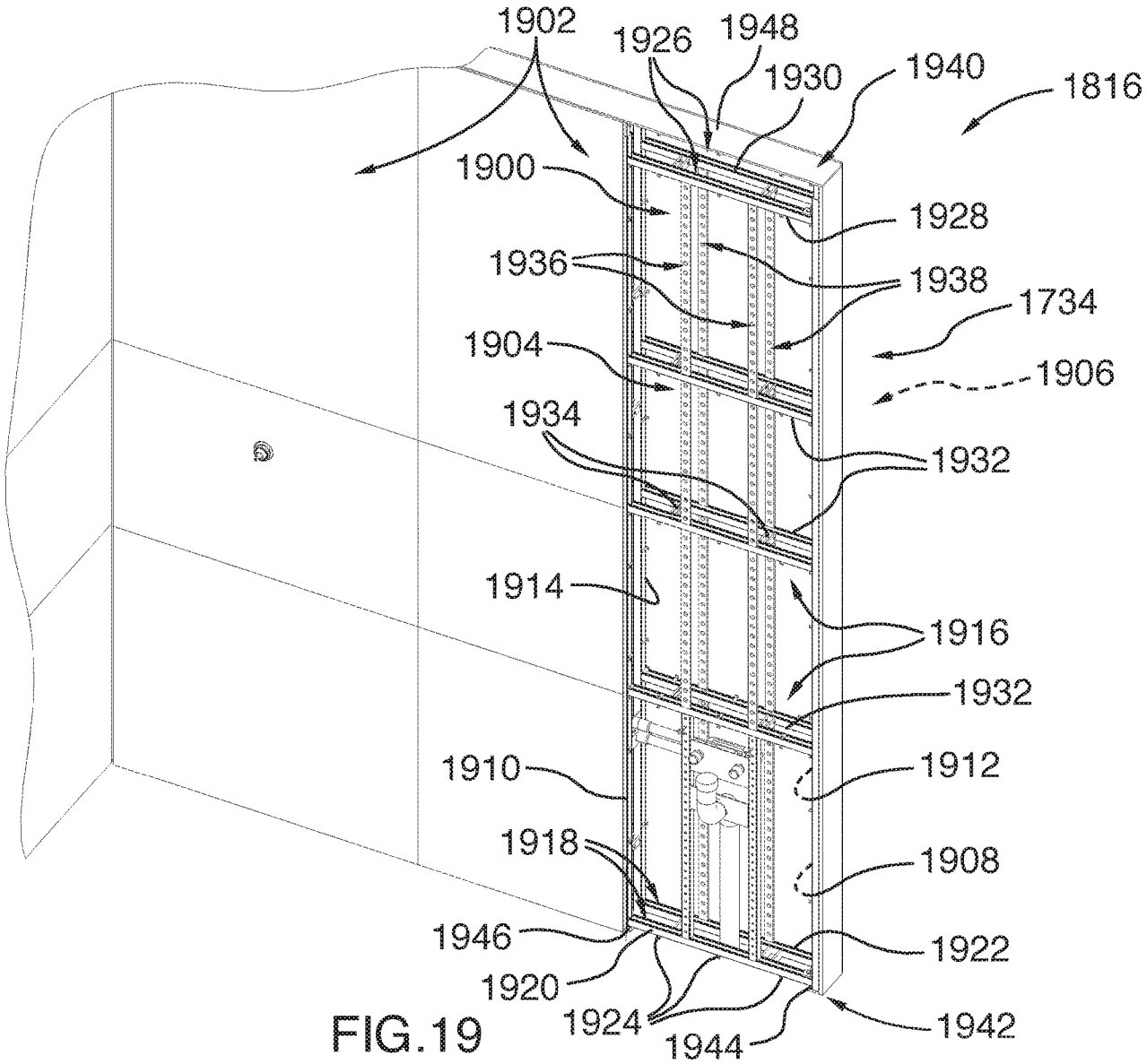
FIG. 19 is a top perspective view of a dividing wall section illustrated in FIG. 17, with the covering panels removed to show details of the wall frame and the top and bottom mounting members.

Now turning to FIGS. 17 and 18, there is shown a building structure 1700, in accordance with one embodiment.

In the illustrated embodiment, the building structure 1700 includes a hollow shell 1702 defining an interior space 1704. Specifically, the shell 1702 includes a floor 1706, a roof panel, not shown, generally disposed opposite and parallel to the floor 1706 and first and second vertical side walls 1710, 1712 extending between the floor 1706 and the roof panel 1708. The shell 1702 further includes first and second vertical end walls 1714, 1716 extending between the floor 1706 and the roof panel 1708 and disposed orthogonally to the first and second vertical side walls 1710, 1712. The first end wall 1714 includes a first wall opening 1718 located near the first vertical side wall 1710 and a second wall opening 1720 located near the second vertical side wall 1712 Similarly, the second end wall 1716 includes a third wall opening 1722 located near the first vertical side wall 1710 and a fourth wall opening 1724 located near the second vertical side wall 1712. In the illustrated embodiment, the first, second, third and fourth wall openings 1718, 1720, 1722, 1724 are generally rectangular and are adapted to receive at least one of a door and a window.

Still in the illustrated embodiment, the building structure 1700 further includes a plurality of interior wall surfaces 1730 disposed within the hollow shell 1702. Specifically, the plurality of interior wall surfaces 1730 includes a plurality of interior wall panels 1738, 1802 disposed against an interior surface of hollow shell 1702 and a plurality of dividing wall sections 1734 which are spaced from the interior surface of hollow shell 1702 and which generally divide the interior space 1704 into a plurality of adjacent living areas.

In the illustrated embodiment, the plurality of interior wall panels 1738 include a first pair of interior corner sections 1736*a*, 1736*b* disposed against the first side wall 1710 adjacent the first and second end walls 1714, 1716, respectively. The plurality of interior wall panels 1802 include a first pair of interior corner sections 1800*a*, 1800*b* disposed against the first side wall 1712 adjacent the first and second end walls 1714, 1716, respectively. Specifically, the interior corner sections 1736*a*, 1736*b*, 1800*a*, 1800*b* are generally planar and rectangular and extend parallel to the first and second side walls 1710, 1712.

In the illustrated embodiment, the plurality of interior wall panels 1738 is disposed against the interior surface of first side wall 1710 of hollow shell 1702 and includes a first group of four interior wall panels disposed between the first pair of interior corner sections 1736*a*, 1736*b*. Similarly, a corresponding plurality of interior wall panels 1802 disposed against the interior surface of first side wall 1712 of hollow shell 1702 includes a second group of four interior wall panels disposed between the first pair of interior corner sections 1800*a*, 1800*b*. Each interior wall panel 1738 and 1802 is generally planar and rectangular and extends parallel to the first and second side end walls 1710, 1712. Alternatively, each one of the first and second groups of interior wall panels 1738, 1802 could instead include more or less than four interior wall panels. In yet another embodiment, the plurality of interior wall panels 1738, 1802 could include a single first interior wall panel extending between the first pair of interior corner sections 1736*a*, 1736*b* and a single second interior wall panel extending between the second pair of interior corner sections 1800*a*, 1800*b*.

In the illustrated embodiment, the plurality of interior wall panels 1738, 1802 further include a control module section 1740 adapted to receive a controller operatively connected to one or more devices or systems of the building structure. For example, the controller could be operatively connected to a heating or HVAC system, an alarm system, a house lighting system, a sound system, an entertainment system including a display screen or the like. The controller could include a personal computer with a communication unit adapted to connect through cables or wirelessly to the devices and systems. The controller could further include an interface such as a touchscreen, a keyboard or any other type of interface that a skilled addressee would consider appropriate.

In the illustrated embodiment, the control module section 1740 is disposed against the second end wall 1716 between the third and fourth wall openings 1722, 1724. Alternatively, the control module could be located elsewhere within the shell 1702.

In one embodiment, each one of the first and second side walls 1710, 1712 are corrugated and includes a plurality of alternating vertical ridges 1804 and grooves 1806. The terms "grooves" and "ridges" used hereinafter refer to the first and second side walls 1710, 1712 as viewed from inside the shell 1702, such that the grooves 1806 extend away from the interior of the shell 1702 and the ridges 1804 extend towards the interior of the shell 1702 relative to the grooves 1806.

In the illustrated embodiment, each interior wall panel 1738, 1802 includes an upper board member 1808 which is adapted to be disposed against the ridges 1804 and a baseboard casing 1810, also adapted to be disposed against the ridges 1804, disposed between the upper board member 1808 and the floor 1706. Specifically, the baseboard casing 1810 is elongated and is disposed generally horizontally along the floor 1706.

The baseboard casing 1810 is hollow and has a generally box-like cross-section adapted for allowing cables and/or piping to pass therethrough. This allows cables and piping to respectively define electrical and plumbing networks which can extend throughout the building structure 1700, as will be explained further below.

In one embodiment, interior wall panels 1738, 1802 are receivable and/or securable within upper board member 1808 and/or baseboard casing 1810 baseboard 1810 to form a wall panel assembly inside the interior of the shell 1702.

In one embodiment, each baseboard casing 1810 further includes a pair of electrical connectors, not shown, located at opposite ends of the baseboard casing 1810, each one facing towards a corresponding adjacent baseboard casing 1810. Each electrical connector is adapted to be operatively connected with a corresponding electrical connector in order to form an electrical connection between the cables extending behind adjacent interior wall panels 1738, 1802.

In one embodiment, the electrical connectors could include quick connect electrical connectors which may facilitate the installation of the interior wall panels 1738, 1802. Alternatively, the electrical connectors could include any type of electrical connectors that a skilled person would consider to be appropriate. In yet another embodiment, the baseboard casings 1810 may not comprise any electrical connectors. Instead, each baseboard casing 1810 could instead have opposite open ends and electrical cables could instead be routed behind multiple adjacent interior wall panels 1738, 1802.

In the illustrated embodiment, each baseboard casing 1810 further includes an electrical outlet 1812 which faces towards the interior of the shell 1702. Specifically, the electrical outlet 1812 is operatively connected to the electrical network, not shown, to allow appliances and electrical devices to be operatively connected to the electrical network.

In one embodiment, the cables could extend though a protective tube which may be made of plastic or another material which a skilled person would consider to be suitable. In this embodiment, the protective tube would extend between the two opposite electrical connectors. Alternatively, a protective tube may not be provided.

In one embodiment, the baseboard casing 1810 may include one or more openings facing upwardly to allow communication between the interior of the baseboard casing 1810 and the vertical grooves 1806 between the upper board member 1808 and the corresponding one of the first and second side walls 1710, 1712. This could allow cables to be routed within the grooves 1806 to electrical devices which are mounted above the floor 1706 to the upper board members 1808 or to the roof panel, such as ceiling lights, ceiling fans or the like. In one embodiment, one or more electrical switches could further be mounted to the upper board member 1808 and be operatively connected to the cables routed through the baseboard casing 1810 to selectively allow and prevent electricity from being routed between the cables in the baseboard casing 1810 and the electrical devices. The electrical switches could also be configured to selectively allow and prevent electricity from being routed between the two opposite electrical connectors of the baseboard casing.

In one embodiment, the baseboard casing 1810 may further be configured to allow communication cables, such as Ethernet cables, or other types of cables therethrough. In this embodiment, the baseboard casing 1810 could include opposite communication cable connectors similar to the electrical connectors described above.

In one embodiment, the baseboard casing 1810 may further be configured to allow piping carrying water or wastewater towards or away from a plumbing fixture, such as a sink, a toilet, a faucet or the like, therethrough. Specifically, the piping could include one or more rigid pipes and/or one or more flexible pipes or hoses. In this embodiment, the baseboard casing 1810 could include opposite pipe connectors located at opposite ends of the baseboard casing 1810 to allow fluid communication between the piping in the baseboard casing 1810 and piping in baseboard casing 1810 of adjacent interior wall panels 1738, 1802.

It will be appreciated that the configuration described above allows an electrical network, a home communication network and/or a plumbing network to be routed throughout the building structure 1700 relatively easily without requiring specialized skills and/or tools.

In an alternative embodiment, the interior wall panels 1738, 1802 do not include a baseboard casing 1810. Electrical cables, communication cables and/or piping could instead be routed between the upper board members 1808 and the corresponding side walls 1710, 1712 of the shell 1702, within cavities in or near the roof panel and/or the floor 1706, or using any other means that a skilled person would consider appropriate.

Still referring to FIGS. 17 and 18, the plurality of dividing wall sections 1734 includes a first dividing wall segment 1814 connected to the first end wall 1714 and disposed perpendicularly to the first end wall 1714, and a second dividing wall segment 1816 perpendicular to the first dividing wall segment 1814. Specifically, the first dividing wall segment 1814 is parallel with and spaced from the second side wall 1712 and the second dividing wall segment 1816 is parallel with and spaced from the first end wall 1714.

In this configuration, the first and second dividing wall segments 1814, 1816 generally define a bathroom area 1818 generally bordered by the first end wall 1714, the second side wall 1712, the first dividing wall segment 1814 and the second dividing wall segment 1816. In the illustrated embodiment, the second dividing wall segment 1816 is spaced from the second side wall 1712 to define therebetween an access opening 1820 for accessing the bathroom area 1818. In one embodiment, the building structure 1700 includes a door for selectively closing the access opening 1820.

Still in the illustrated embodiment, the first and second dividing wall segments 1814, 1816 further generally define a main room area 1822 and a kitchen area 1824 adjacent the main room area 1822. Specifically, the main room area 1822 is generally bordered by the second dividing wall segment 1816, the second end wall 1716, the first side wall 1710 and the second side wall 1712 of the shell 1702, and the kitchen area 1824 is generally bordered by the first dividing wall segment 1814, the first end wall 1714 and the first side wall 1710.

It will be appreciated in alternative embodiments, the plurality of dividing wall sections 1734 could be disposed differently to define different areas and that various alternative combinations are possible.

In the illustrated embodiment, the second dividing wall segment 1816 includes a first dividing wall section 1750, a second dividing wall section 1752 adjacent the first dividing wall section 1750 and a third dividing wall section 1754 disposed adjacent the second dividing wall section 1752 and the first dividing wall segment 1814.

Still in the illustrated embodiment, the first dividing wall segment 1814 includes a fourth dividing wall section 1756 adjacent the third dividing wall section 1754 and a fifth dividing wall section 1758 disposed between the fourth dividing wall section 1756 and the first end wall 1714 of the shell 1702.

In the illustrated embodiment, the building structure 1700 further includes a kitchen module 1850 which may include kitchen appliances such as a stove and an exhaust hood, kitchen cabinets and any other kitchen fixture which a skilled person may consider appropriate. Specifically, the kitchen module 1850 is located in the kitchen area 1824 and is disposed against the first dividing wall segment 1814.

In one embodiment, the kitchen module 1850 is provided as a single unit to facilitate its installation in the kitchen area 1824. Alternatively, the kitchen module 1850 could be provided as separate components which could be installed in the kitchen area 1824 individually.

In the illustrated embodiment, the building structure 1700 further includes a main room storage unit 1860 located in the main room area 1822. Specifically, the main room storage unit 1860 is disposed against the second dividing wall segment 1816. The main room storage unit 1860 could be used for storage of various items or could be used to store a pull down bed, for example. Alternatively, the main room storage unit 1860 could be disposed at a different location such as against the interior wall panels 1738, 1802 of the first or second side walls 1710 or 1712 of the shell 1702.

Now turning to FIGS. 19 to 23, the dividing wall sections 1734 will now be described in accordance with one embodiment.

In the illustrated embodiment, each dividing wall section 1734 includes a wall frame 1900 and a plurality of covering panels 1902 enclosing the wall frame 1900. Specifically, the wall frame 1900 is a three-dimensional, hollow and generally rectangular structure which defines a front face 1904 located towards the bathroom area 1818 and a rear face 1906 located away from the bathroom area 1818. The front face 1904 defines a front vertical plane and the rear face 1906 defines a rear vertical plane which is generally parallel to the front vertical plane.

In the illustrated embodiment, the front face 1904 includes first and second front vertical frame members 1908, 1910 extending within the front vertical plane and the rear face 1906 includes first and second rear vertical frame members 1912, 1914 extending within the rear vertical plane. The front vertical frame members 1908, 1910 are spaced apart from each other by a certain lateral distance and the rear vertical frame members 1912, 1914 are spaced from each other by the same lateral distance. In this configuration, the front and rear vertical frame members 1908, 1910, 1912, 1914 thereby define corners of the wall frame 1900.

Still in the illustrated embodiment, the wall frame 1900 further includes a plurality of horizontal members 1916 which extend transversely between the front and rear vertical frame members 1908, 1910, 1912, 1914. Specifically, the wall frame 1900 includes a pair of spaced-apart bottom horizontal members 1918 extending transversely between the front and rear vertical frame members 1908, 1910, 1912, 1914 near the floor 1706. More specifically, the pair of spaced-apart bottom horizontal members 1918 includes a front bottom horizontal member 1920 extending between the front vertical frame members 1908, 1910, generally in the front vertical plane, and a rear bottom horizontal member 1922 extending between the rear vertical frame members 1912, 1914, generally in the rear vertical plane. The front and rear bottom horizontal members 1920, 1922 are further disposed in a common bottom horizontal plane.

Figure 20:
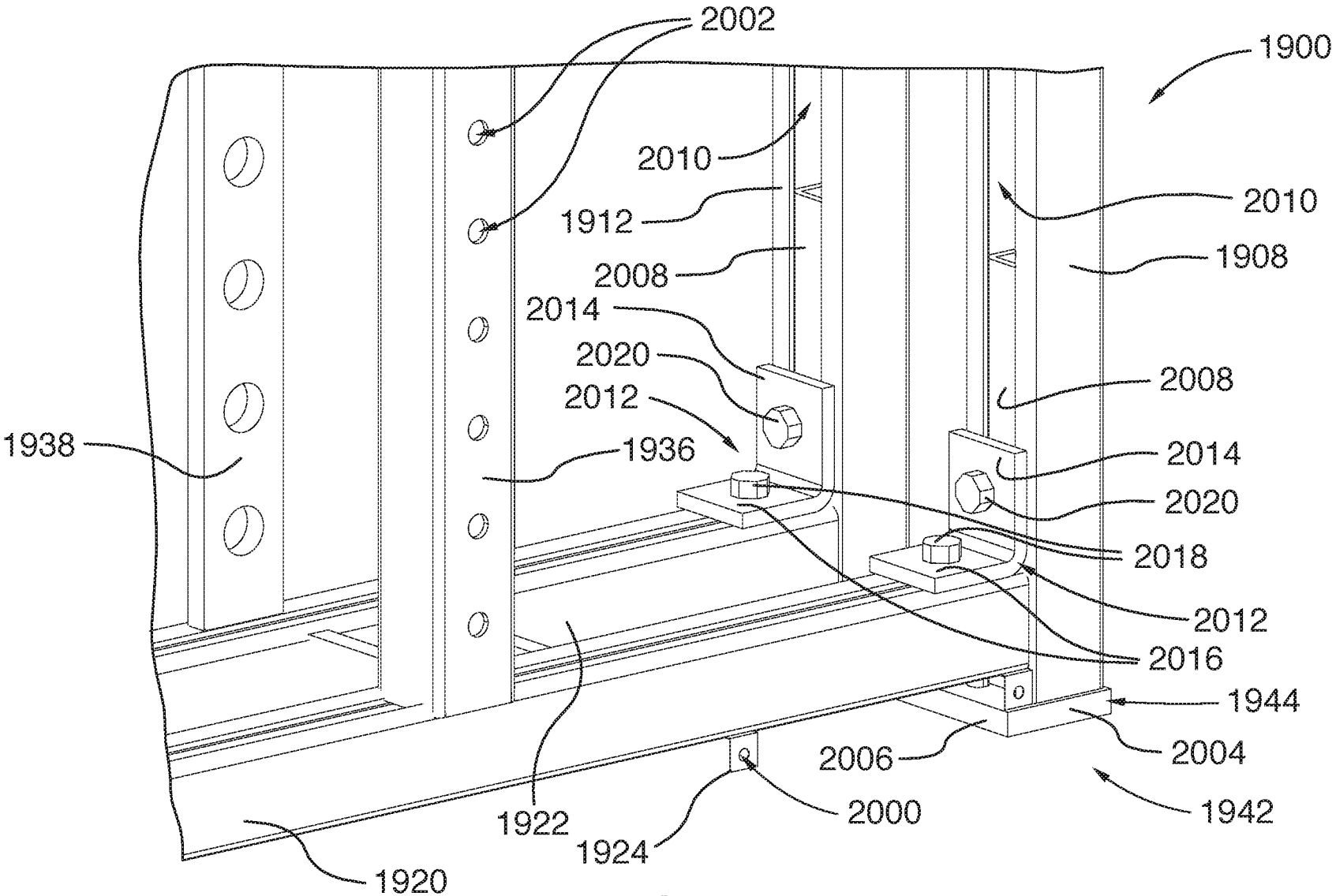
FIG. 20 is an enlarged top perspective view showing the bottom mounting member of the dividing wall section illustrated in FIG. 19.
Figure 21:
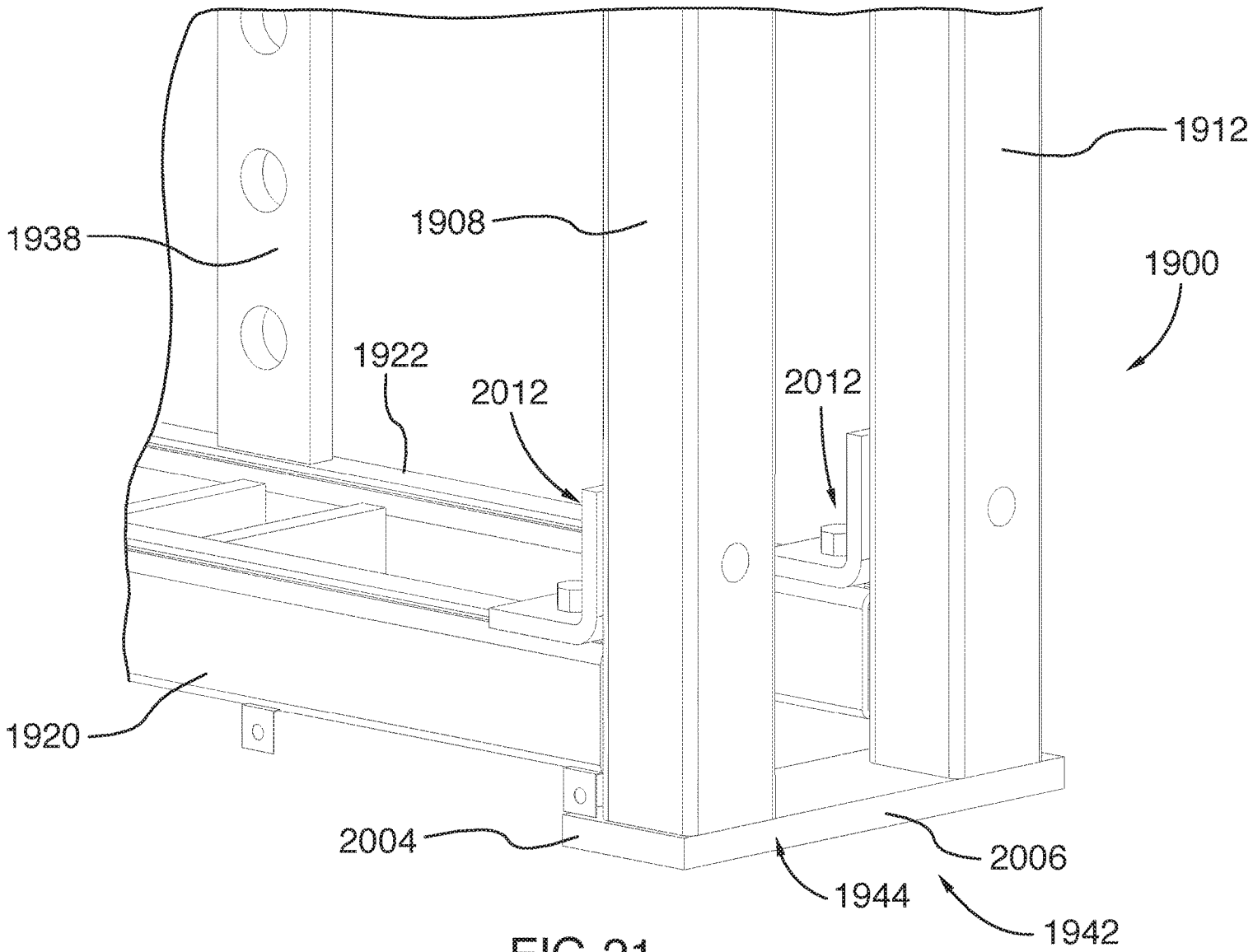
FIG. 21 is another enlarged top perspective view showing the bottom mounting member of the dividing wall section illustrated in FIG. 19.
Figure 22:
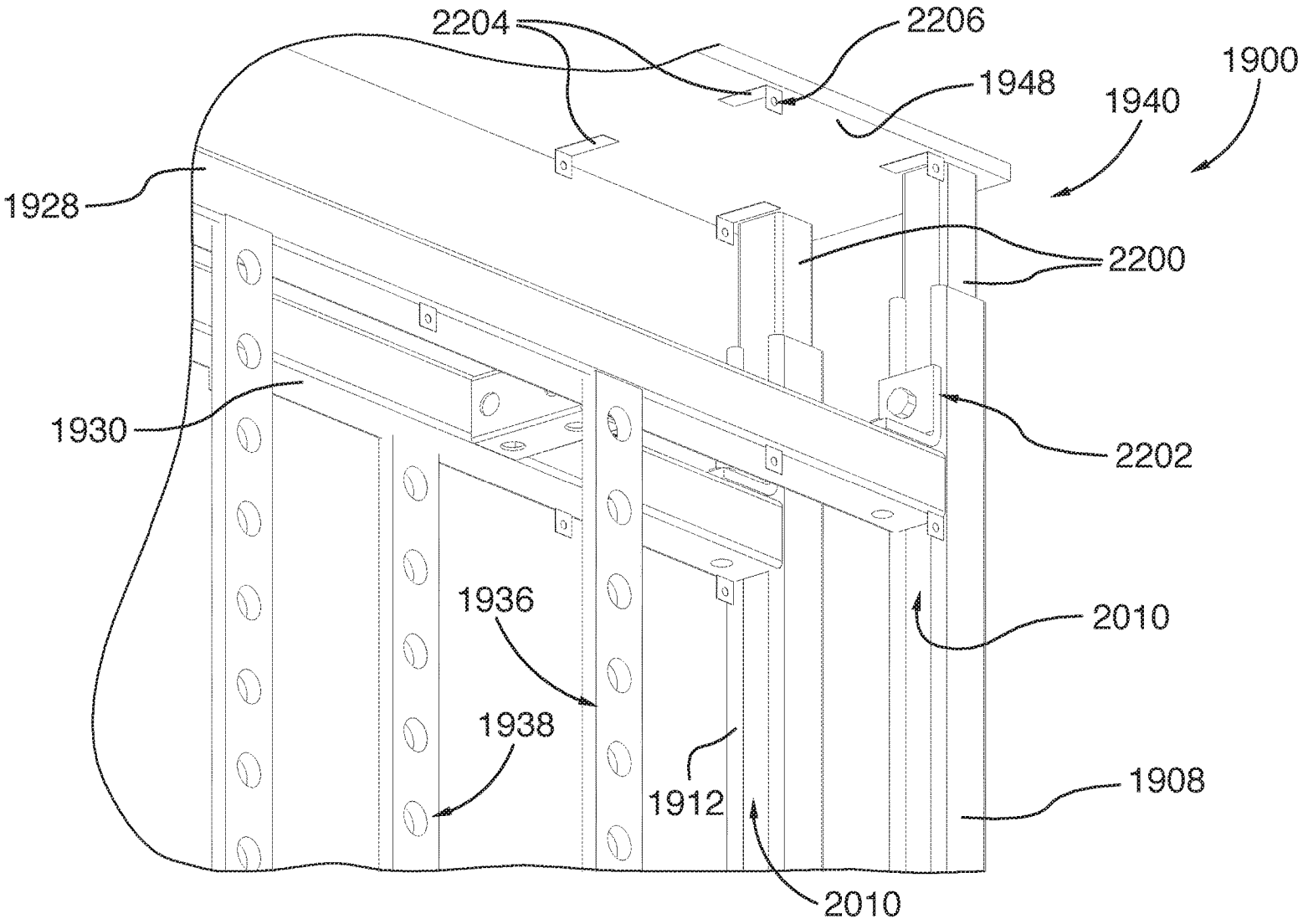
FIG. 22 is an enlarged bottom perspective view showing the top mounting member of the dividing wall section illustrated in FIG. 19.
Figure 23:
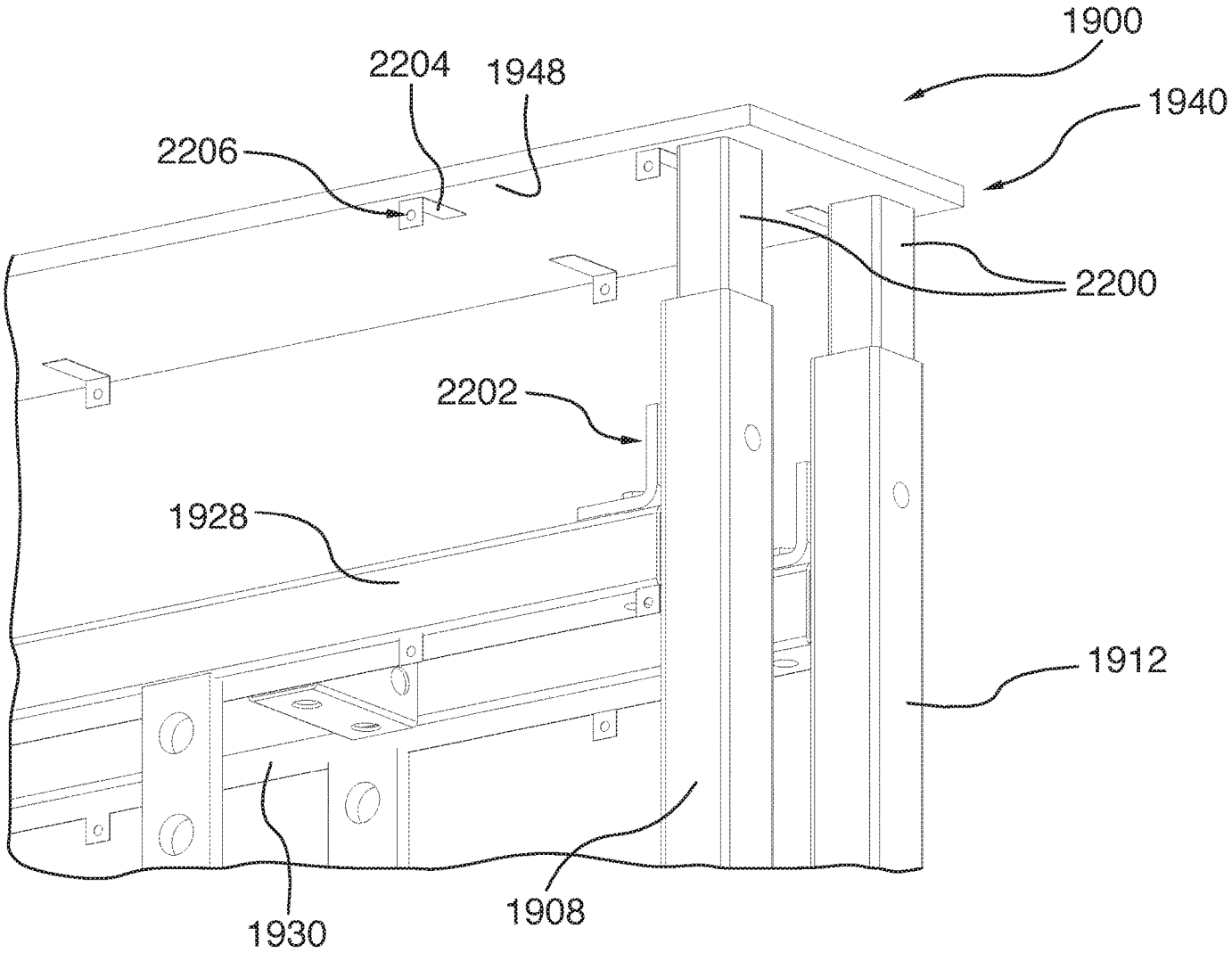
FIG. 23 is another enlarged bottom perspective view showing the top mounting member of the dividing wall section illustrated in FIG. 19.

In the illustrated embodiment, the wall frame 1900 further includes a plurality of bottom panel securing brackets 1924, best shown in FIG. 20, extending downwardly from the bottom horizontal members 1920, 1922 for securing the covering panels 1902 to the wall frame 1900. Specifically, the bottom panel securing brackets 1924 include a fastening opening 2000 adapted to receive a panel securing fastener, not shown. To secure a covering panel 1902 to the corresponding wall frame 1900, the panel securing fastener is inserted through the covering panel 1902 and the fastening opening 2000. Alternatively, the wall frame 1900 may not include any bottom panel securing brackets 1924.

Still in the illustrated embodiment, the wall frame 1900 further includes a pair of spaced-apart top horizontal members 1926 extending transversely between the front and rear vertical frame members 1908, 1910, 1912, 1914 near the roof panel. The pair of spaced-apart top horizontal members 1926 include a front top horizontal member 1928 extending between the front vertical frame members 1908, 1910 and a rear top horizontal member 1930 extending between the rear vertical frame members 1912, 1914. The front and rear top horizontal members 1928, 1930 are disposed in a common top horizontal plane.

In the illustrated embodiment, the wall frame 1900 further includes three pairs of intermediate horizontal frame members 1932 which are vertically spaced apart from each other and which are vertically spaced from the bottom and top horizontal members 1918, 1926.

Still in the illustrated embodiment, the wall frame 1900 further includes a plurality of connecting members 1934 extending horizontally between the front and rear faces of the wall frame 1900 to connect together each pair of horizontal members 1916. Specifically, the connecting members 1934 are generally disposed in the horizontal planes defined by the corresponding horizontal members 1916.

In the illustrated embodiment, the wall frame 1900 further includes a plurality of vertical bracket mounting members 1936 disposed generally parallel to the vertical frame members 1908, 1910, 1912, 1914. Specifically, the wall frame 1900 includes spaced-apart first and second front bracket mounting members 1936 extending vertically between the front top horizontal member 1928 and the front bottom horizontal member 1920 and first and second spaced-apart rear bracket mounting members 1938 extending vertically between the rear top horizontal member 1930 and the rear bottom horizontal member 1922. Each vertical bracket mounting member is perforated to allow brackets holding various accessories, fittings and/or devices to be attached to the wall frame 1900. Specifically, each vertical bracket mounting member 1936, 1938 includes a plurality of mounting holes 2002 spaced relatively evenly along the vertical bracket mounting member 1936, 1938 between the corresponding top and bottom horizontal members 1928, 1920 or 1930, 1922. This configuration allows brackets to be secured at a desired height, as will be explained further below. While in this embodiment, brackets can be secured to the vertical bracket mounting member 1936, 1938 via the plurality of mounting holes 2002, it will be understood that accessories, fitting and devices could be mounted to bracket mounting member 1936, 1938 by any suitable means.

In the illustrated embodiment, each vertical bracket mounting member 1936, 1938 is relatively flat and has a generally rectangular cross-section. Alternatively, the vertical bracket mounting members 1936, 1938 could have any other shape or cross-section that a skilled addressee would consider appropriate.

In one embodiment, each vertical bracket mounting member 1936, 1938 includes a single piece extending between the corresponding top horizontal member 1928, 1930 to the corresponding bottom horizontal member 1920, 1922. Alternatively, each vertical bracket mounting member 1936, 1938 could include a plurality of shorter mounting member segments disposed end-to-end.

In the illustrated embodiment, each dividing wall section 1734 further includes a top mounting member 1940 secured to the roof panel and a bottom mounting member 1942 secured to the floor 1706. The top and bottom mounting members 1940, 1942 are adapted to receive the wall frame 1900 and to secure the dividing wall section 1734 to the roof panel and the floor 1706 at a predetermined location.

In the illustrated embodiment, the bottom mounting member 1942 includes first and second bottom base plates 1944, 1946 adapted to be secured to the floor 1706 of the shell 1702. Specifically, the bottom base plates 1944, 1946 are disposed against the floor 1706 so as to lie flat on the floor 1706. Still in the illustrated embodiment, the bottom base plates 1944, 1946 are spaced from each other by a lateral distance corresponding to the lateral distance between the two front vertical members 1908, 1910 and the lateral distance between the two rear vertical members 1912, 1914. The first bottom base plate 1944 is positioned under the first front vertical frame member 1908 and the first rear vertical frame member 1912 and the second bottom base plate 1946 is positioned under the second front vertical frame member 1910 and the second rear vertical frame member 1914.

In the illustrated embodiment, each bottom base plate 1944, 1946 is rectangular and elongated, and defines a longitudinal bottom base plate axis which is perpendicular to the corresponding dividing wall section 1734. Specifically, each bottom base plate 1944, 1946 has a pair of opposite side edges 2004 which extends generally parallel to the corresponding dividing wall section 1734 and a pair of end edges 2006 which extend perpendicularly to the side edges 2004. In the illustrated embodiment, the end edges 2006 are longer than the side edges 2004. Alternatively, the bottom base plates 1944, 1946 could instead be square and the end edges 2006 and the side edges 2004 could be of the same length. In yet another embodiment, the bottom base plates 1944, 1946 could be rectangular, but be sized and shaped so as to define a longitudinal bottom base plate axis which is parallel to the corresponding dividing wall section 1734. In yet another alternative embodiment, the bottom base plates 1944, 1946 could have any other shape that a skilled person may consider appropriate.

In still another embodiment, the bottom mounting member 1942 could include a single bottom base plate instead of two distinct bottom base plates. In this embodiment, the bottom plate could be large enough to be able to be positioned under all four vertical frame members 1908, 1910, 1912, 1914 simultaneously.

In the illustrated embodiment, the bottom mounting member 1942 further includes first and second pairs of corner post members 2008, each pair 2008 being secured to one of the first and second bottom base plates 1944, 1946. Each corner post member extends upwardly from the bottom base plate 1944, 1946 and is disposed generally orthogonally to the bottom base plate 1944, 1946. Each corner post member 2008 is further located near one of the side edges 2004 of the corresponding bottom base plate 1944, 1946.

In the illustrated embodiment, the vertical frame members 1908, 1910, 1912, 1914 of the wall frame 1900 are hollow and each corner post member 2008 is sized and shaped to be received in a corresponding one of the front and rear vertical frame members 1908, 1910, 1912, 1914. In the illustrated embodiment, each corner post member 2008 has a generally rectangular cross-section and the vertical frame members 1908, 1910, 1912, 1914 also have a generally rectangular cross-section. Alternatively, the corner post members 2008 and the front and rear vertical frame members 1908, 1910, 1912, 1914 of the wall frame 1900 could have a square cross-section or any other cross-sectional shape that a skilled person would consider appropriate.

In the illustrated embodiment, each vertical frame member 1908, 1910, 1912, 1914 has an open beam section rather than a closed section. As best shown in FIG. 20, each vertical frame member 1908, 1910, 1912, 1914 includes a longitudinal groove 2010 which faces towards the opposite vertical frame member 1908, 1910, 1912, 1914 and which extends vertically along the vertical frame member 1908, 1910, 1912, 1914. In one embodiment, the longitudinal groove extends along the entire length of the vertical frame member 1908, 1910, 1912, 1914. Alternatively, the longitudinal groove 2010 may extend from a bottom end of the vertical frame member 1908, 1910, 1912, 1914 along only a portion of the vertical frame member's length.

As shown in FIG. 20, the longitudinal groove 2010 allows access into the hollow vertical frame members 1908, 1910, 1912, 1914. When the corner post members 2008 are received in the corresponding vertical frame members 1908, 1910, 1912, 1914, they can therefore be accessed through the longitudinal groove 2010. In the illustrated embodiment, the dividing wall section 1734 further includes a plurality of L-shaped securing members 2012 which are adapted for securing the wall frame 1900 to the bottom mounting member 1942. Specifically, each L-shaped securing member 2012 is generally flat and includes an upper portion 2014 which is disposed generally vertically and a lower portion 2016 which is disposed generally horizontally. The lower portion 2016 includes a lower fastening opening, not shown, adapted for receiving a first fastener 2018 to secure the L-shaped securing member to the wall frame 1900, and the upper portion 2014 includes an upper fastening opening, also not shown, adapted for receiving a second fastener 2020 to secure the L-shaped securing member 2012 to the corner post member 2008 received in the corresponding vertical frame member 1908, 1910, 1912, 1914 through the longitudinal groove 2010. In this configuration, the wall frame 1900 is therefore secured to the corner post member 2008.

Alternatively, the dividing wall section 1734 may not include any L-shaped securing member 2012. Instead, the wall frame 1900 may be secured to the bottom mounting member 1942 by one or more fasteners extending directly through the vertical frame members 1908, 1910, 1912, 1914 and into the corner post members 2008. In yet another embodiment, the dividing wall section 1734 may be secured to the bottom mounting member 1942 using other means such as welding or the like.

In the illustrated embodiment, the top mounting member 1940 includes a top base plate 1948 disposed against the roof panel. Still in the illustrated embodiment, the top mounting member 1940 includes a single, rectangular top base plate 1948. Specifically, the top base plate 1948 is elongated defines a longitudinal top base plate axis which is parallel to the corresponding dividing wall section 1734.

Similarly to the bottom mounting member 1942, the top mounting member 1940 further includes corner post members 2200 which are adapted to be received in the vertical frame members 1908, 1910, 1912, 1914. The dividing wall section 1734 further includes a plurality of L-shaped securing members 2202 adapted for securing the wall frame 1900 to the top mounting member 1940, similarly to the L-shaped securing members 2012 adapted for securing the wall frame 1900 to the bottom mounting member 1942.

In one embodiment, each top base plate 1948 includes four corner post members 2200 disposed so as to be received in the four vertical frame members 1908, 1910, 1912, 1914 of the wall frame 1900. In this embodiment, the length of the top base plate 1948 is generally similar to the width of the dividing wall section 1734. Alternatively, the top base plate 1948 could be longer or shorter than a single dividing wall section, and could include more or less than four corner post members.

In the illustrated embodiment, the top mounting member 1940 further includes a plurality of top panel securing brackets 2204 extending downwardly from the top base plate for securing the dividing wall sections 1734 to the wall frame 1900. Specifically, the top panel securing brackets 2204 are generally similar to the bottom panel securing brackets 1924 and include a fastening opening 2206 adapted to receive a panel securing fastener. To secure a covering panel 1902 to the corresponding wall frame 1900, the panel securing fastener is inserted through the covering panel 1902 and the fastening opening 2206. Alternatively, the wall frame 1900 may not include any top panel securing brackets 2204.

It will be appreciated that the configuration described above allows the wall frame 1900 to be relatively easily installed at a desired location inside the shell 1702 by sliding the corner post members 2008, 2200 in the corresponding vertical frame members 1908, 1910, 1912, 1914.

It will further be appreciated that the top and bottom mounting members 1940, 1942 further define a predetermined location for positioning the wall frame 1900 within the shell 1702. This facilitates the mounting of the building structure 1700 by allowing a user to first position the top and bottom mounting members 1940, 1942 according to a desired configuration and to then secure the wall frame 1900 to the top and bottom mounting members 1940, 1942 to thereby form the dividing wall sections 1734 and divide the shell 1702 into areas in accordance with the desired configuration.

With references to FIGS. 24 to 28, a configuration of first and second dividing walls segments 1814, 1816 will now be described in accordance with one example.

In the illustrated embodiment, the first and second dividing wall segments 1814, 1816 define the bathroom area 1818, as described above. As also described above, the second dividing wall segment 1816 includes first, second and third dividing wall sections 1750, 1752, 1754 and the first dividing wall segment 1814 includes fourth and fifth dividing wall sections 1756, 1758. Still in the illustrated embodiment, each dividing wall section 1734 includes a bottom covering panel 2400 disposed over the corresponding wall frame 1900 near the floor 1706, a top covering panel 2402 disposed over the corresponding wall frame 1900 near the roof panel and an intermediate covering panel 2404 disposed over the corresponding wall frame 1900 between the bottom and top covering panels 2400, 2402.

Figure 24:
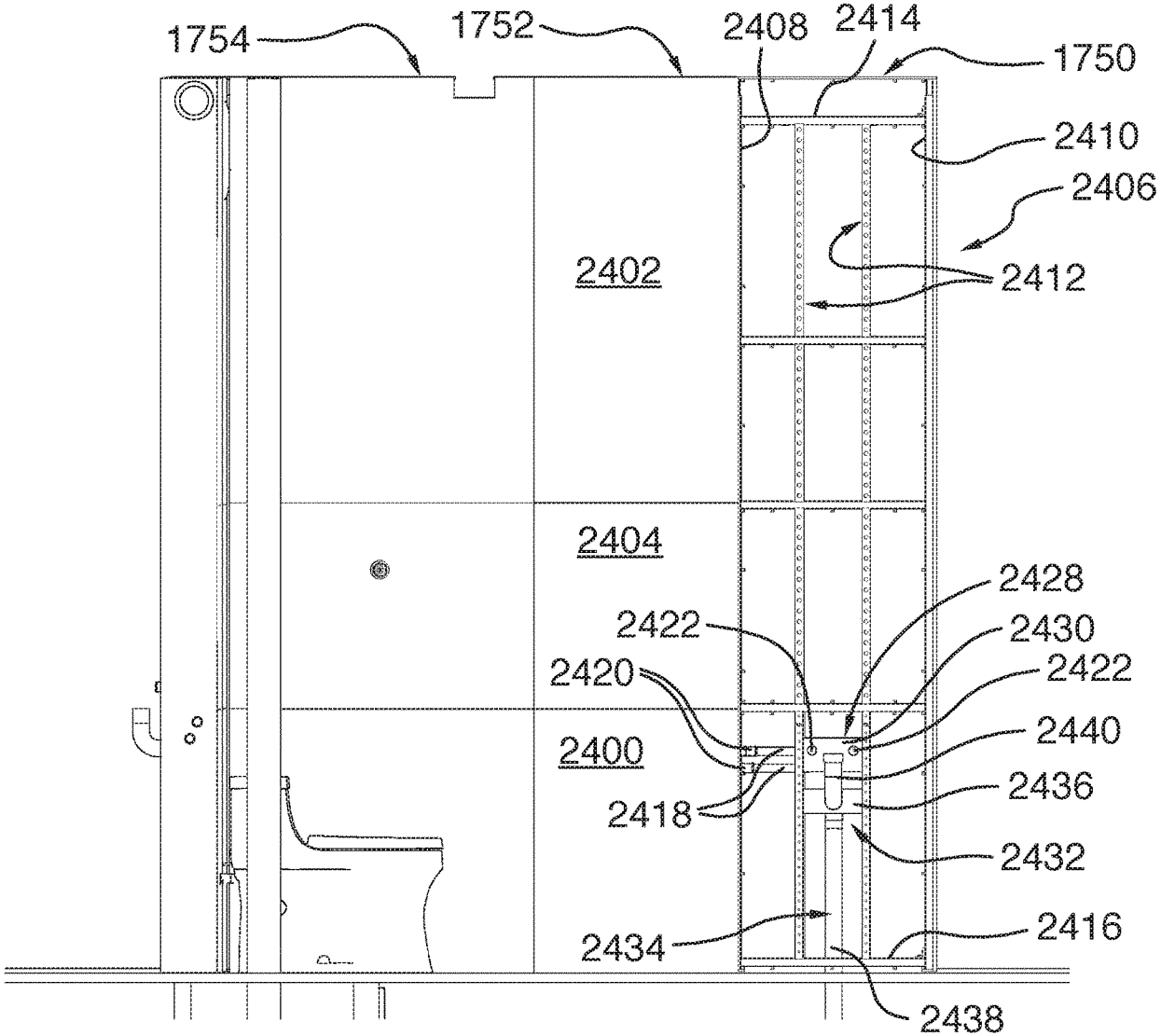
FIG. 24 is a front elevation view of the second dividing wall segment, with the covering panels removed from the first dividing wall section.
Figure 24A:
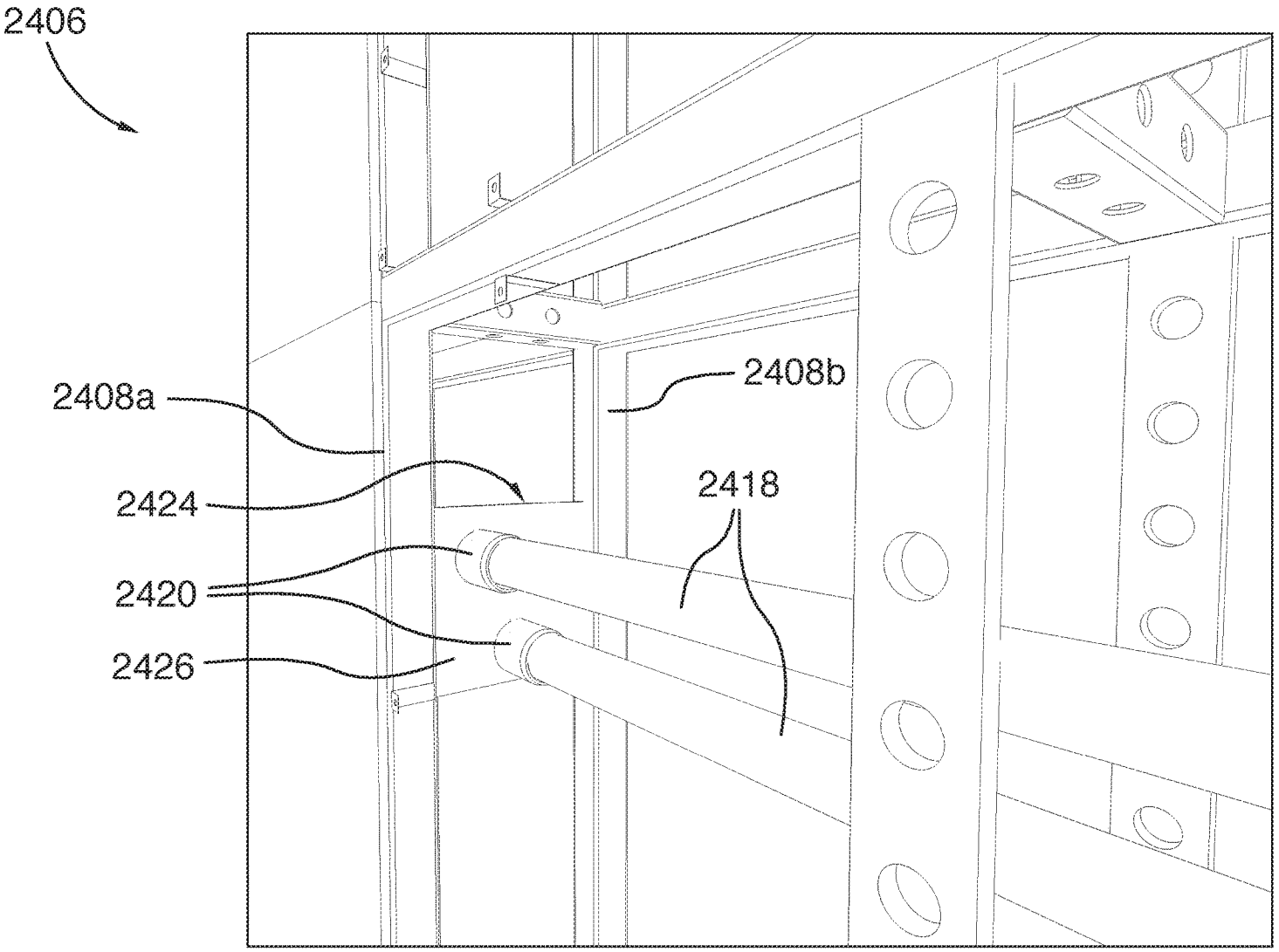
FIG. 24A is an enlarged bottom perspective view of the second dividing wall segment with the covering panels removed from the first dividing wall section to show details of the wall frame.

Referring specifically to FIGS. 24 and 24A, the first dividing wall section 1750 includes a first wall frame 2406 as described above. The first wall frame 2406 includes first front and rear vertical frame members 2408*a*, 2408*b* located near the second dividing wall section 1752 and second front and rear vertical members 2410 located away from the second dividing wall section 1752. The first wall frame 2406 further includes spaced-apart first and second vertical bracket mounting members 2412 extending between top and bottom front horizontal members 2414, 2416.

In the illustrated embodiment, the first dividing wall section 1750 is adapted to receive a sink, not shown. Specifically, the first dividing wall section 1750 includes a pair of water conduits 2418 having an inlet end 2420 and an outlet end 2422. The inlet end 2420 of the water conduits 2418 includes a connector such as a quick connect fitting which allows the water conduits 2418 to be connected to the second dividing wall section 1752 adjacent the first dividing wall section 1750, as will be explained further below.

In the illustrated embodiment, the first dividing wall section 1750 further includes an inlet bracket 2424 located at the inlet end 2420 for securing the connectors to the wall frame 2406 at a desired position. The inlet bracket 2424 includes a generally rectangular inlet bracket plate 2426 which extends generally orthogonally to the first dividing wall section 1750, between the first front vertical frame member 2408*a* and the first rear vertical frame member 2408*b*, and which is secured to the first front vertical frame member 2408*a* and the first rear vertical frame member

2408*b* using fasteners or other securing means such as welding or the like. The inlet bracket 2424 is adapted to receive the connectors, which are secured to the inlet bracket plate 2426 and face towards the second dividing wall section 1752.

Still in the illustrated embodiment, the first dividing wall section 1750 further includes an outlet bracket 2428 located at the outlet end 2422 for securing the outlet end 2422 of the water conduits 2418 to the wall frame 2406 at a desired position. The outlet bracket 2428 also includes a generally rectangular outlet bracket plate 2430 which extends generally parallel to the first dividing wall section 1750, between the first and second vertical bracket mounting members 2412, and which is secured to the first and second vertical bracket mounting members 2412 using fasteners. Alternatively, the outlet bracket plate 2430 could be secured to the first and second vertical bracket mounting members 2412 using other securing means such as welding or any other securing means that a skilled person may consider appropriate. The outlet bracket plate 2430 is adapted to receive the outlet end 2422 of the water conduits 2418, which is secured to the outlet bracket plate 2430 and faces towards the bathroom area 1818. The outlet end 2422 of the water conduits 2418 is adapted to be connected to a sink inlet, not shown, to allow water to be dispensed through the water conduits 2418 to the sink.

In the illustrated embodiment, the first dividing wall section 1750 further includes a drain bracket 2432 adapted to receive a drain pipe 2434 extending upwardly from the floor 1706. Specifically, the drain bracket 2432 also includes a generally rectangular drain plate 2436 which extends generally parallel to the first dividing wall section 1750, between the first and second vertical bracket mounting members 2412, and which is secured to the first and second vertical bracket mounting members 2412 using fasteners. Alternatively, the drain plate 2436 could be secured to the first and second vertical bracket mounting members 2412 using other securing means such as welding or any other securing means that a skilled person may consider appropriate.

In the illustrated embodiment, the drain pipe 2434 is not entirely straight, but instead includes a vertical drain portion 2438 extending upwardly from the floor 1706 and located within the first dividing wall section 1750 and an S-shaped drain portion 2440 extending from the vertical drain portion 2438 through the bottom covering panel, not shown, and further upwardly into the bathroom area 1818. The S-shaped portion 2440 extends through the drain plate 2436 and is held in position by the drain plate 2436, which allows the drain pipe 2434 to be positioned before the bottom covering panel is placed over the wall frame 2406.

It will be understood that the outlet bracket 2428 and the drain bracket 2432 are disposed at a height which is suitable for the mounting of a selected sink in a desired configuration. Alternatively, the outlet bracket 2428 and the drain bracket 2432 could be mounted at a different height for the water conduits 2418 and the drain pipe 2434 to be operatively connected to a different sink or to the same sink configured in an alternative configuration.

Figure 25:
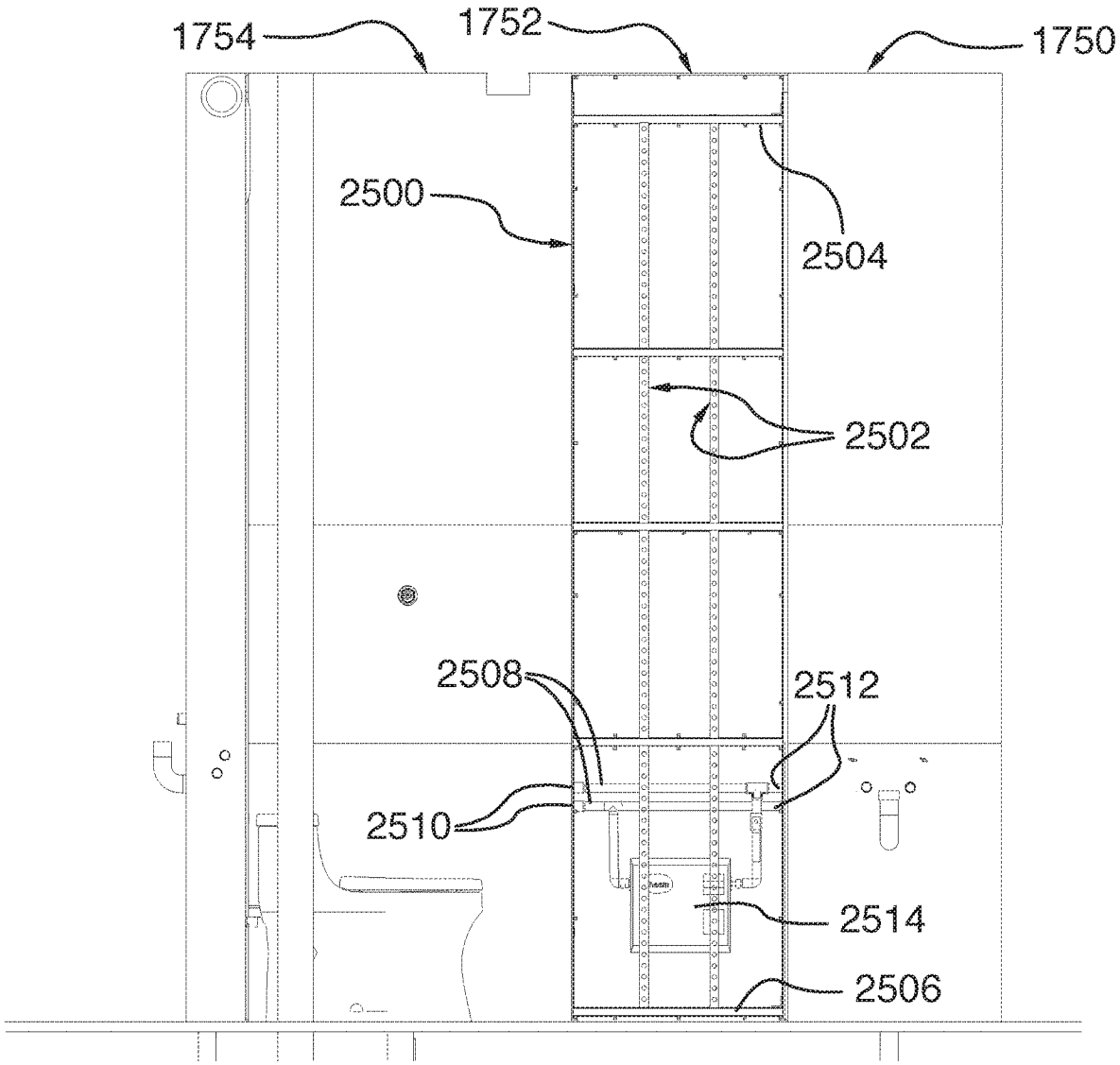
FIG. 25 is a front elevation view of the second dividing wall segment, with the covering panels removed from the second dividing wall section.

Now referring specifically to FIG. 25, the second dividing wall section 1752 is generally similar to the first dividing wall section 1750 and includes a second wall frame 2500 which has a pair of spaced-apart vertical bracket mounting members 2502 extending between top and bottom front horizontal members 2504, 2506. In the illustrated embodiment, the second dividing wall section 1752 includes a pair of water conduits 2508 which extends from the first dividing wall section 1750 to the third dividing wall section 1754 generally horizontally through the second dividing wall section 1752.

In the embodiment illustrated in FIG. 25, the water conduits 2508 of the second dividing wall section 1752 includes a first end 2510 and a second end 2512, each one of the first end 2510 and the second end 2512 being provided with connectors such as quick connect fittings which are adapted to connect the water conduits 2508 to the third dividing wall section 1754 and to the inlet end 2420 of the of the first dividing wall section's water conduits 2418.

In the illustrated embodiment, the second dividing wall section 1752 further includes a water heater 2514 which is secured to the vertical bracket mounting members 2502 and which is operatively connected to one of the water conduits 2508 to receive water and to the other one of the water conduits 2508 to selectively heat water and provide hot water to the other water conduit 2508.

Figure 26:
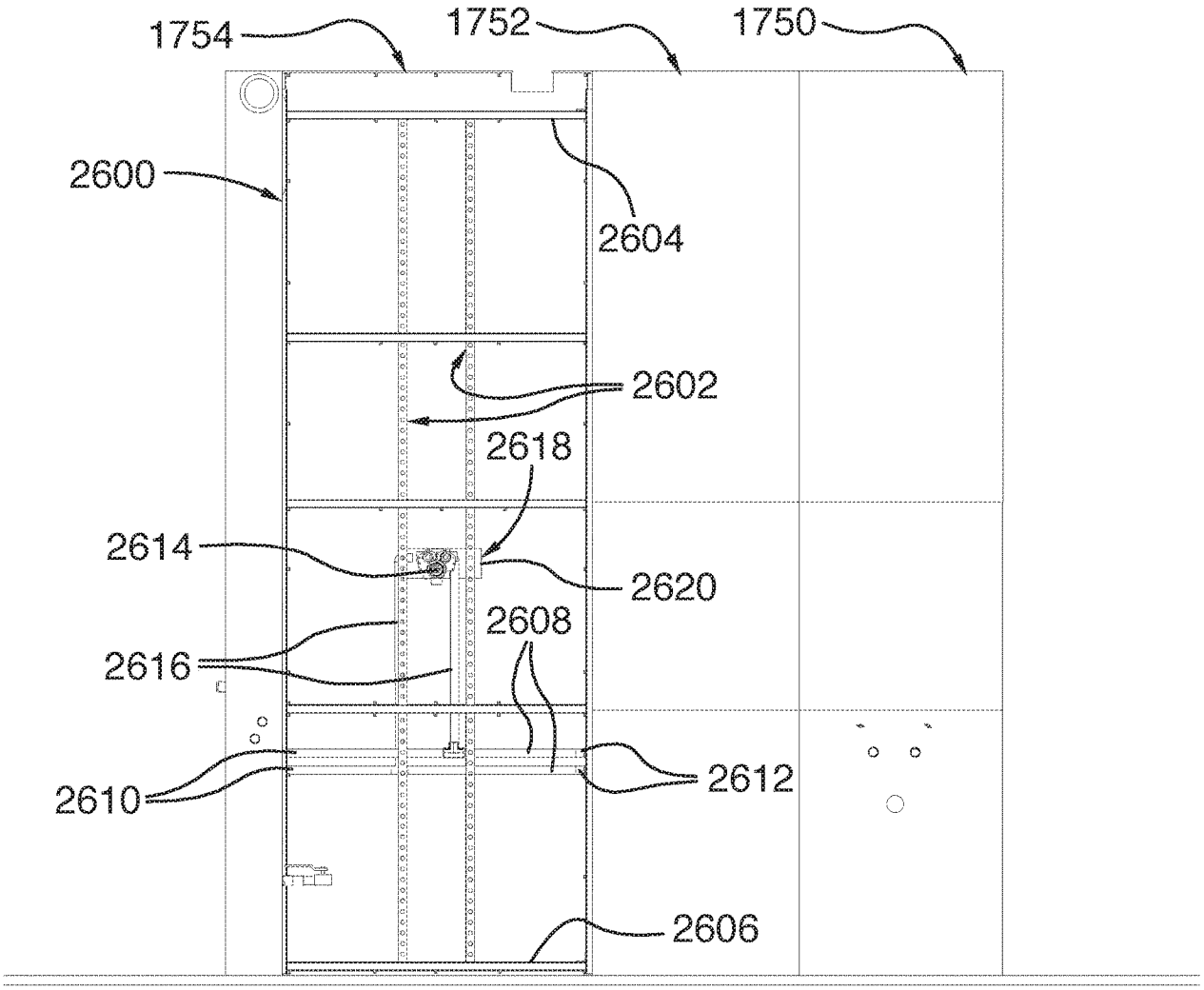
FIG. 26 is a front elevation view of the second dividing wall segment, with the covering panels removed from the third dividing wall section.

Now referring to FIG. 26, the third dividing wall section 1754 includes a third wall frame 2600 which has a pair of spaced-apart vertical bracket mounting members 2602 extending between top and bottom front horizontal members 2604, 2606. In the illustrated embodiment, the third dividing wall section 1754 includes a pair of water conduits 2608 which extends from the second dividing wall section 1752 to the fourth dividing wall section 1756 generally horizontally through the third dividing wall section 1754.

In the embodiment illustrated in FIG. 26, the water conduits 2608 of the third dividing wall section 1754 includes a first end 2610 and a second end 2612, each one of the first end 2610 and the second end 2612 being provided with connectors such as quick connect fittings which are adapted to connect the water conduits 2608 to the fourth dividing wall section 1756 and to the first end 2510 of the second dividing wall section's water conduit 2508.

In the illustrated embodiment, the third dividing wall section 1754 is adapted to receive a shower and/or bathtub. More specifically, the third dividing wall section 1754 further includes a shower fitting 2614 adapted for operatively connecting a shower head and corresponding faucets, not shown, to the water conduits 2608. The shower fitting 2614 is operatively connected to the water conduits 2608 by a pair of water delivery lines 2616 extending vertically and upwardly from the water conduits 2608. In the illustrated embodiment, the third dividing wall section 1754 includes a shower bracket 2618 adapted to receive the shower fitting 2614. The shower bracket 2618 includes a generally rectangular shower plate 2620 which extends generally parallel to the third dividing wall section 1754, between the vertical bracket mounting members 2602, and which is secured to the vertical bracket mounting members 2602 using fasteners. Alternatively, the shower plate 2620 could be secured to the vertical bracket mounting members 2602 using other securing means such as welding or any other securing means that a skilled person may consider appropriate.

Figure 27:
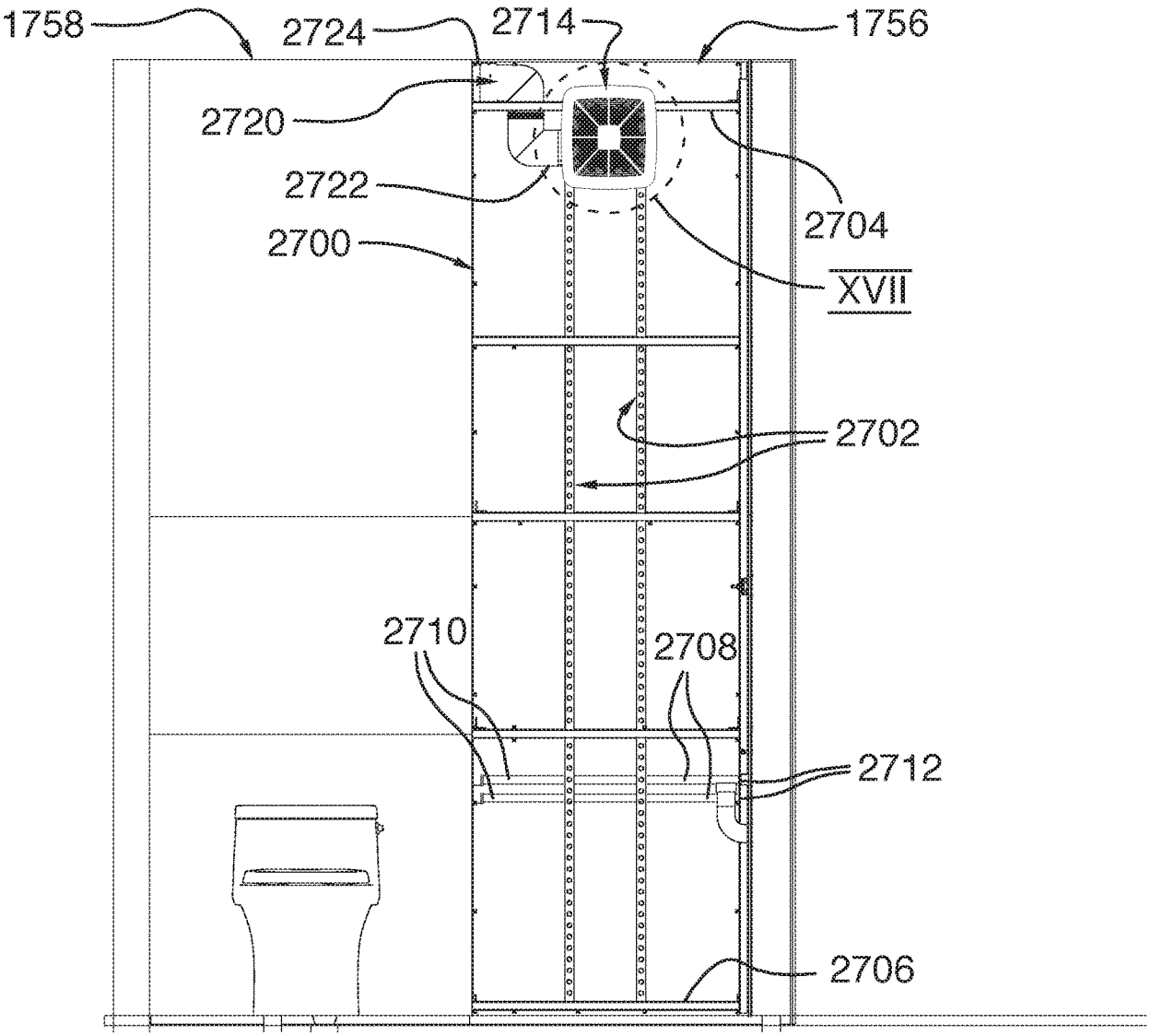
FIG. 27 is a front elevation view of the first dividing wall segment, with the covering panels removed from the fourth dividing wall section.
Figure 27A:
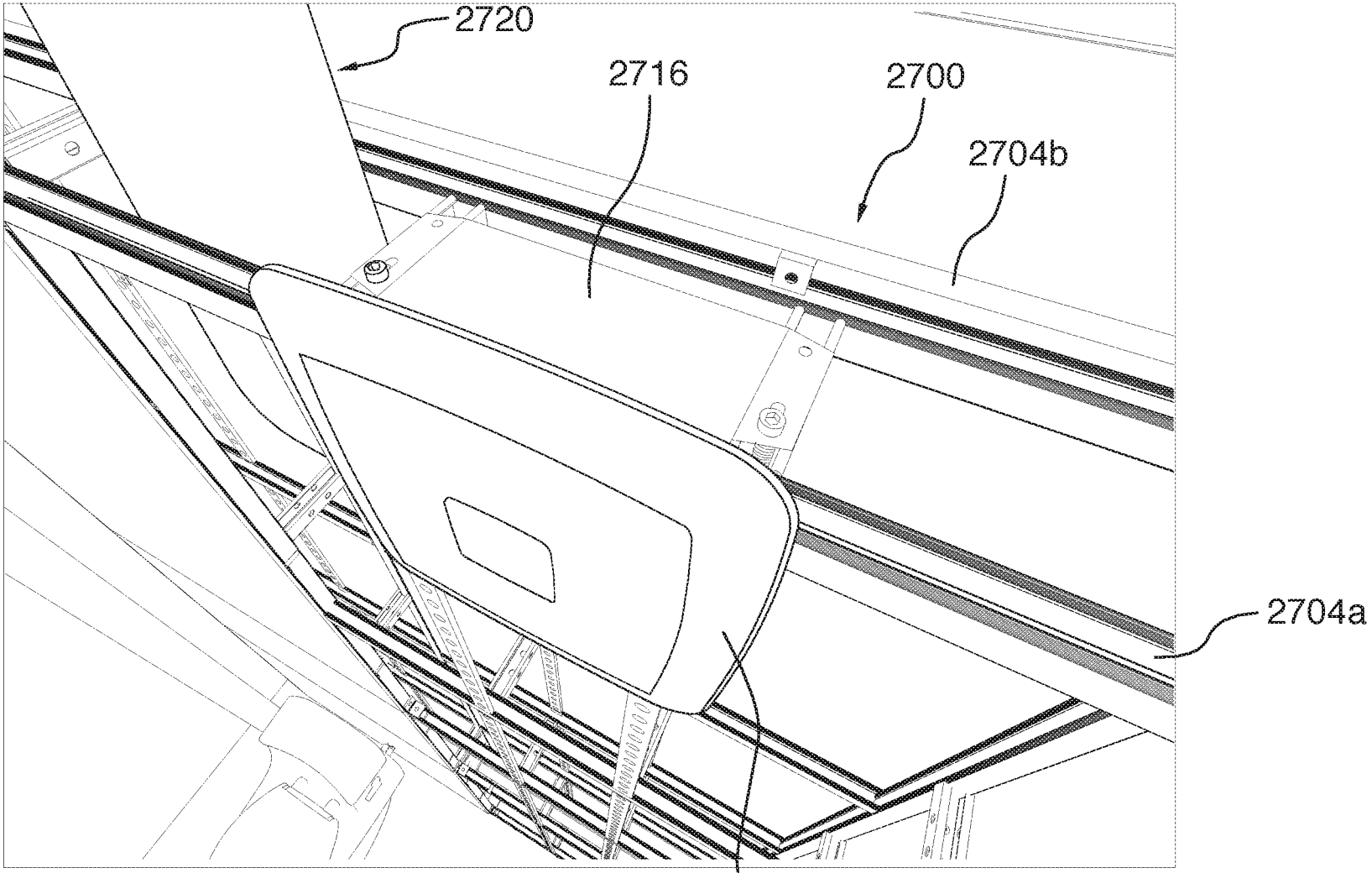
FIG. 27A is an enlarged bottom perspective view of the exhaust vent assembly taken from area XVII of FIG. 27.

Now referring to FIG. 27, the fourth dividing wall section 1756 includes a fourth wall frame 2700 which has a pair of spaced-apart vertical bracket mounting members 2702 extending between top and bottom front horizontal members 2704, 2706. In the illustrated embodiment, the fourth dividing wall section 1756 includes a pair of water conduits 2708 which extends from the third dividing wall section 1754 to the fifth dividing wall section 1758 generally horizontally through the fourth dividing wall section 1756.

In the embodiment illustrated in FIG. 27, the water conduits 2708 of the fourth dividing wall section 1756 includes a first end 2710 and a second end 2712, each one of the first end 2710 and the second end 2712 being provided with connectors such as quick connect fittings which are adapted to connect the water conduits 2708 to the fifth dividing wall section 1758 and to the first end 2610 of the third dividing wall section's water conduit 2608.

In the illustrated embodiment, the fourth dividing wall section 1756 is adapted to house an exhaust vent assembly 2714. Specifically, the exhaust vent assembly 2714 includes a fan mounting plate 2716 secured to the wall frame 2700 and an exhaust fan 2718 extending downwardly from the fan mounting plate 2716. Specifically, the fan mounting plate 2716 is disposed generally parallel to the roof panel and extends horizontally between the two top horizontal members 2704*a*, 2704*b* of the fourth wall frame 2700.

In the illustrated embodiment, the fourth dividing wall section 1756 further includes an exhaust duct 2720 which has an inlet end 2722 operatively connected to the exhaust fan 2718 and an outlet end 2724 connected to the fifth dividing wall 1758 to allow air to be extracted from the bathroom area 1818 by the exhaust fan 2718.

Figure 28:
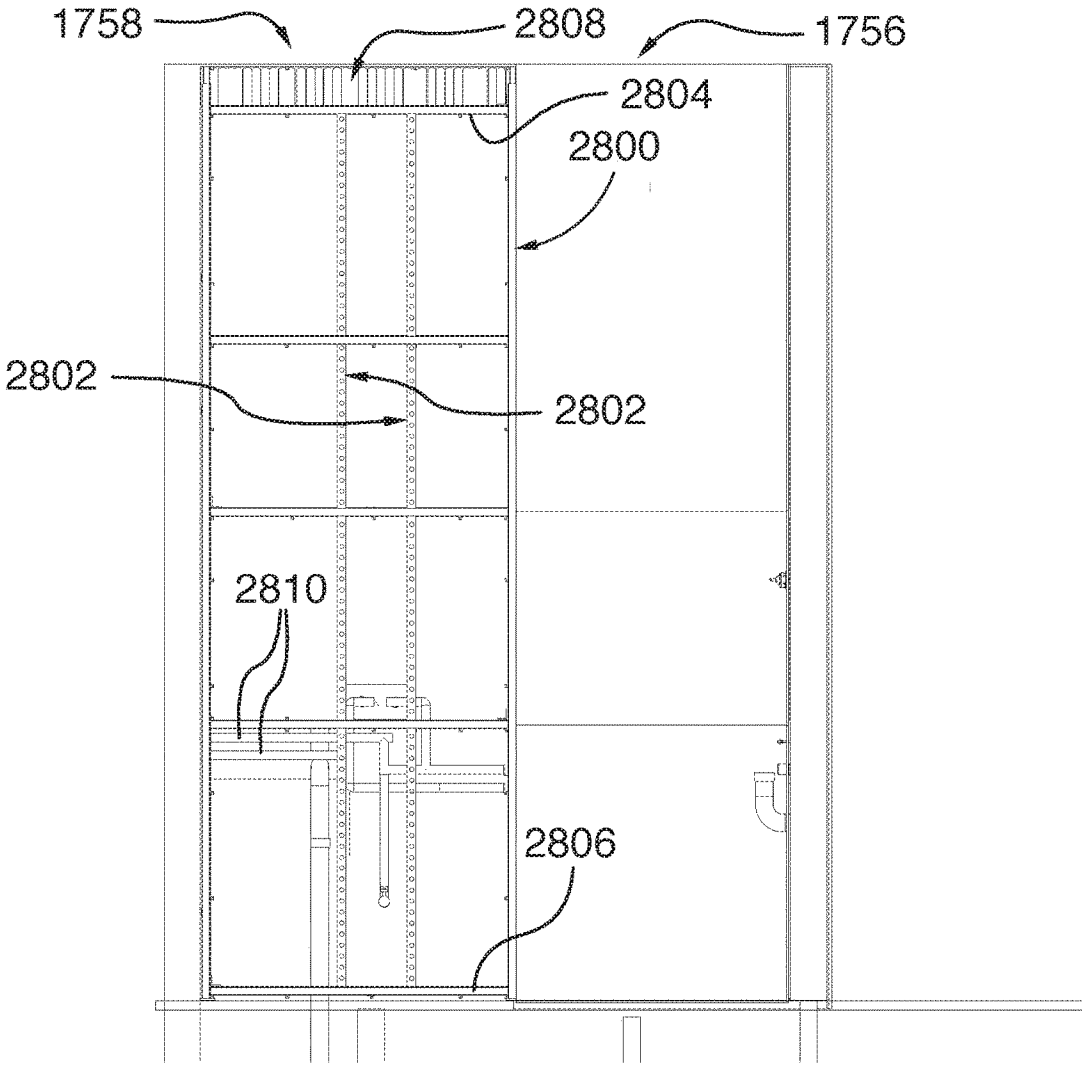
FIG. 28 is a front elevation view of the first dividing wall segment, with the covering panels removed from the fifth dividing wall section.

Now referring to FIG. 28, the fifth dividing wall section 1758 includes a fifth wall frame 2800 which has a pair of spaced-apart vertical bracket mounting members 2802 extending between top and bottom front horizontal members 2804, 2806.

In the illustrated embodiment, the fifth dividing wall section 1758 includes an air conduit 2808 extending from the fourth dividing wall section 1756 to the first end wall 1714 of the shell 1702. More specifically, the air conduit 2808 is operatively connected to the outlet end 2724 of the fourth dividing wall section's exhaust duct 2720 to allow air from the exhaust fan 2718 to be expelled towards the exterior of the shell 1702. In one embodiment, the air conduit 2808 is configured to expel air through the first end wall 1714. Alternatively, the air conduit may be configured to expel air through the roof panel or any other wall of the shell 1702.

In the illustrated embodiment, the fifth dividing wall section 1758 further includes a pair of water conduits 2810 which extends from the fourth dividing wall section 1756 to the first end wall 1714 of the shell 1702 through the fifth dividing wall section 1758. Specifically, the water conduits 2810 are operatively connected to a toilet mounted to the fifth dividing wall section 1758 and located in the bathroom area 1818 for providing water to the toilet.

In the illustrated embodiment, the water conduits 2810 are further operatively connected to the kitchen unit 1850 located in the kitchen area 1824. Specifically, the kitchen unit 1850 includes a kitchen sink and the water conduits 2810 are operatively connected to the kitchen sink to provide water to the kitchen sink. Still in the illustrated embodiment, the fifth dividing wall section 1758 further includes a sink drain adapted to be operatively connected to the kitchen sink to allow water to drain from the kitchen sink. It will be understood that the kitchen unit 1850 could include one or more additional plumbing fixtures such as a dishwasher or a water dispenser which could be operatively connected to the water conduits 2810 of the fourth and/or fifth dividing wall sections 1756, 1758.

It will further be understood that the fifth dividing wall section 1758 could include connectors such as quick connect fittings to connect the water conduits 2810 to the toilet, kitchen sink and various plumbing fixture operatively connected to the water conduits. The connectors could be received in one or more mounting plates secured to the vertical bracket mounting members 2802 and/or to the vertical frame members to allow the quick connect fittings to be positioned at a desired height and location, as described above for the other wall sections.

In one embodiment, all of the water conduits of the dividing wall sections 1734 include flexibles tubes. It will be appreciated that this configuration facilitates the installation of the outlet ends of the water conduits at a desired height and/or position. In one embodiment, the user may not even need to cut the tubes, but could simply bend the tube within the dividing wall section 1734 until the outlet end is at the desired height and/or position.

In addition to water conduits, the dividing wall sections 1734 may further include an electrical circuit comprising one or more electrical cables extending through the wall frame 1900 of the dividing wall sections 1734.

It will be appreciated that the dividing wall sections 1734 are modular and can relatively easily be configured and positioned within the shell 1702 according to a desired configuration. Specifically, the dividing wall sections 1734 described above all have a similar wall frame 1900 which can therefore be prefabricated in relatively large quantities, thereby reducing the manufacturing costs of the dividing wall sections 1734.

Once the wall frames 1900 are provided to the customers, the wall frames 1900 can then easily customized by the user to accommodate various accessories, fittings or devices by using brackets secured to the vertical bracket mounting members and/or the vertical frame members as described above.

In one embodiment, the wall frames 1900 could be preassembled by the manufacturer and delivered already assembled to the user. Alternatively, the members of the wall frames 1900 could be delivered to the user unassembled and assembled by the user.

Furthermore, the top and/or bottom mounting members 1940, 1942 can be positioned within the shell 1702 to define areas within the shell 1702 before the wall frames 1900 are installed. The user may therefore be sure that all dividing wall sections 1734 will be at their proper location and will be properly aligned with the other dividing wall sections 1734 according to a desired configuration when the wall frames 1900 are installed. The user may further be sure that all wall frames 1900 will be installed properly since a unique, definite position is defined for each wall frame 1900 relative to the corresponding top and/or bottom mounting member 1940, 1942 by the corner post members engaging the vertical frame members of the wall frame 1900.

It will be appreciated that the configuration described above is merely provided an example, and that various alternative configurations are possible. Specifically, the dividing wall sections 1734 could be arranged differently to divide the shell 1702 into different areas. In another embodiment, the shell 1702 could include more than two containers (e.g. more than two shipping container) and could be shaped differently, thereby creating a larger and/or differently shaped interior area which could be divided differently. It will further be appreciated that various additional devices, systems and appliances could be incorporated into the building structure, such as for example a heating unit or a HVAC unit which could be installed on the roof panel or in the shell's walls and be operatively connected to a plurality of air conduits extending behind the interior wall panels 1738, 1802 and/or inside dividing wall sections to provide hot and/or cold air throughout the shell.

While in this embodiment the interior wall panels 1738, 1802 are for use with containers in general and more particularly shipping containers, the person skilled in the art will appreciate that the interior wall panels may also be used with any other types of construction modules such as, e.g., sectional prefabricated building shells, prefabricated home shells, precision built home shells, and the likes, without departing from the scope of the present invention. It is understood that the construction modules referred hereinabove means construction with or without inner dividing walls. As it will be appreciated by the skilled person, constructions not necessarily seen as modular construction like, e.g., doublewides or mobile homes, may also be used without departing from the scope of the present invention. The person skilled in the art will further appreciate that these building unit modules and other constructions may be made of various material including, but not limited to, metal, wood, concrete, fiberglass, and/or polymers.

Figure 29:
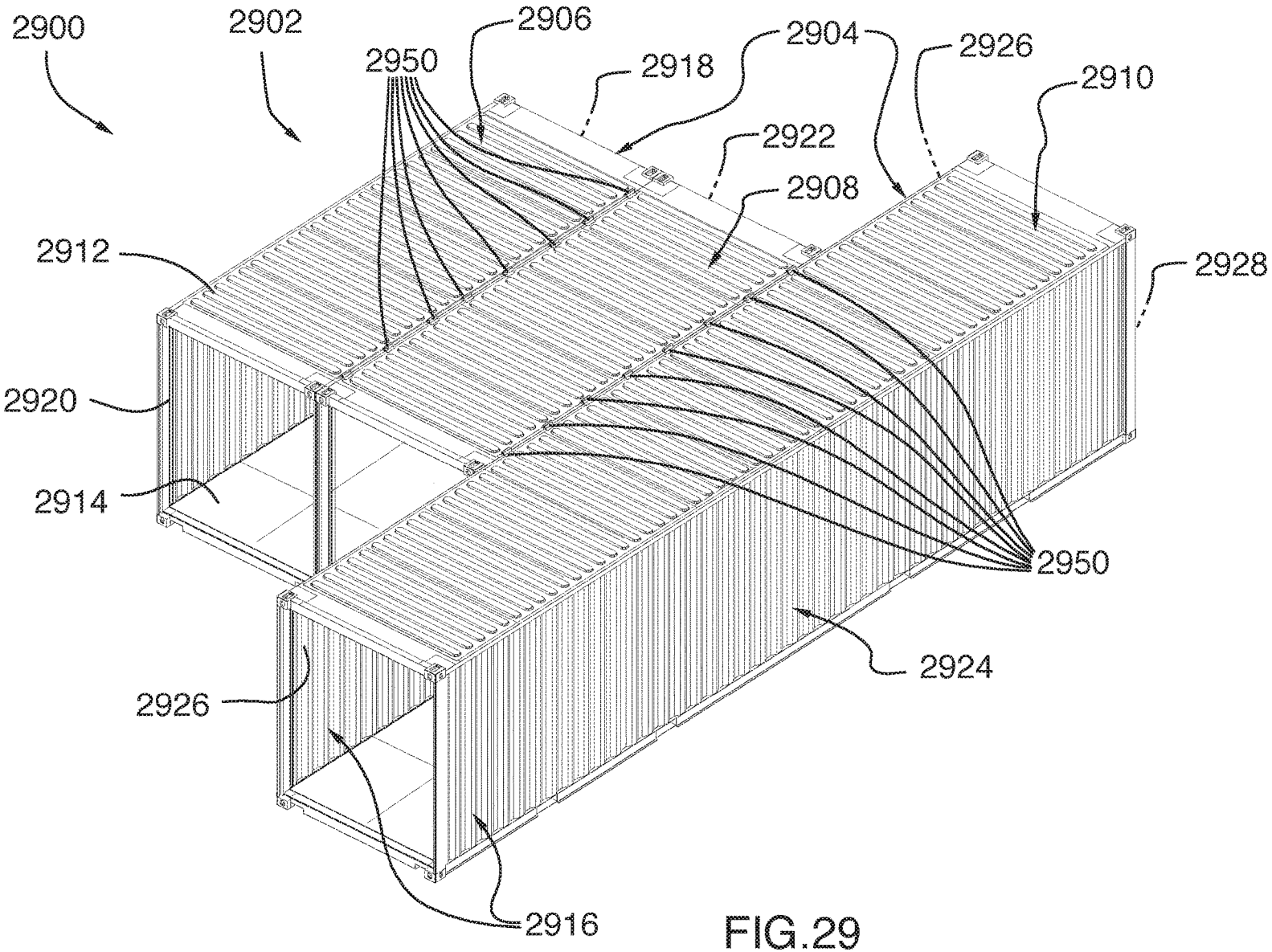
FIG. 29 is a top perspective view of a building structure including a shell made of a plurality of containers, in accordance with one embodiment.
Figure 30:
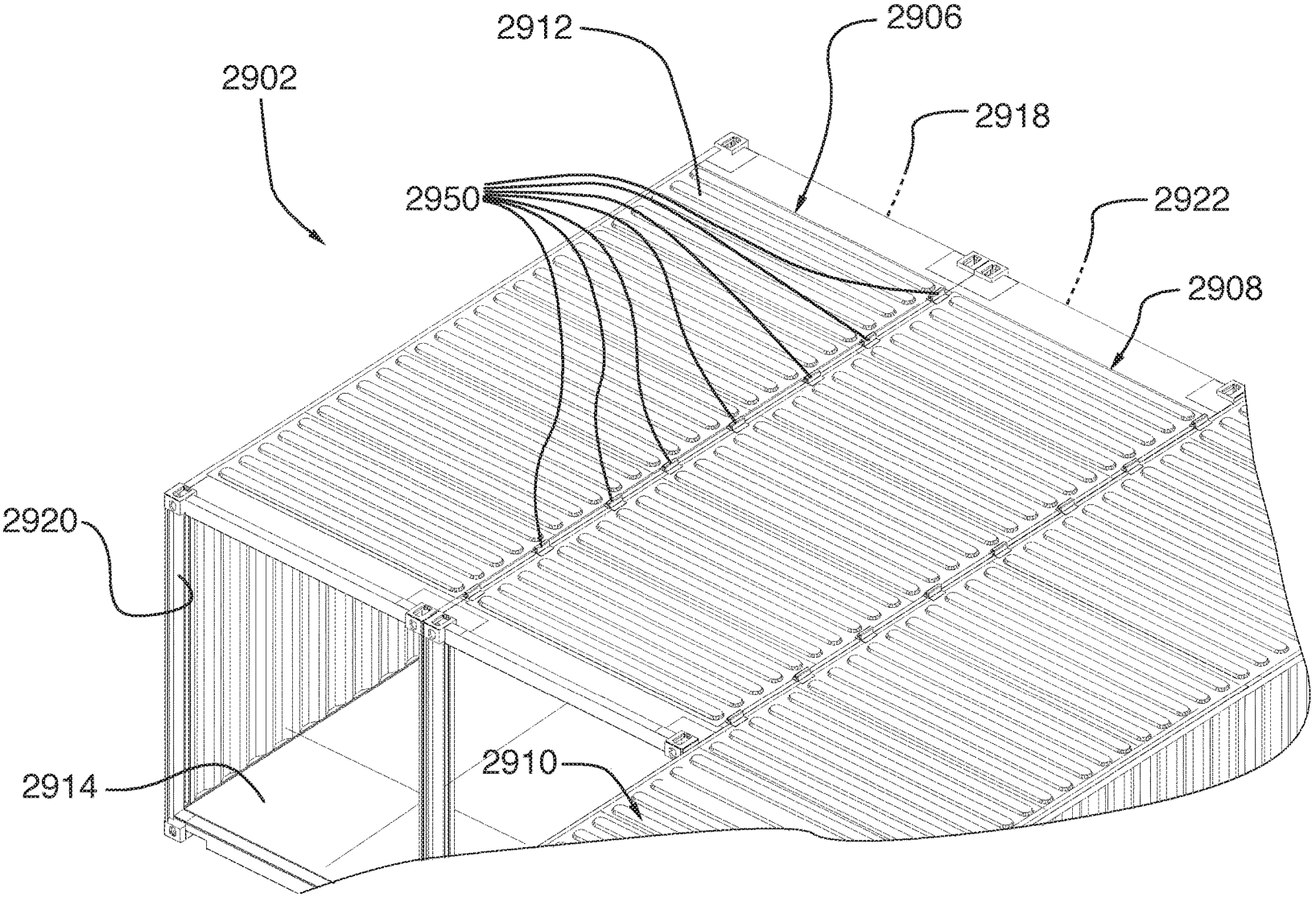
FIG. 30 is an enlarged portion of the perspective view of the building structure illustrated in FIG. 29, showing the top attachment subassemblies between the first and second containers.

Now referring to FIGS. 29 and 30, there is shown a building structure 2900 including a shell 2902, in accordance with another embodiment. In the embodiment illustrated in FIGS. 29 and 30, the shell 2902 includes a plurality of containers 2904 which are attached together using a container attachment assembly to define a single shell. Specifically, the containers 2904 are manufactured from conventional containers which have been modified such that the interior space of all of the containers are placed in communication with each other to form a single living space within the shell 2902.

In the illustrated embodiment, the shell 2902 includes first, second and third rectangular and elongated containers 2906, 2908, 2910 disposed side-by-side. Specifically, the containers 2904 are standard intermodal shipping containers, with the third container 2910 being longer than the first and second containers 2906, 2908. In one embodiment, the first and second containers are 20-foot long containers and the third container is a 40-foot long container, which are both standard sizes for intermodal shipping containers as will appreciate a skilled person. Alternatively, the first, second and third containers 2906, 2908, 2910 could have various other lengths.

In the illustrated embodiment, each container 2904 includes a roof panel 2912 and a floor 2914, both disposed generally horizontally, and a plurality of walls 2916 disposed generally vertically. Specifically, the first container 2906 includes a first end wall, not shown, a second end wall 2918 opposite and spaced from the first end wall and an outer side wall 2920 disposed orthogonally to the first and second end walls 2918. The second container 2908 includes a first end wall, not shown, and a second end wall 2922 opposite and spaced from the first end wall. Still in the illustrated embodiment, the third container 2910 includes an outer side wall 2924, a pair of inner side wall sections 2926 opposite the outer side wall 2924, a first end wall not shown, and a second end wall 2928 disposed orthogonally to the outer side wall 2924 and the inner side wall sections 2926.

In the illustrated embodiment, the inner side wall of the first container 2906, usually located opposite the outer side wall 2920, was removed by the manufacturer or the user. Similarly, the side walls of the second container 2908 were also removed by the manufacturer or the user to allow communication between the first and second containers 2906, 2908. Furthermore, the inner side wall sections 2926 of the third container 2910 are parallel to each other but spaced from each other to define an opening, not shown, which allows communication between the second container 2908 and the third container 2910.

Figure 33:
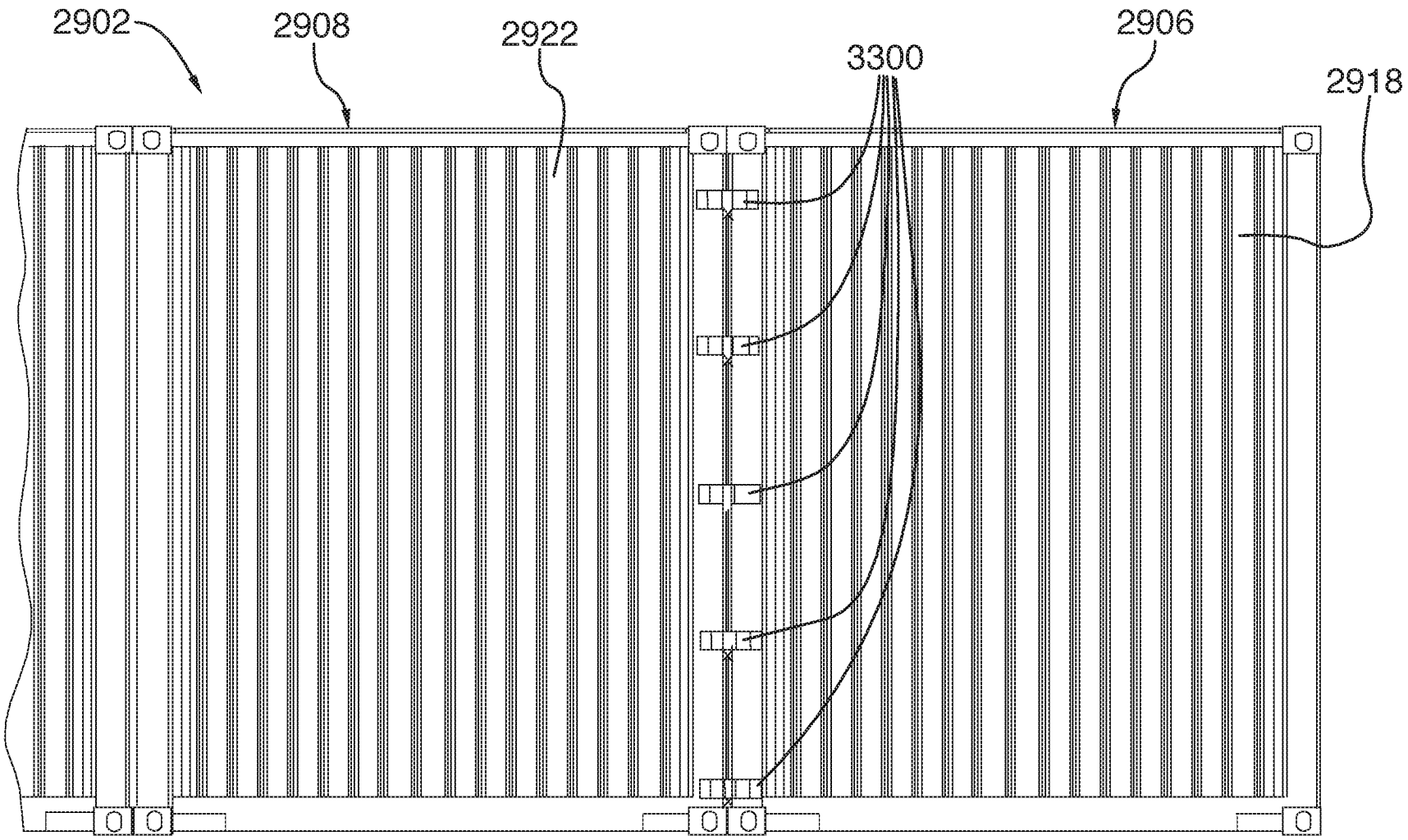
FIG. 33 is a rear elevation view of the building structure shown in FIG. 29, showing the lateral attachment assemblies between the first and second containers.

Referring to FIGS. 29, 30 and 33, the container attachment assembly includes a plurality of top attachment subassemblies 2950 and a plurality of lateral attachment subassemblies 3300. In the illustrated embodiment, the top attachment subassemblies 2950 are disposed between the first and second containers 2906, 2908 and between the second and third containers 2908, 2910. Still in the illustrated embodiment, the plurality of top attachment subassemblies 2950 are spaced from each other and generally distributed between the end walls of the first and second containers 2906, 2908.

Now turning to FIGS. 31 and 32, the top attachment subassemblies 2950 between the first and second containers 2906, 2908 will be described. It will be understood that the top attachment subassemblies 2950 between the second and third containers 2908, 2910 are generally similar and will require no further description.

Figure 31:
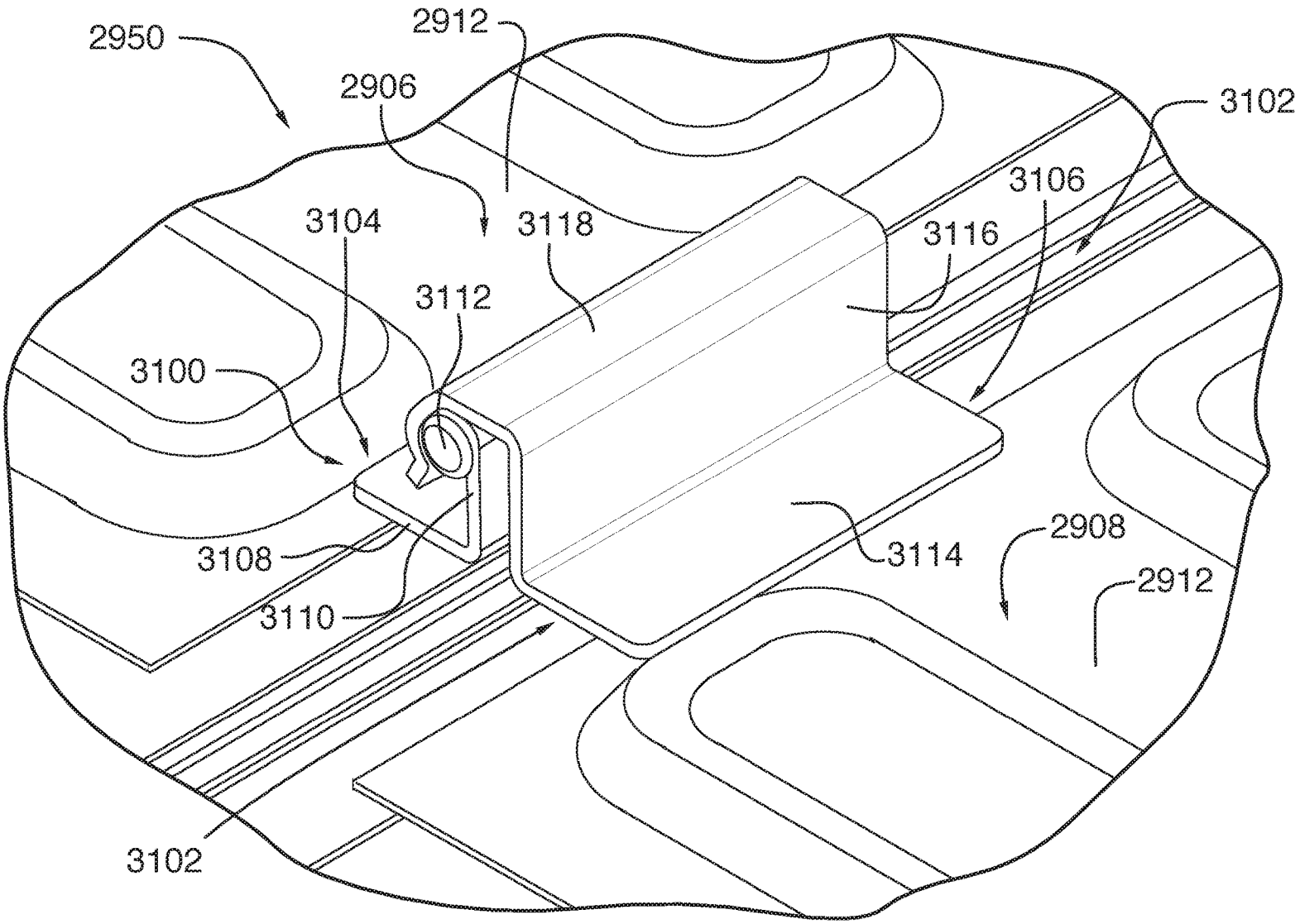
FIG. 31 is a further enlarged portion of the perspective view of the building structure illustrated in FIG. 29, showing details of one of the top attachment subassemblies.
Figure 32:
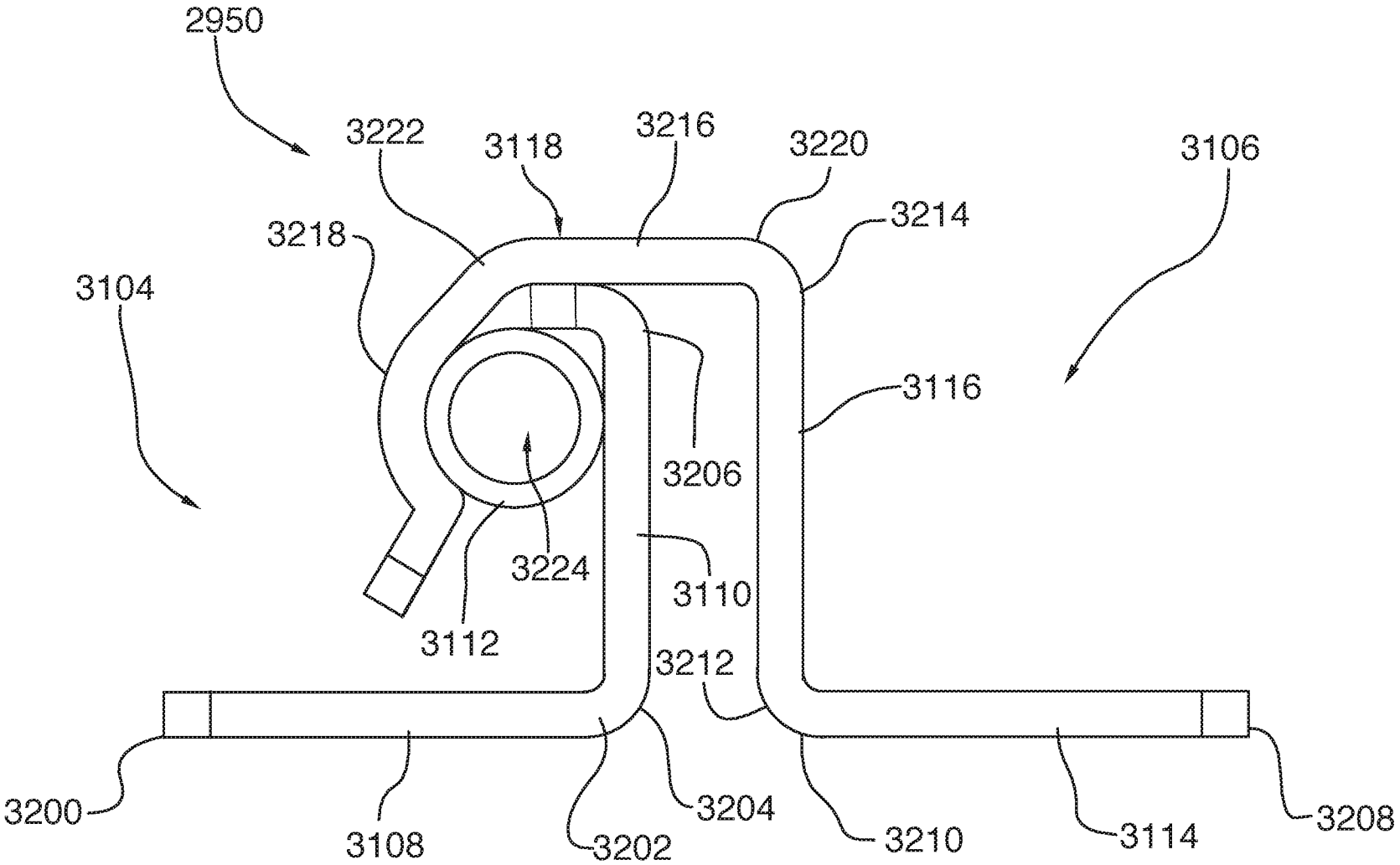
FIG. 32 is a side elevation view of a top attachment subassembly for the building structure illustrated in FIG. 29.

In the embodiment illustrated in FIGS. 31 and 32, each top attachment subassembly 2950 includes a first top attachment member 3100 secured to the roof panel 2912 of the first container 2906 and a second top attachment member 3102 secured to the roof panel 2912 of the second container 2908. The first top attachment member 3100 is adapted to engage the second top attachment member 3102 to thereby attach together the first and second containers 2906, 2908. In the illustrated embodiment, the first top attachment member 3100 includes a male connector 3104 and the second top attachment member 3102 includes a female connector 3106. Alternatively, the first top attachment member 3100 could include a female connector and the second top attachment member 3102 could include a male connector.

In the illustrated embodiment, the male connector 3104 includes a first flat portion 3108 adapted to be disposed horizontally against the roof panel 2912 of the first container 2906, a second flat portion 3110 extending orthogonally to and upwardly from the first flat portion 3108 and a cylindrical portion 3112 connected to the second flat portion 3110. Specifically, the first flat portion 3108 includes a first side end 3200 disposed away from the second container 2908 and a second side end 3202 disposed towards the second container 2908. The first flat portion 3108 is adapted to be secured to the roof panel 2912 of the first container 2906 using fasteners or other securing techniques such as welding or any other securing technique that a skilled person would consider appropriate. The second flat portion 3110 includes a bottom end 3204 connected to the second side end 3202 of the first flat portion 3108 and an upper end 3206 located away from the bottom end 3204. The first and second flat portions 3108, 3110 are generally elongated and extend generally parallel to the longitudinal axes of the first and second containers 2906, 2908.

In the illustrated embodiment, the cylindrical portion 3112 is also generally elongated and extends parallel to the first and second flat portions 3108, 3110. Specifically, the cylindrical portion 3112 is connected to the upper end 3206 of the second flat portion 3110 and is disposed away from the second container 2908 and above the first flat portion 3108.

In one embodiment, the cylindrical portion 3112 is secured to the second flat portion 3110 using securing means known to a skilled person such as welding or the like. Alternatively, the cylindrical portion 3112 could be provided as a separate piece. Specifically, the cylindrical portion 3112 could include a locking rod member which is slid between the male and female connectors 3104, 3106 once the first and second containers 2906, 2908 have been positioned side-by-side and adjacent each other to prevent movement of the first container 2906 relative to the second container 2908.

Still in the illustrated embodiment, the female connector 3106 includes a first flat portion 3114 adapted to be disposed horizontally against the roof panel 2912 of the second container 2908, a second flat portion 3116 extending orthogonally to and upwardly from the first flat portion and a hook portion 3118 connected to the second flat portion 3116 and extending towards the first container 2906. Specifically, the first flat portion 3114 includes a first side end 3208 disposed away from the first container 2906 and a second side end 3210 disposed towards the first container 2906. The first flat portion 3114 is adapted to be secured to the roof panel 2912 of the second container 2908 using fasteners or other securing techniques such as welding or any other securing technique that a skilled person would consider appropriate. The second flat portion 3116 includes a bottom end 3212 connected to the second side end 3210 of the first flat portion 3114 and an upper end 3214 located away from the bottom end 3212. The first and second flat portions 3114, 3116 are generally elongated and extend generally parallel to the longitudinal axes of the first and second containers 2906, 2908.

In the illustrated embodiment, the hook portion 3118 includes a generally horizontal panel 3216 which is connected to and extends away from the upper end 3214 of the second flat portion 3116 and a hook member 3218 which curves downwardly from the horizontal panel 3216. Specifically, the horizontal panel 3216 includes a first side end 3220 connected to the upper end 3214 of the second flat portion 3116 and a second side end 3222 located away from the first side end 3220. The hook member 3218 is connected to the second side end 3222 of the horizontal panel 3216 and curves convexly away from the second container 2908 to define a cylindrical recess 3224 sized and shaped to receive the cylindrical portion 3112 of the male connector 3104.

When the first and second containers 2906, 2908 are positioned side-by-side and adjacent each other, the second container 2908 may be lowered such that the cylindrical portion 3112 of the male connector 3104 is received in the cylindrical recess of the female connector 3106 to thereby prevent movement of the male and female connectors 3104, 3106 away from each other. Alternatively, the first and second containers 2906, 2908 could be placed side-by-side and adjacent each other, and the male and female connectors 3104, 3106 could then be secured to the roof panel 2912 of the first and second containers 2906, 2908. As also described above, the cylindrical portion 3112 could be slid between the male and the female connectors 3104, 3106 once the first and second containers 2906, 2908 have been positioned side-by-side and adjacent each other to prevent movement of the first container 2906 relative to the second container 2908.

In one embodiment, the building structure 2900 may further include one or more gaskets or seals adapted to be positioned between the first and second containers 2906, 2908 and thereby seal together the first and second containers 2906, 2908. Alternatively, a sealant material could be applied between the first and second containers 2906, 2908 after the first and second containers 2906, 2908 have been placed side-by-side and adjacent each other.

Figure 34:
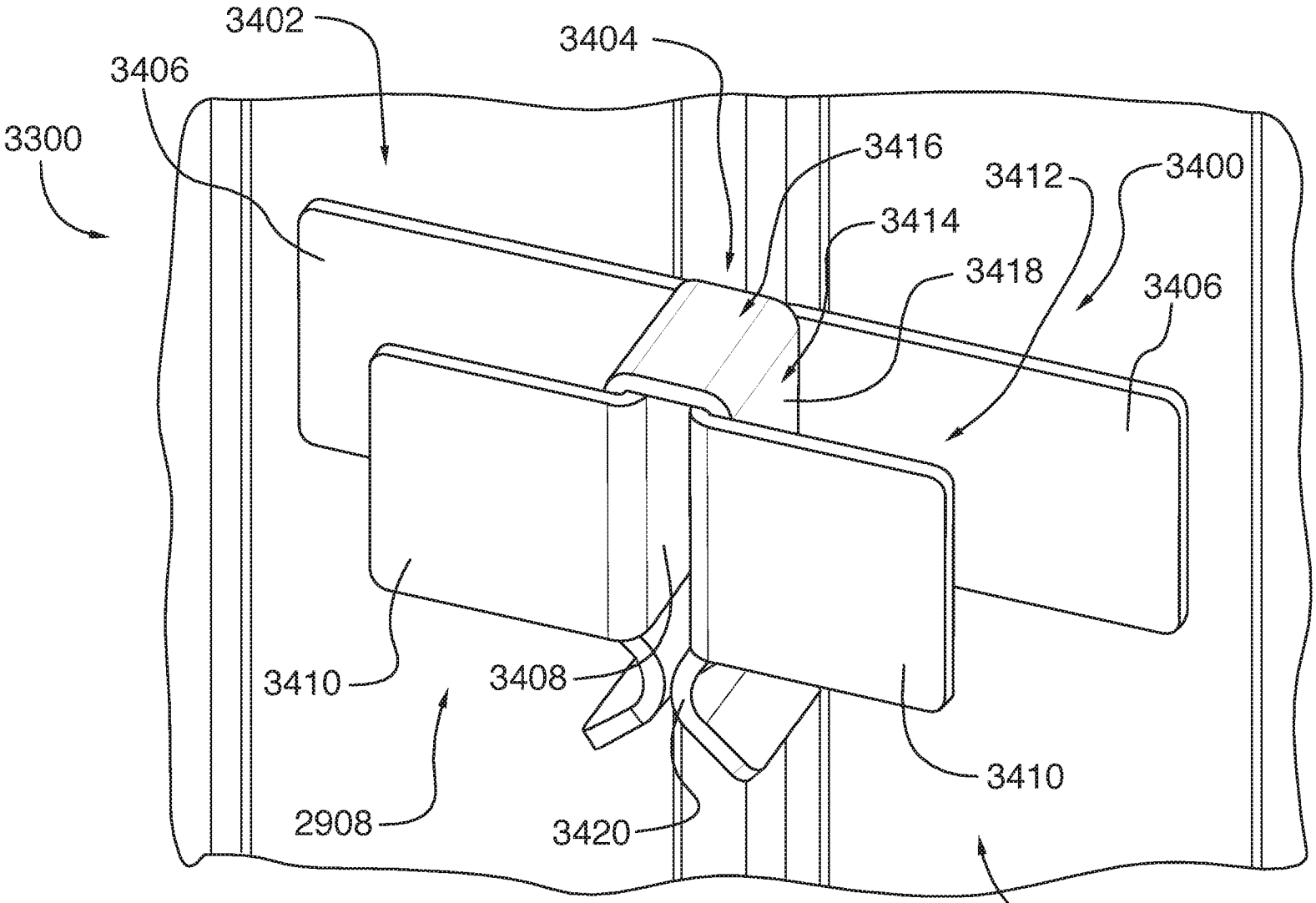
FIG. 34 is a top perspective view of one of the lateral attachment assemblies illustrated in FIG. 33.

Now referring to FIGS. 33 and 34, the first and second containers 2906, 2908 are further connected together by the lateral attachment subassemblies 3300. Specifically, the lateral attachment subassemblies 3300 are spaced from each other and generally distributed between the roof panel 2912 and the floor 2914 of the first and second containers 2906, 2908. Each lateral attachment subassembly 3300 includes a first lateral hook member 3400 secured to the second end wall 2918 of the first container 2906, a second lateral hook member 3402 secured to the second end wall 2922 of the second container 2908 and a connecting clip 3404 removably fastening the first and second lateral hook members 3400, 3402 together.

In the illustrated embodiment, each lateral hook member 3400, 3402 includes a first flat portion 3406 adapted to be disposed vertically against the second end wall 2918, 2922 of a corresponding one of the first and second containers 2906, 2908, a second flat portion 3408 disposed orthogonally to and extending away from the first flat portion 3406 and a third flat portion 3410 extending away from the second flat portion 3408. Specifically, the second flat portion 3408 is disposed towards the other container 2906 or 2908 and the third flat portion 3410 is disposed opposite and parallel to the first flat portion 3406 to define a rectangular receiving recess 3412 between the first, second and third flat portions 3406, 3408, 3410. As shown in FIG. 34, the first and lateral hook members 3400, 3402 are mirror images of each other.

Still in the illustrated embodiment, the connecting clip 3404 includes a pair of opposite legs 3414 extending downwardly from a horizontal central portion 3416 connecting the legs 3414 together. Each leg 3414 includes an upper straight portion 3418 and a bottom curved portion 3420 which curves convexly towards the opposite leg. The legs 3414 are adapted to be received in the receiving recesses 3412 of the lateral hook members 3400, 3402. Specifically, the second flat portions 3408 of the lateral hook members 3400, 3402 are spaced from each other by a first distance and the upper straight portions 3418 of the legs 3414 are spaced from each other by a second distance which is slightly greater than the first distance such that the upper straight portions 3418 are disposed against the second flat portions 3408 of the lateral hook members 3400, 3402. Furthermore, the bottom curved portions 3420 of the legs 3414 are spaced from each other by a third distance which is smaller than the first and second distances, such that the bottom curved portions 3420 extends under the second flat portions 3408 of the lateral hook members 3400, 3402 to prevent the connecting clip 3404 from sliding off upwardly.

In one embodiment, the legs 3414 of the connecting clip 3404 are generally resiliently connected to the horizontal central portion 3416 and are adapted to spread apart as the connecting clip 3404 is lowered over the lateral hook members 3400, 3402, and then be biased back into their initial position in which the upper straight portions 3418 of the legs 3414 are parallel to each other once the bottom curved portion 3420 is lowered below the lateral hook members 3400, 3402.

It will be appreciated that the lateral attachment subassemblies 3300 further prevents the containers 2906, 2908 from moving away from each other once the containers 2906, 2908 are positioned side-by-side in a desired position.

It will further be appreciated that the configurations described above are merely examples of building structures, and that the building structure may be configured according to various alternative configuration. In another embodiment, the shell could include more than three containers and/or various combinations of 20-foot long containers, 40-foot long containers or any other containers that a skilled person may consider appropriate. In yet another embodiment, the shell could further include multiple levels consisting of multiple containers stacked vertically.

The invention claimed is:

1. A hurricane-resistant modular building structure comprising:

a structural frame defining an interior enclosure sized and shaped to house at least one individual, the structural frame comprising a construction module configured to be stacked with other construction modules of the same configuration;

a plurality of exterior panel assemblies attached to the structural frame;

a mounting member extending outwardly from the structural frame, the mounting member having a first end secured to the structural frame and a second end located away from the structural frame;

a top corner brace adapted to be supported by a top member of the structural frame, the top corner brace comprising first and second planar surfaces defining a hollow cross-section of the top corner brace; and an exterior wall panel secured to both the second end of the mounting member and to the top corner brace so as to be spaced from the structural frame.

2. The building structure as claimed in claim 1, wherein the mounting member includes an elongated body disposed generally orthogonally to the exterior wall panel.

3. The building structure as claimed in claim 1, wherein the exterior wall panel includes an interior face disposed towards the structural frame, an exterior face disposed away from the structural frame and at least one channel defined in the interior face to receive the second end of the mounting member.

4. The building structure as claimed in claim 1, further comprising a layer of insulating material disposed between the exterior wall panel and the structural frame.

5. The building structure as claimed in claim 1, wherein the construction module comprises at least one shipping container.

6. The building structure as claimed in claim 1, the building structure further comprising a plurality of dividing wall sections secured to the structural frame inside the interior enclosure, each of the dividing wall sections defining a wall frame enclosing a plurality of perforated vertical elements.

7. The building structure as claimed in claim 6, further including a plurality of mounting elements secured to one of a floor and a ceiling of the interior enclosure at a predetermined location, each dividing wall section being secured to the at least one of the plurality of mounting elements to position at least one interior wall panel to the predetermined location.

8. The building structure as claimed in claim 6, wherein the plurality of dividing wall sections include a wall frame and a plurality of interior wall panels enclosing the wall frame.

9. The building structure as claimed in claim 1, the building structure further comprising a wall section assembly, the wall section assembly comprising at least one wall panel and at least one board connected to the at least one wall panel, the at least one board defining a passage for allowing at least one of an electric or a plumbing element to run along the wall section assembly, the wall section assembly further comprising at least one perforated vertical element.

10. The building structure as claimed in claim 1, wherein the top corner brace further comprises third and fourth planar surfaces adapted to be affixed to the top member of the structural frame.

11. The building structure as claimed in claim 1, wherein the exterior wall panel is secured to at least one of the first and second planar surfaces of the top corner brace.

12. The building structure as claimed in claim 1, wherein the hollow cross-section of the top corner brace has a closed shape.

13. The building structure as claimed in claim 1, wherein the top corner brace further comprises a lug member adapted to receive an elongated fastener.

14. A kit for a hurricane-resistant modular building structure comprising:

a structural frame defining an interior enclosure sized and shaped to house at least one individual, the structural frame comprising a construction module configured to be stacked with other construction modules of the same configuration;

a plurality of exterior panel assemblies adapted to be attached to the structural frame;

a mounting member adapted to be secured to the structural frame so as to extend outwardly therefrom, the mounting member having a first end adapted to be secured to the structural frame and a second end located away from the first end;

a top corner brace adapted to be supported by a top member of the structural frame the top corner brace comprising first and second planar surfaces defining a hollow cross-section of the top corner brace; and an exterior wall panel adapted to be secured to both the second end of the mounting member and to the top corner brace so as to be spaced from the structural frame.

15. The kit as claimed in claim 14, wherein the mounting member includes an elongated body disposed generally orthogonally to the exterior wall panel.

16. The kit as claimed in claim 14, wherein the exterior wall panel includes an interior face adapted to be disposed towards the structural frame, an exterior face adapted to be disposed away from the structural frame and at least one channel defined in the interior face to receive the second end of the mounting member.

17. The kit as claimed in claim 14, further comprising a layer of insulating material adapted to be disposed between the exterior wall panel and the structural frame.

18. The kit as claimed in claim 14, wherein the construction module comprises at least one shipping container.

19. The kit as claimed in claim 14, the kit further comprising a plurality of dividing wall sections adapted to be secured to the structural frame inside the interior enclosure, each of the dividing wall sections defining a wall frame enclosing a plurality of perforated vertical elements.

20. The kit as claimed in claim 19, further including a plurality of mounting elements adapted to be secured to one of a floor and a ceiling of the interior enclosure at a predetermined location, each dividing wall section being secured to the at least one of the plurality of mounting elements to position at least one interior wall panel to the predetermined location.

21. The kit as claimed in claim 19, wherein the plurality of dividing wall sections include a plurality of interior wall panels enclosing the wall frame.

* * * * *